US012117235B2

(12) United States Patent
Kim et al.

(10) Patent No.: US 12,117,235 B2
(45) Date of Patent: Oct. 15, 2024

(54) VACUUM ADIABATIC BODY AND REFRIGERATOR

(71) Applicant: LG ELECTRONICS INC., Seoul (KR)

(72) Inventors: Bongjin Kim, Seoul (KR); Hyeunsik Nam, Seoul (KR); Deokhyun Youn, Seoul (KR); Jaehyun Bae, Seoul (KR); Jangseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 343 days.

(21) Appl. No.: 17/620,086

(22) PCT Filed: Jul. 9, 2020

(86) PCT No.: PCT/KR2020/008974
§ 371 (c)(1),
(2) Date: Dec. 16, 2021

(87) PCT Pub. No.: WO2021/006645
PCT Pub. Date: Jan. 14, 2021

(65) Prior Publication Data

US 2022/0307759 A1 Sep. 29, 2022

(30) Foreign Application Priority Data

Jul. 9, 2019 (KR) ..... 10-2019-0082727

(51) Int. Cl.
*F25D 23/06* (2006.01)
*F25D 11/02* (2006.01)
(Continued)

(52) U.S. Cl.
CPC ..... *F25D 23/067* (2013.01); *F25D 11/02* (2013.01); *F25D 23/028* (2013.01);
(Continued)

(58) Field of Classification Search
CPC ..... F25D 23/067; F25D 11/02; F25D 23/028; F25D 23/063; F25D 23/087;
(Continued)

(56) References Cited

U.S. PATENT DOCUMENTS

2004/0226956 A1 11/2004 Brooks
2008/0034779 A1 2/2008 Lee et al.
(Continued)

FOREIGN PATENT DOCUMENTS

AU 2016303866 A1 * 3/2018 ..... F16L 59/065
CN 1224493 A * 7/1999 ..... F25B 9/006
(Continued)

OTHER PUBLICATIONS

International Search Report and Written Opinion dated Oct. 20, 2020 issued in PCT Application No. PCT/KR2020/008974.
(Continued)

*Primary Examiner* — Hanh V Tran
(74) *Attorney, Agent, or Firm* — KED & ASSOCIATES, LLP

(57) ABSTRACT

Provided is a vacuum adiabatic body. The vacuum adiabatic body includes an outer case made of a metal material, which is thicker than a plate providing a vacuum space. The vacuum space provides two extension modules that extend in directions different from each other. Accordingly, a refrigerator door may be improved in adiabatic performance.

21 Claims, 36 Drawing Sheets

(51) Int. Cl.
*F25D 23/02* (2006.01)
*F25D 23/08* (2006.01)

(52) U.S. Cl.
CPC ..... *F25D 23/063* (2013.01); *F25D 23/087* (2013.01); *F25D 2201/12* (2013.01); *F25D 2201/14* (2013.01)

(58) Field of Classification Search
CPC ..... F25D 2201/12; F25D 2201/14; F25D 2317/061; F25D 2317/062; F25D 23/02; F25D 23/06; F25D 23/065; F25D 23/021; F25D 2323/022; F25C 2400/10; F16L 59/065; F16L 59/12
See application file for complete search history.

(56) References Cited

U.S. PATENT DOCUMENTS

| | | | | |
|---|---|---|---|---|
| 2015/0030800 | A1* | 1/2015 | Jung | B32B 27/306 428/69 |
| 2017/0023291 | A1* | 1/2017 | Kal | B32B 1/00 |
| 2018/0224198 | A1 | 8/2018 | Jung et al. | |
| 2018/0238610 | A1 | 8/2018 | Jung et al. | |
| 2019/0024968 | A1 | 1/2019 | Jung et al. | |
| 2021/0010741 | A1 | 1/2021 | Nam et al. | |

FOREIGN PATENT DOCUMENTS

| | | | | |
|---|---|---|---|---|
| CN | 103649658 | A * | 3/2014 | F16L 59/065 |
| CN | 106052276 | | 10/2016 | |
| CN | 205860612 | | 1/2017 | |
| CN | 106457770 | | 2/2017 | |
| CN | 107923698 | | 4/2018 | |
| CN | 108139142 | A * | 6/2018 | F16L 59/065 |
| EP | 2419685 | B1 * | 8/2018 | F25D 17/065 |
| JP | 10-2008-0014562 | | 2/2008 | |
| JP | 2013-002655 | | 1/2013 | |
| KR | 10-1999-0043536 | | 6/1999 | |
| KR | 10-0343719 | | 7/2002 | |
| KR | 10-2006-0041437 | | 5/2006 | |
| KR | 10-1332018 | | 11/2013 | |
| KR | 10-2015-0012712 | | 2/2015 | |
| KR | 10-2017-0016187 | | 2/2017 | |
| KR | 10-2017-0016243 | | 2/2017 | |
| KR | 10-2019-0070765 | | 6/2019 | |
| RU | 2553251 | | 6/2015 | |
| WO | WO-2013140658 | A1 * | 9/2013 | F25D 23/02 |
| WO | WO-2017023073 | A1 * | 2/2017 | F16L 59/065 |
| WO | WO-2017023075 | A1 * | 2/2017 | F16L 59/065 |
| WO | WO-2017023088 | A1 * | 2/2017 | F25D 19/006 |
| WO | WO-2017023100 | A1 * | 2/2017 | F16L 59/065 |
| WO | WO-2017023102 | A1 * | 2/2017 | F16L 59/065 |
| WO | WO-2019017138 | A1 * | 1/2019 | |
| WO | WO 2019-117598 | | 6/2019 | |
| WO | WO 2019-117601 | | 6/2019 | |

OTHER PUBLICATIONS

Partial Supplementary European Search Report dated Jun. 12, 2023 issued in Application No. 20836298.8.
Russian Office Action dated Sep. 15, 2023 issued in Application No. 2022102806/10(005998).
Chinese Office Action dated Mar. 18, 2023 issued in Application No. 202080050092.8.

* cited by examiner

[Fig. 1]
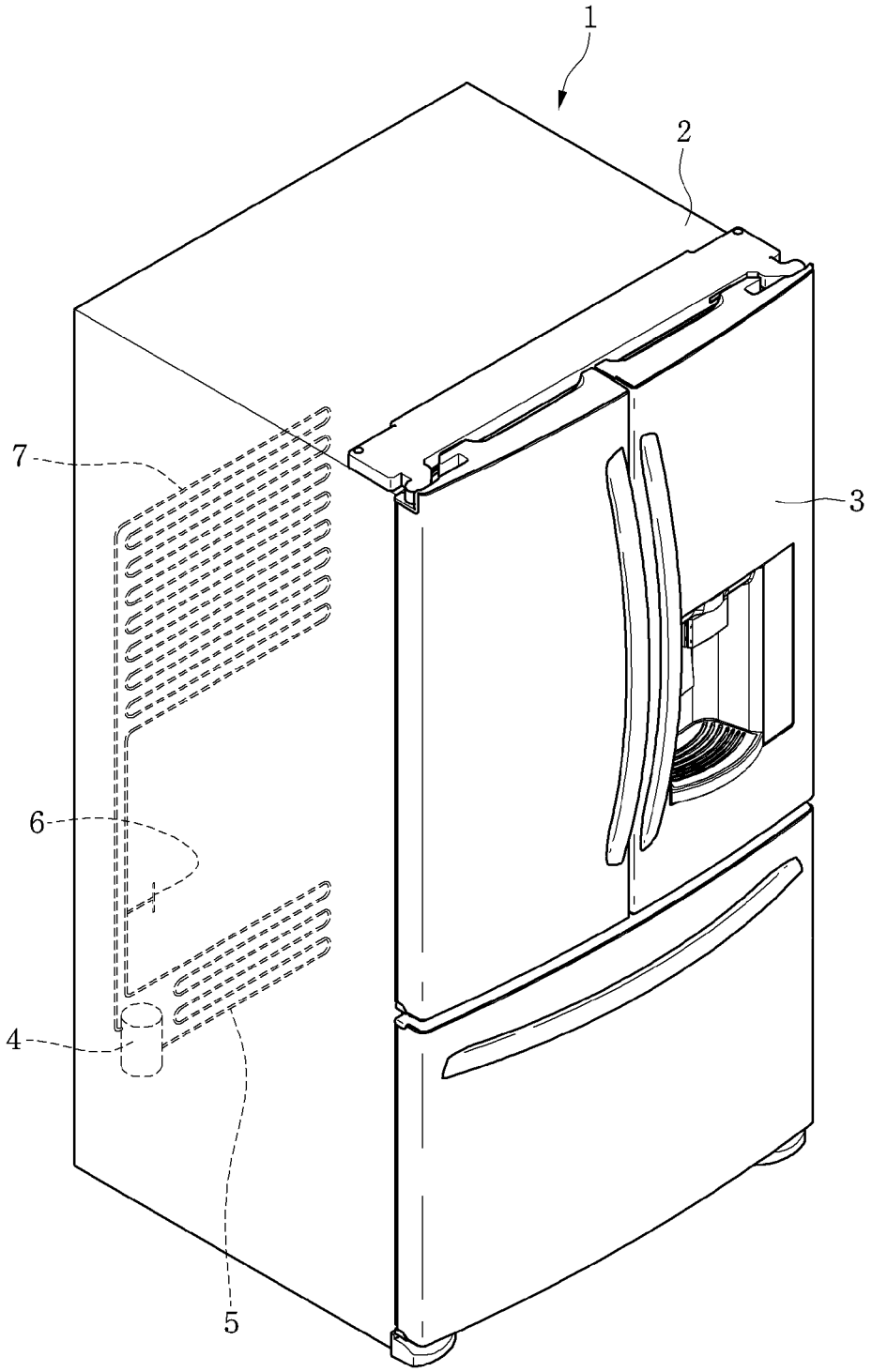

[Fig. 2]
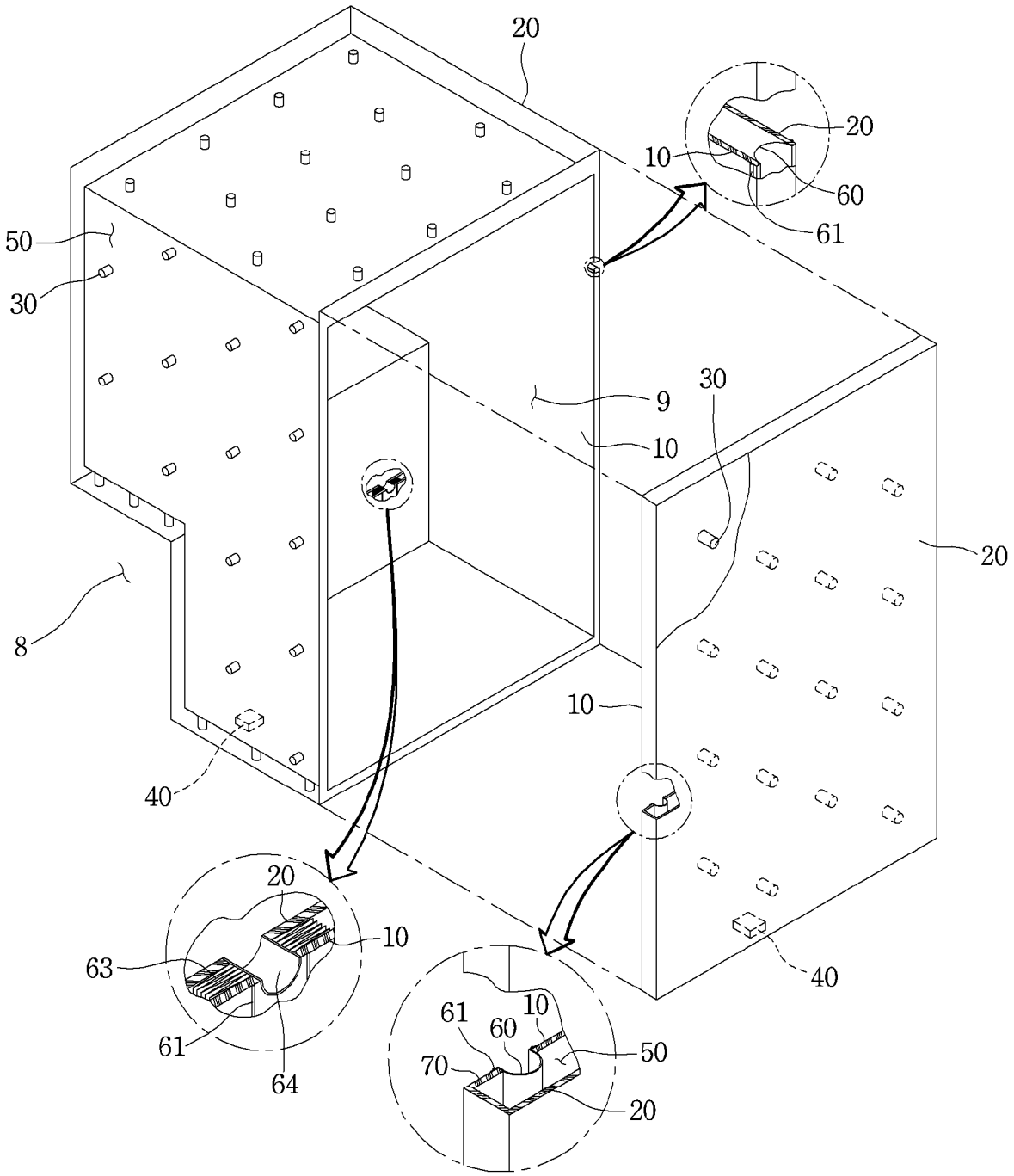

[Fig. 3]
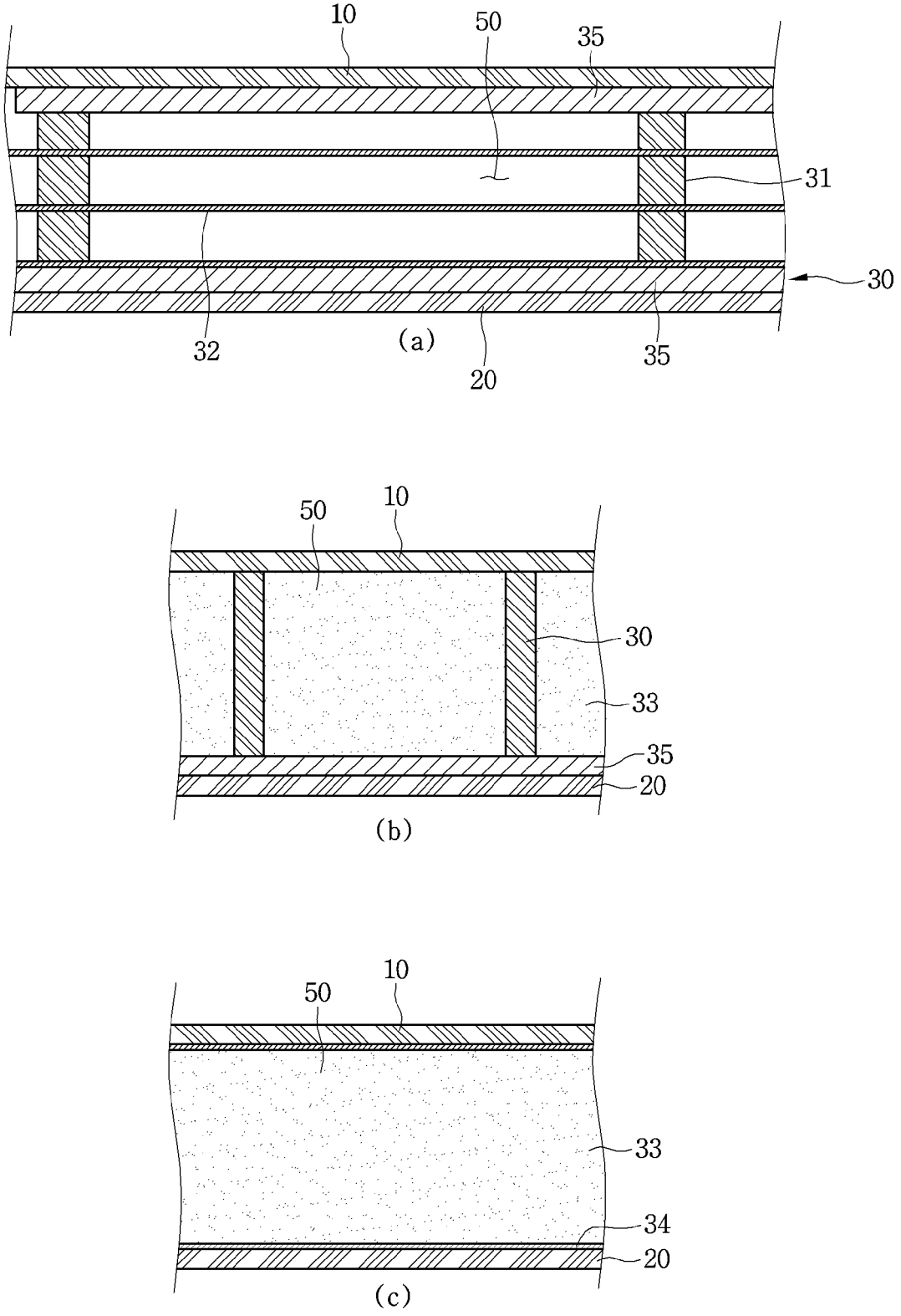

[Fig. 4]
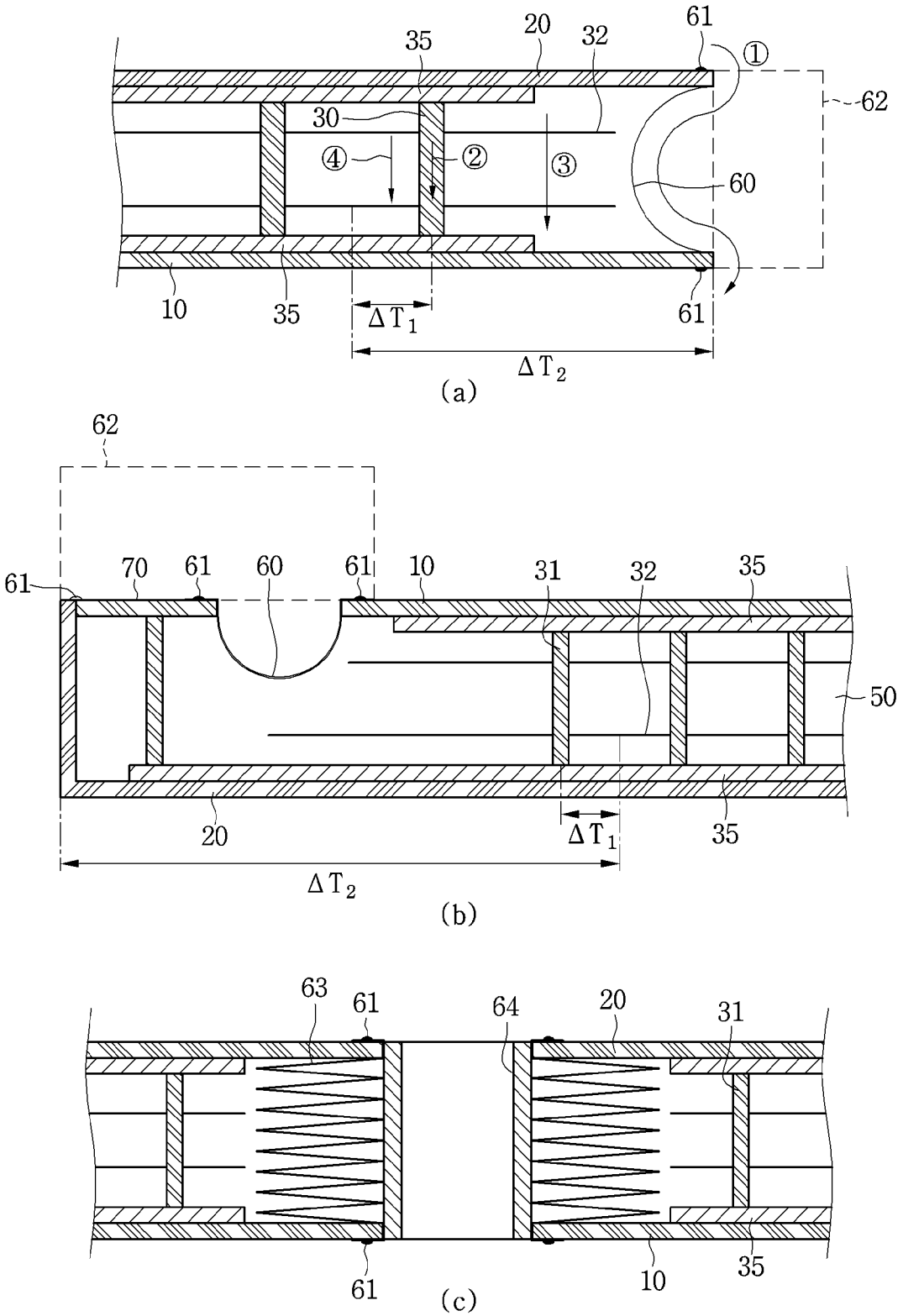

[Fig. 5]
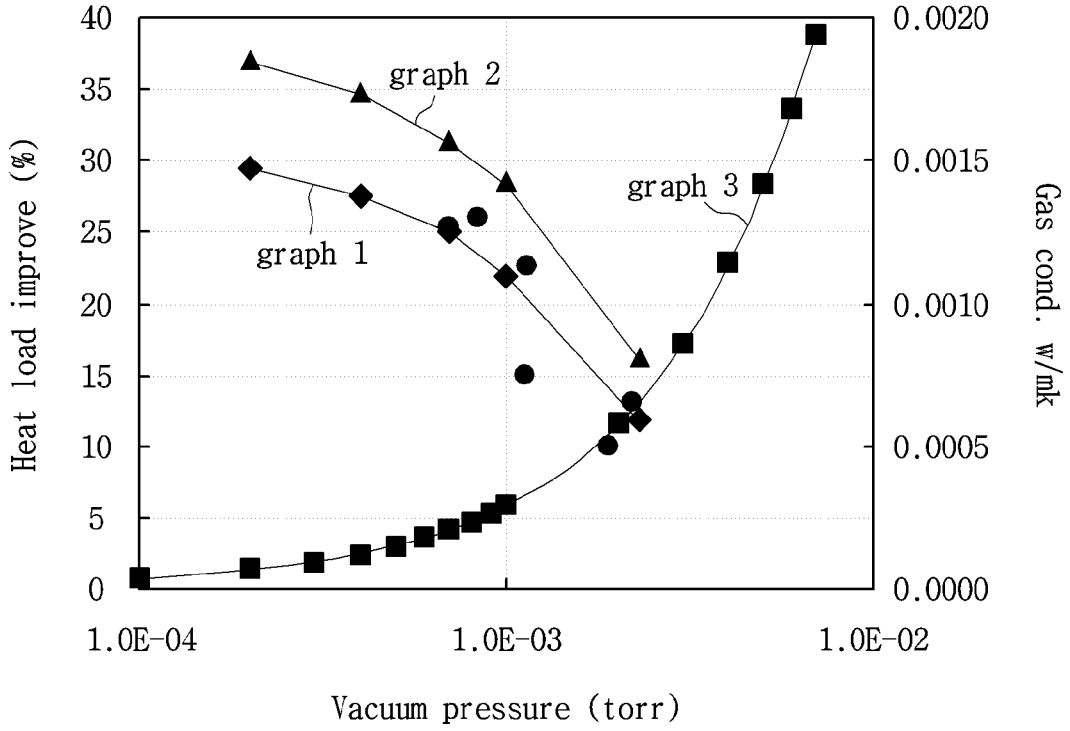
[Fig. 6]
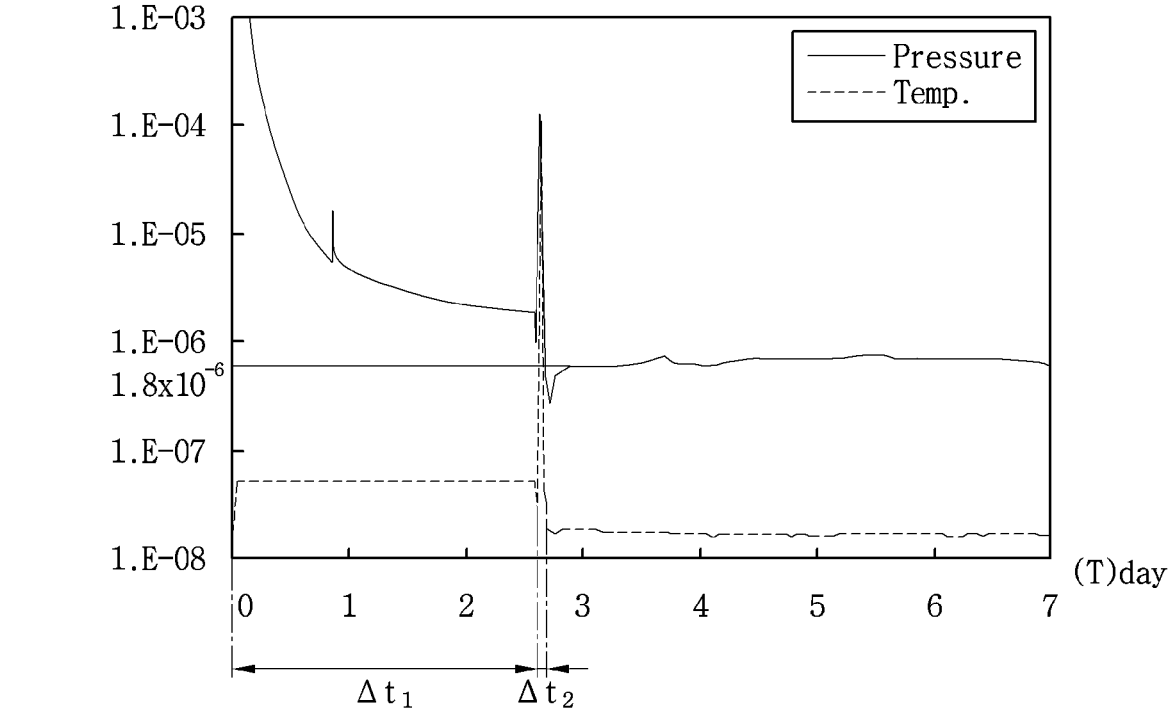

[Fig. 7]
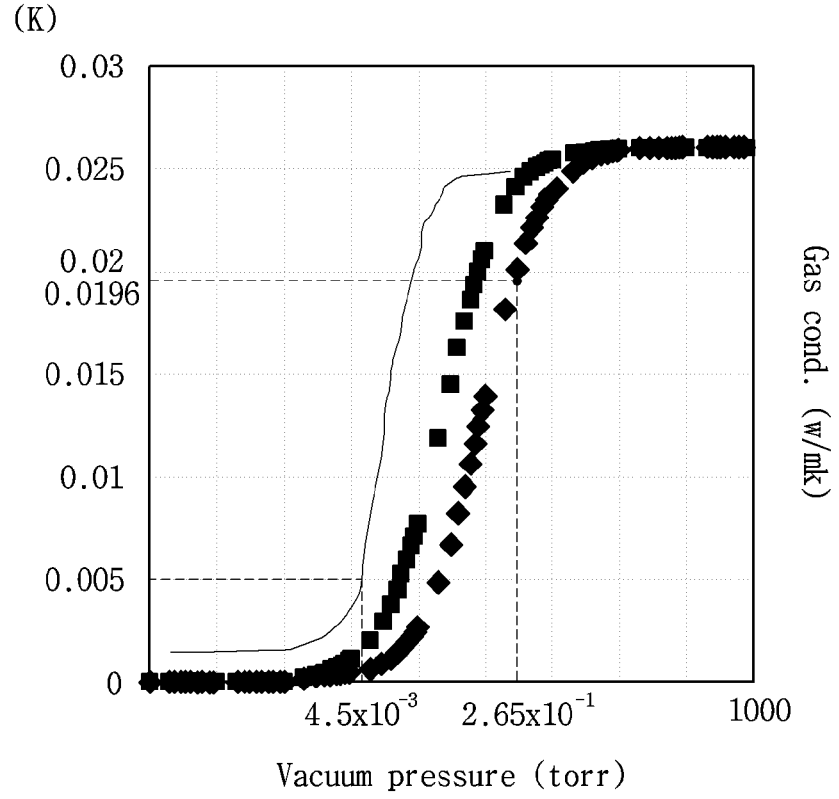

[Fig. 8]
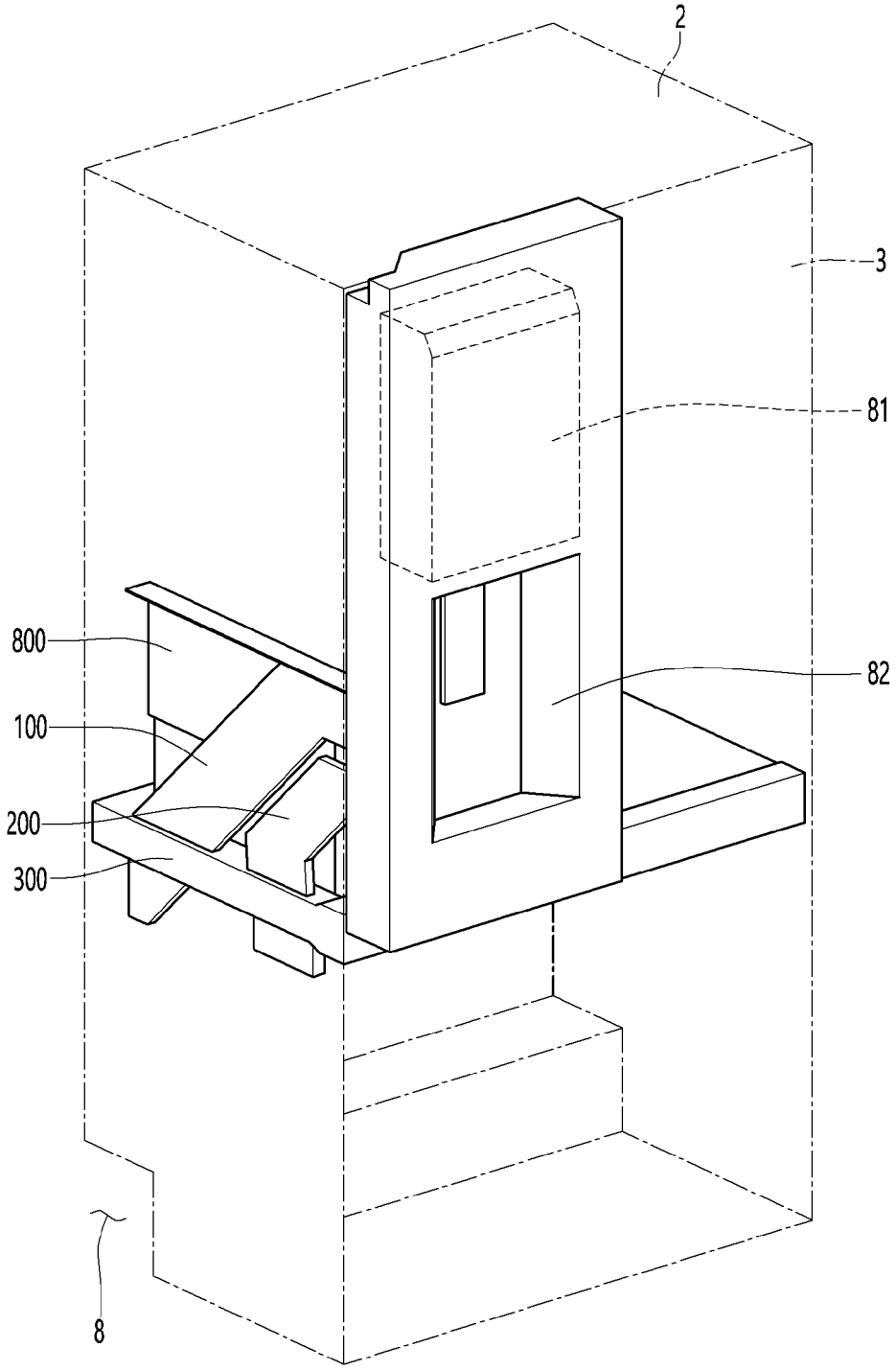

[Fig. 9]
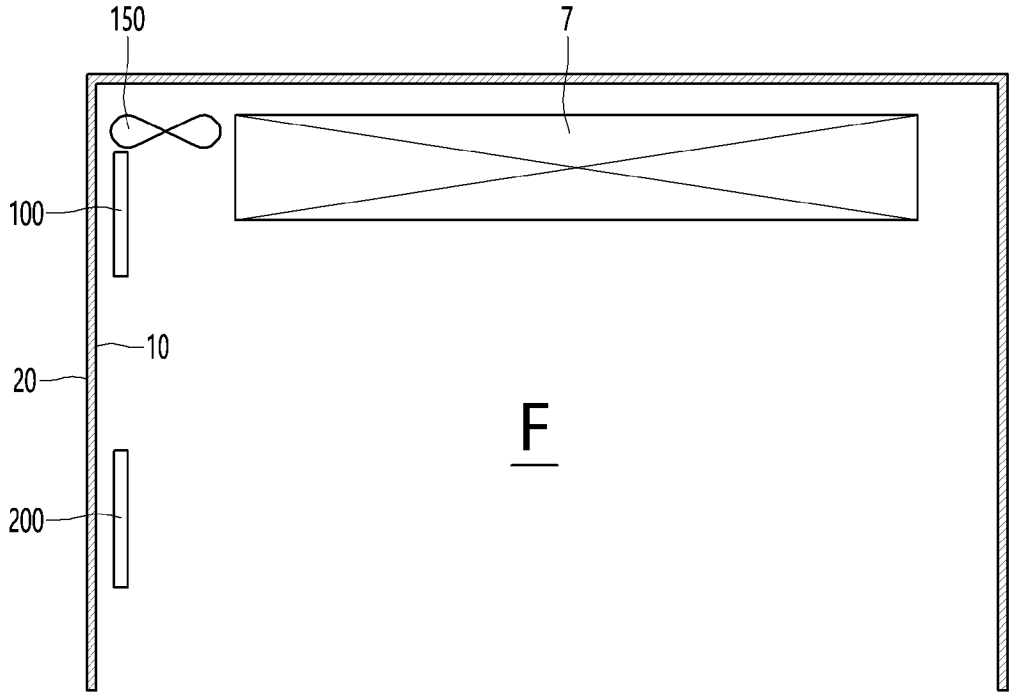
[Fig. 10]
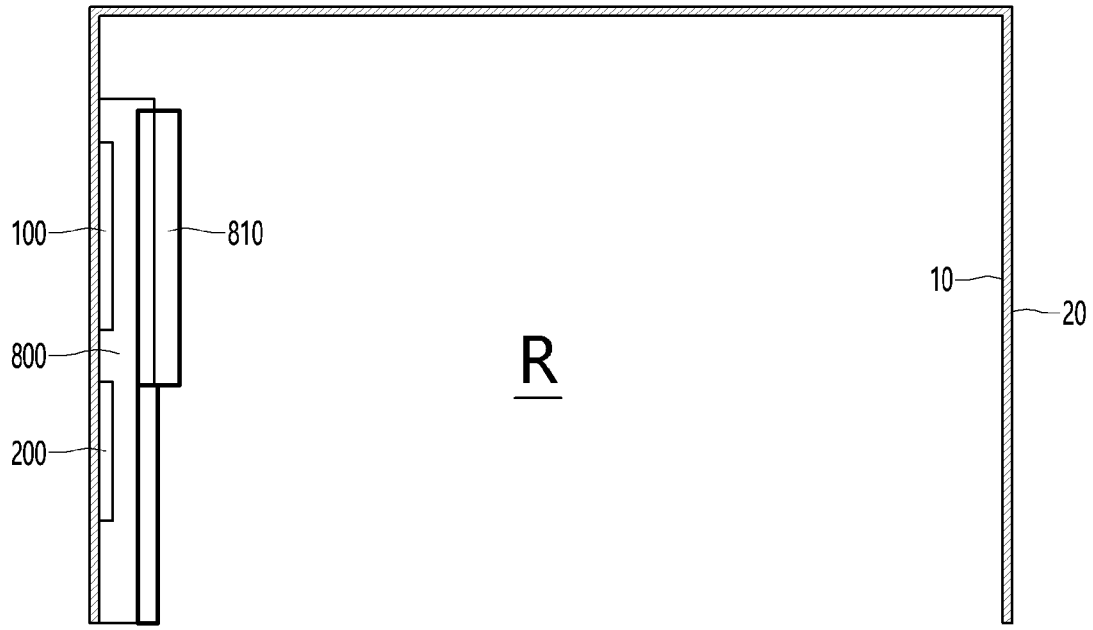

[Fig. 11]
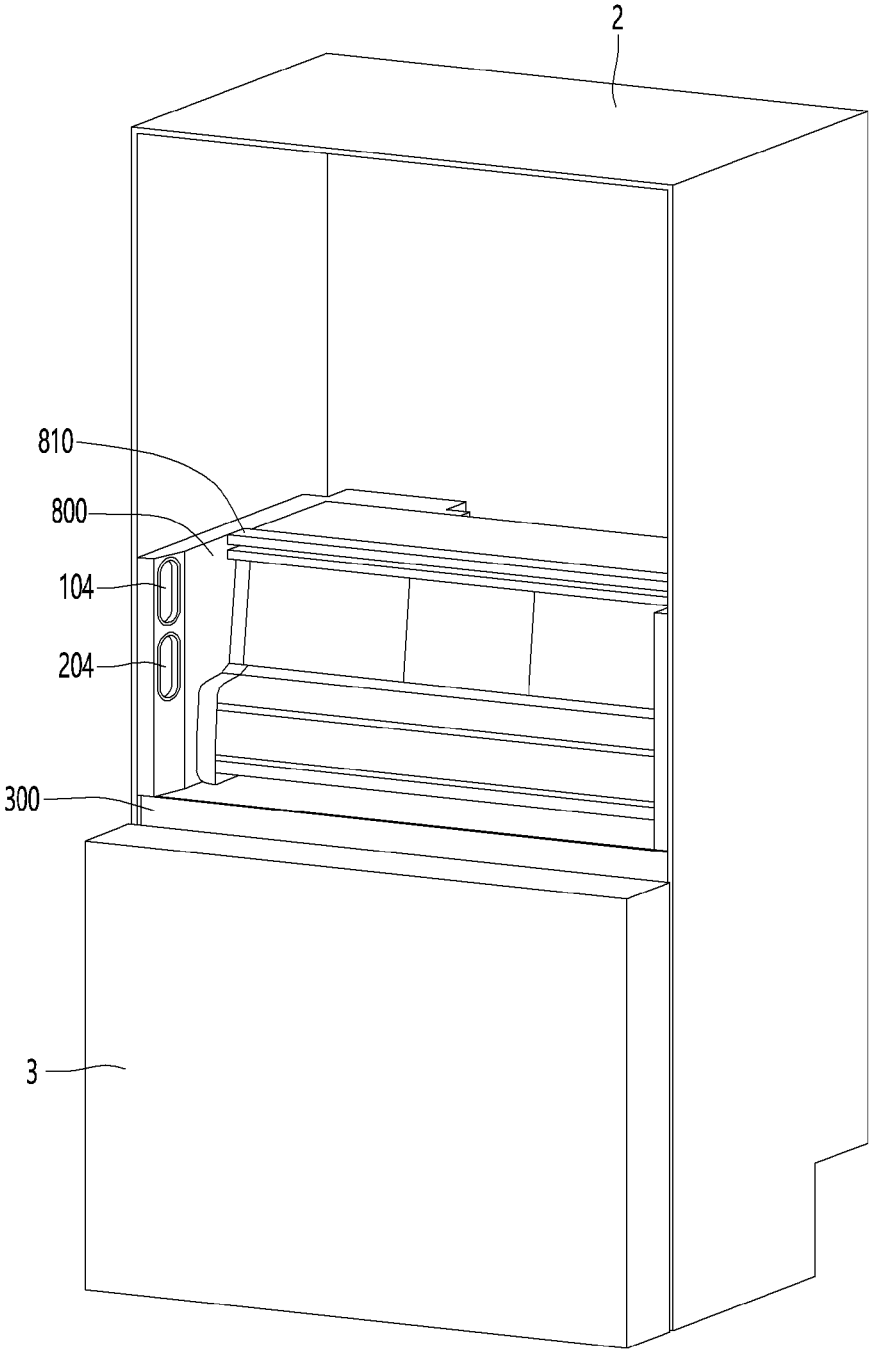

[Fig. 12]
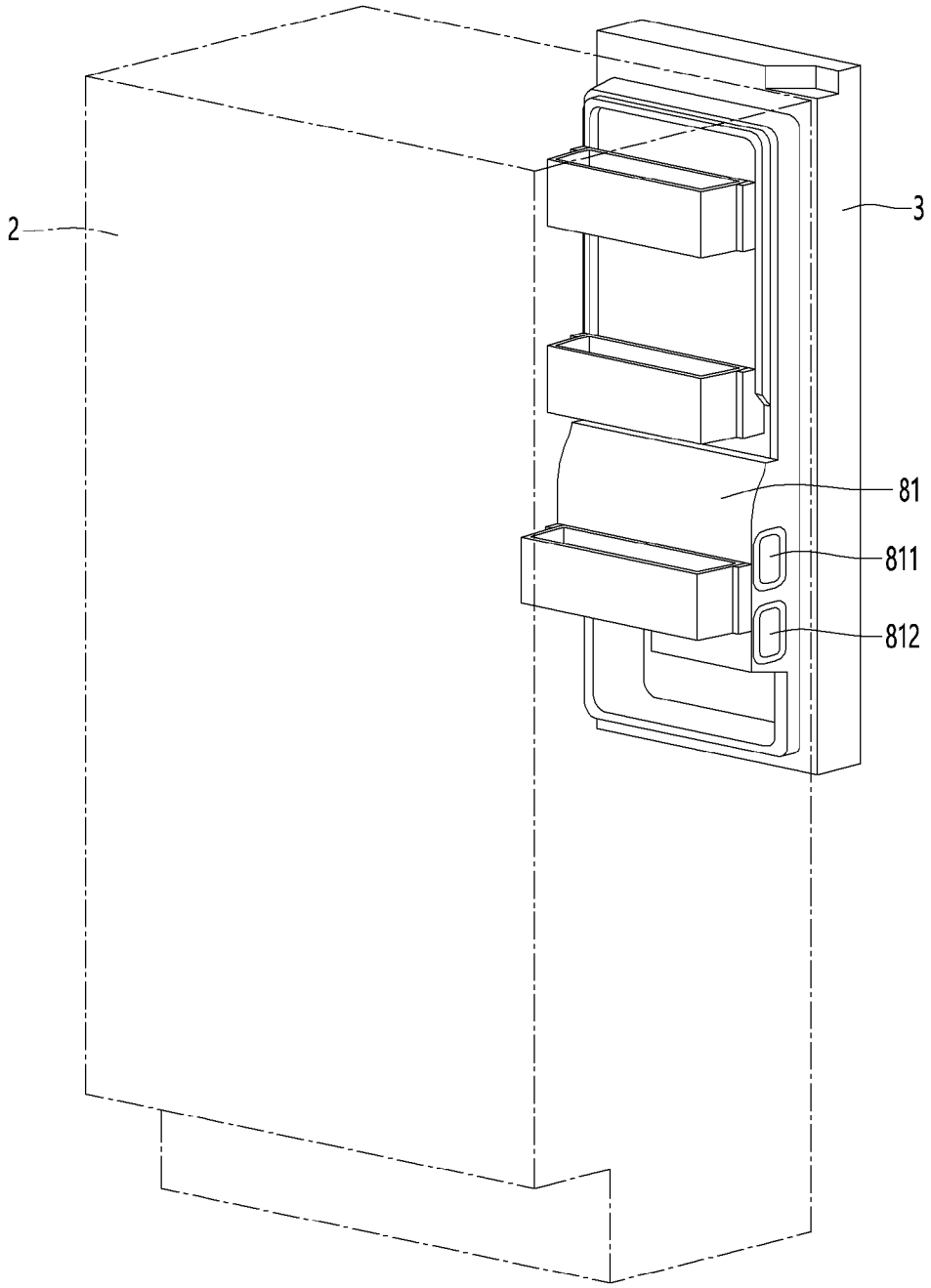

[Fig. 13]
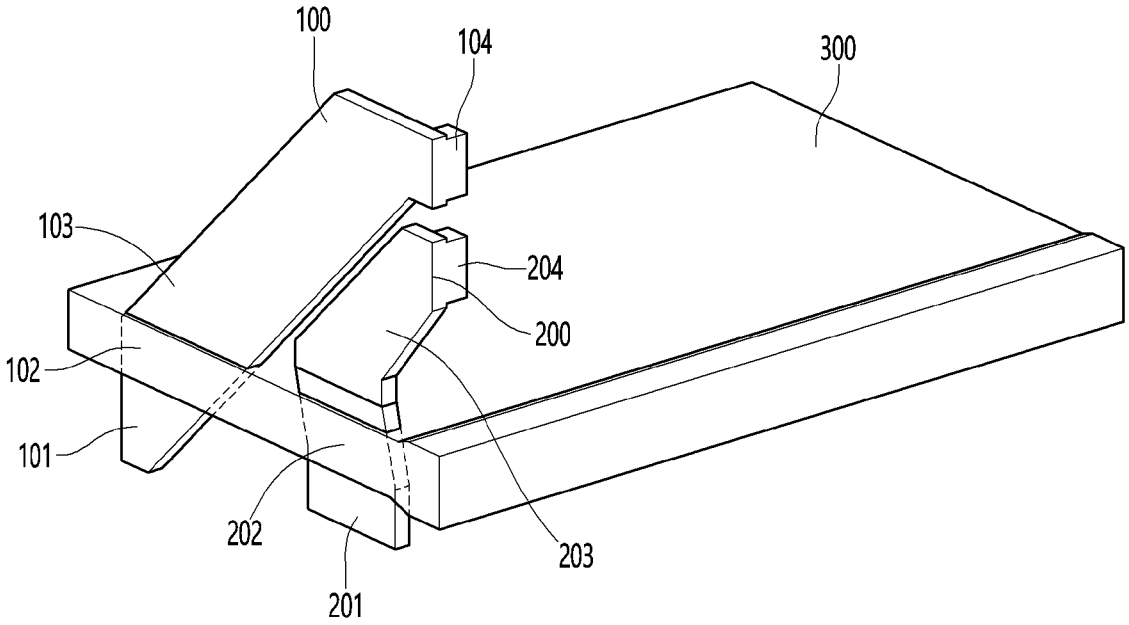

[Fig. 14]
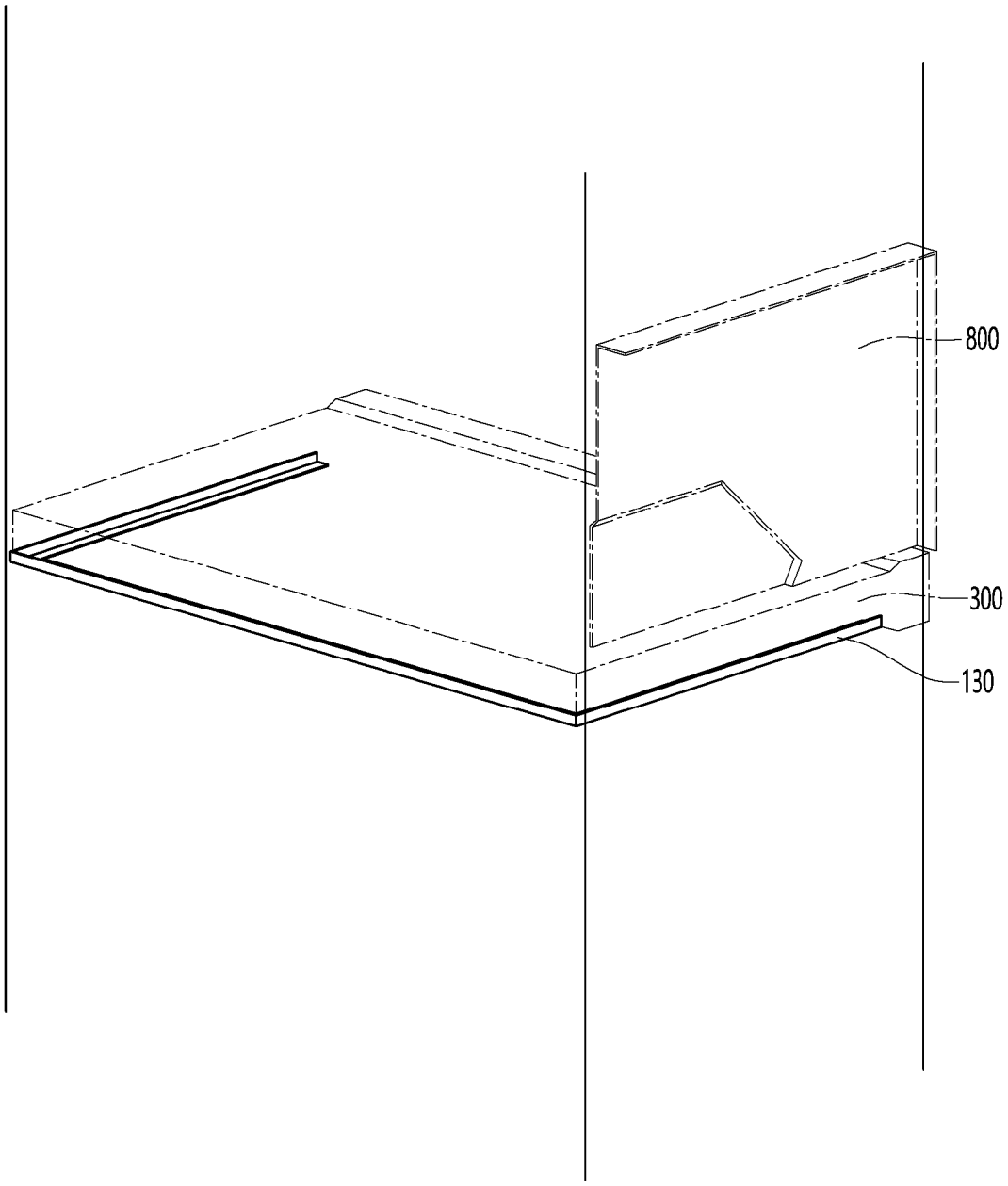

[Fig. 15]
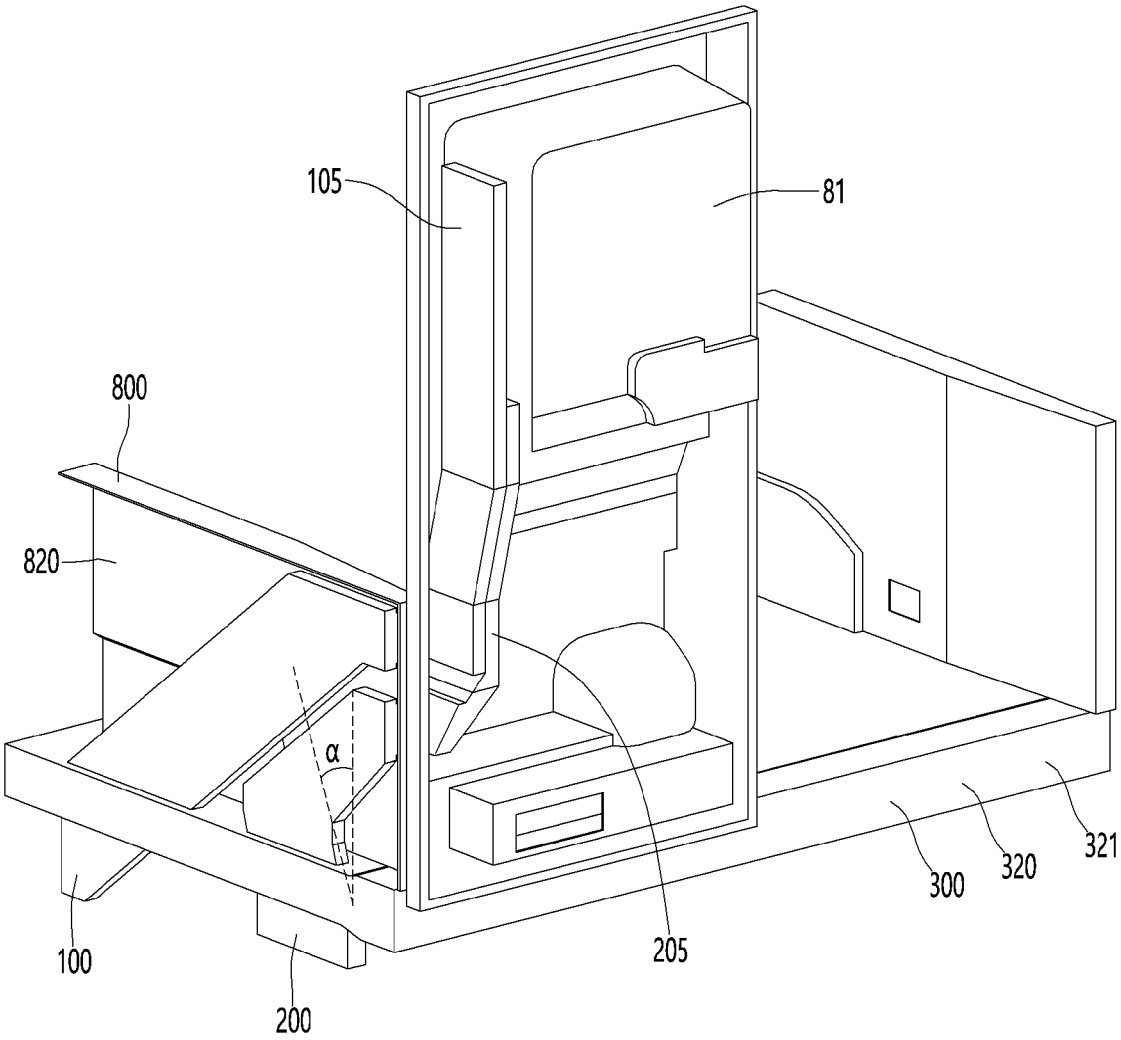

[Fig. 16]
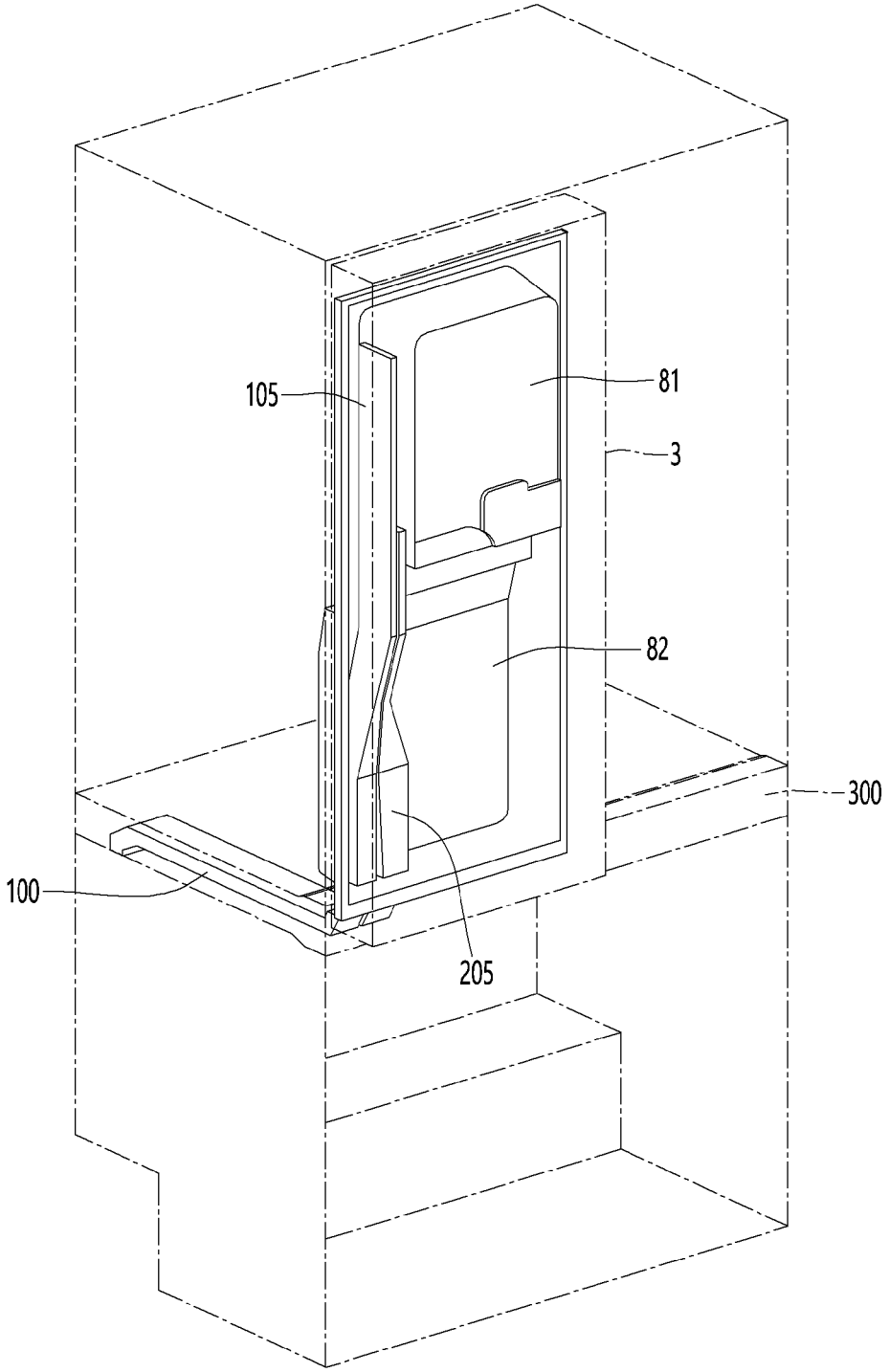

[Fig. 17]
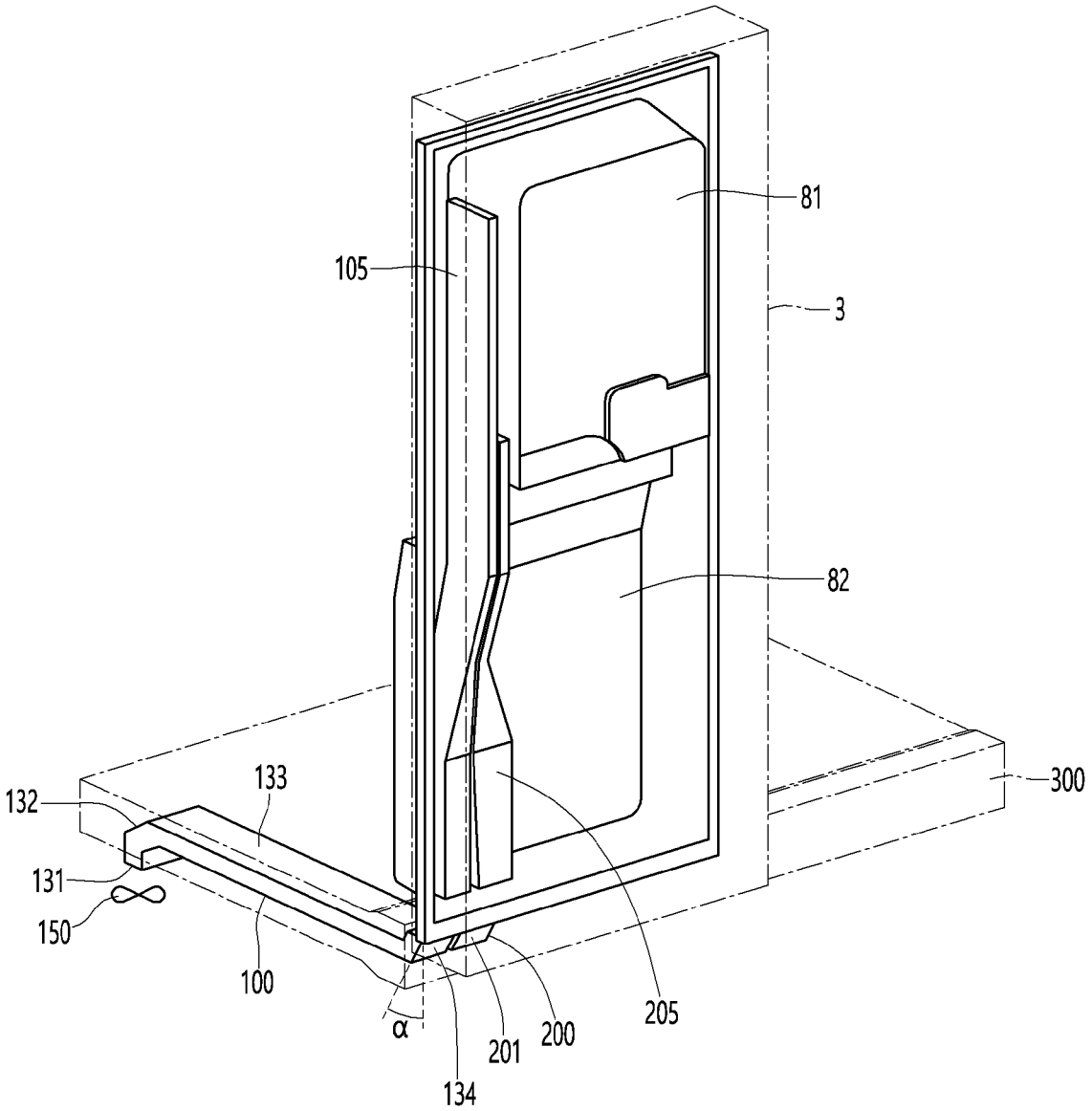

[Fig. 18]
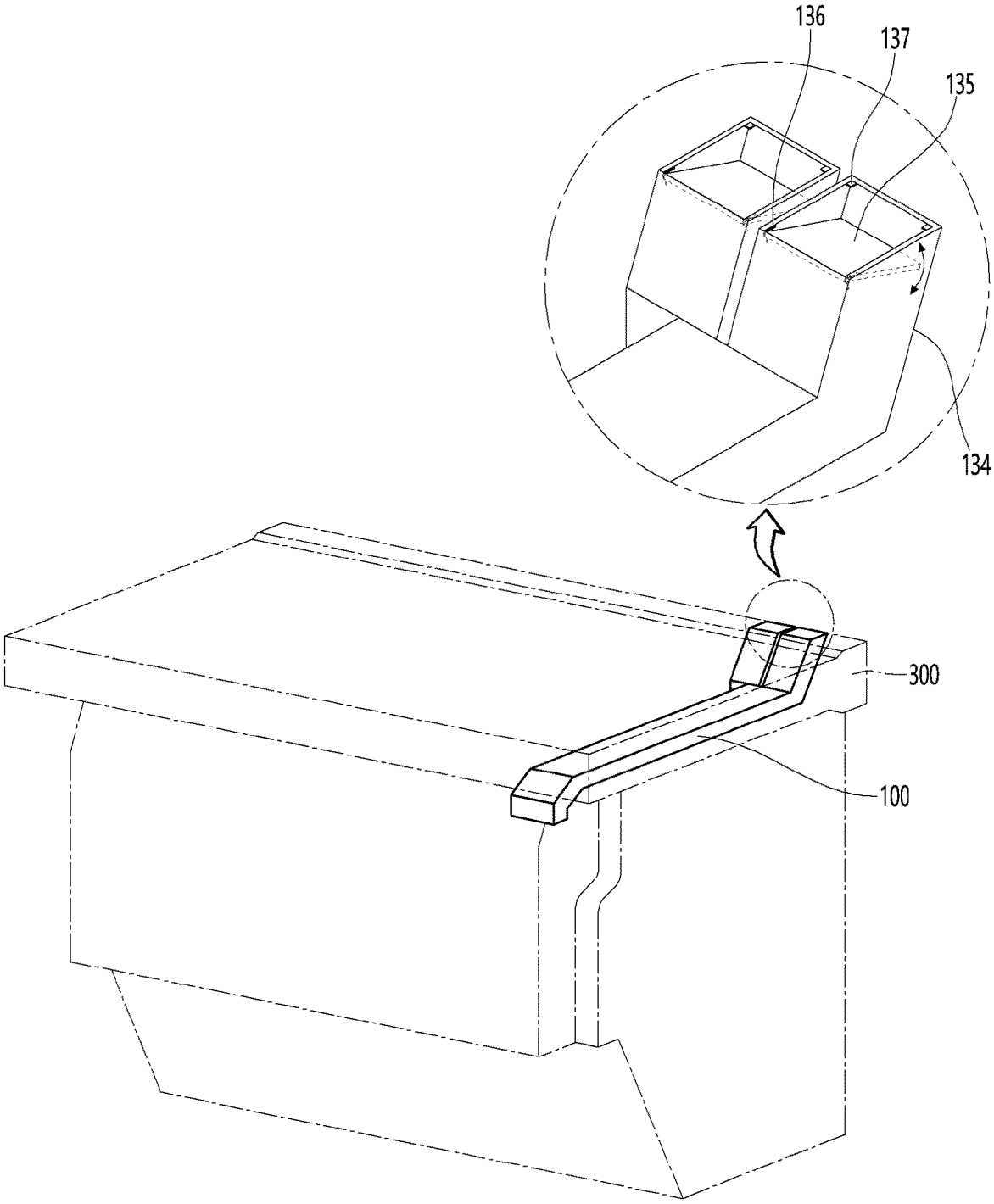

[Fig. 19]
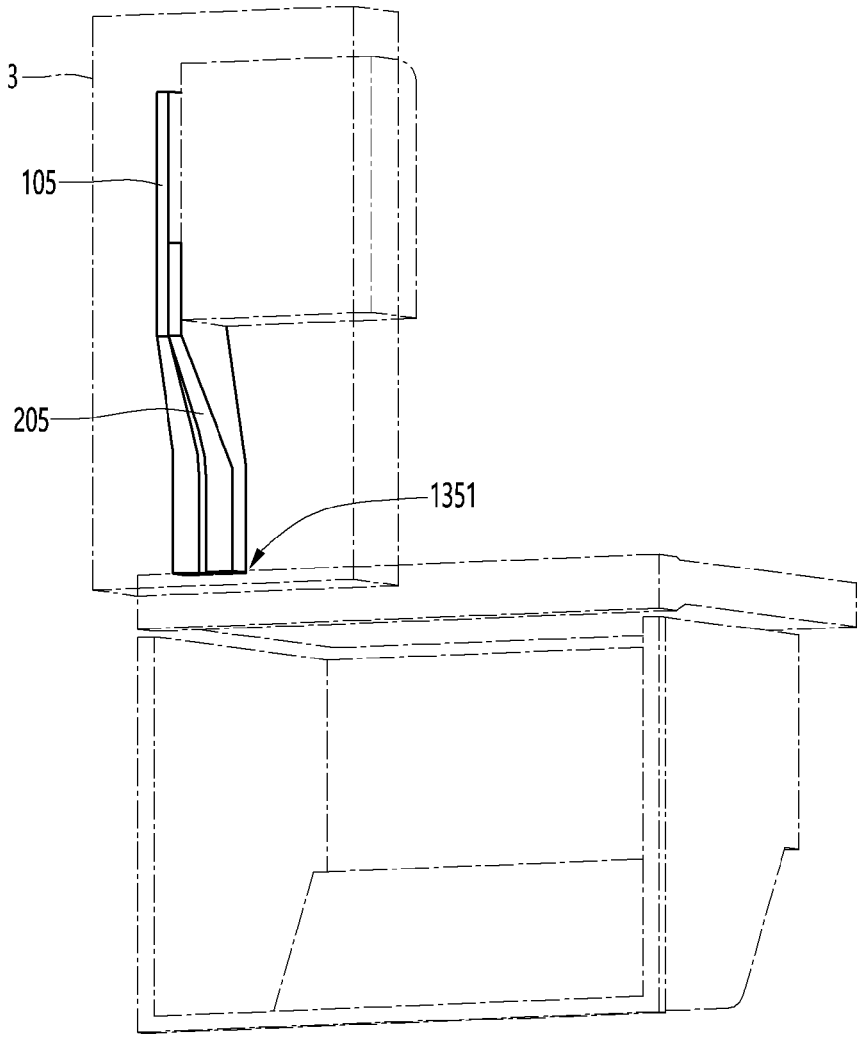

[Fig. 20]
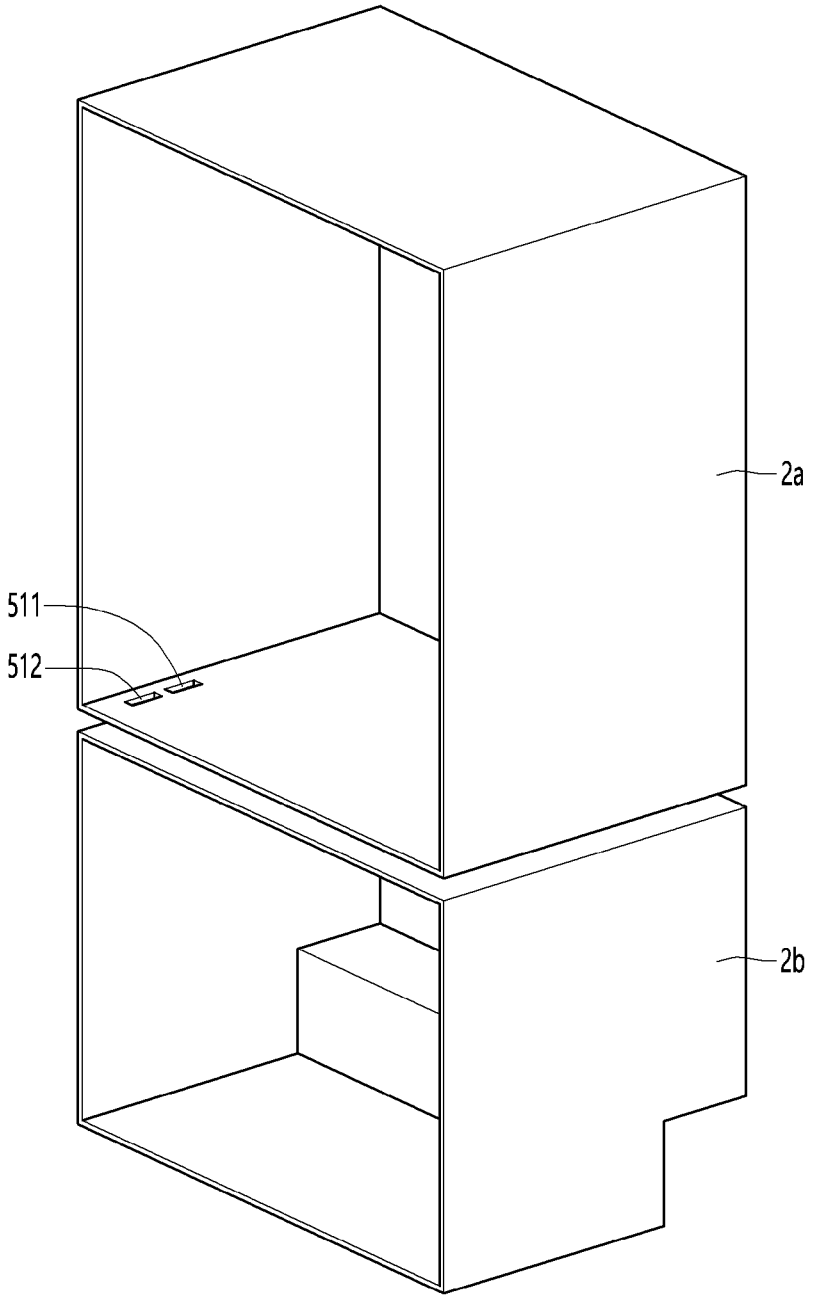

[Fig. 21]
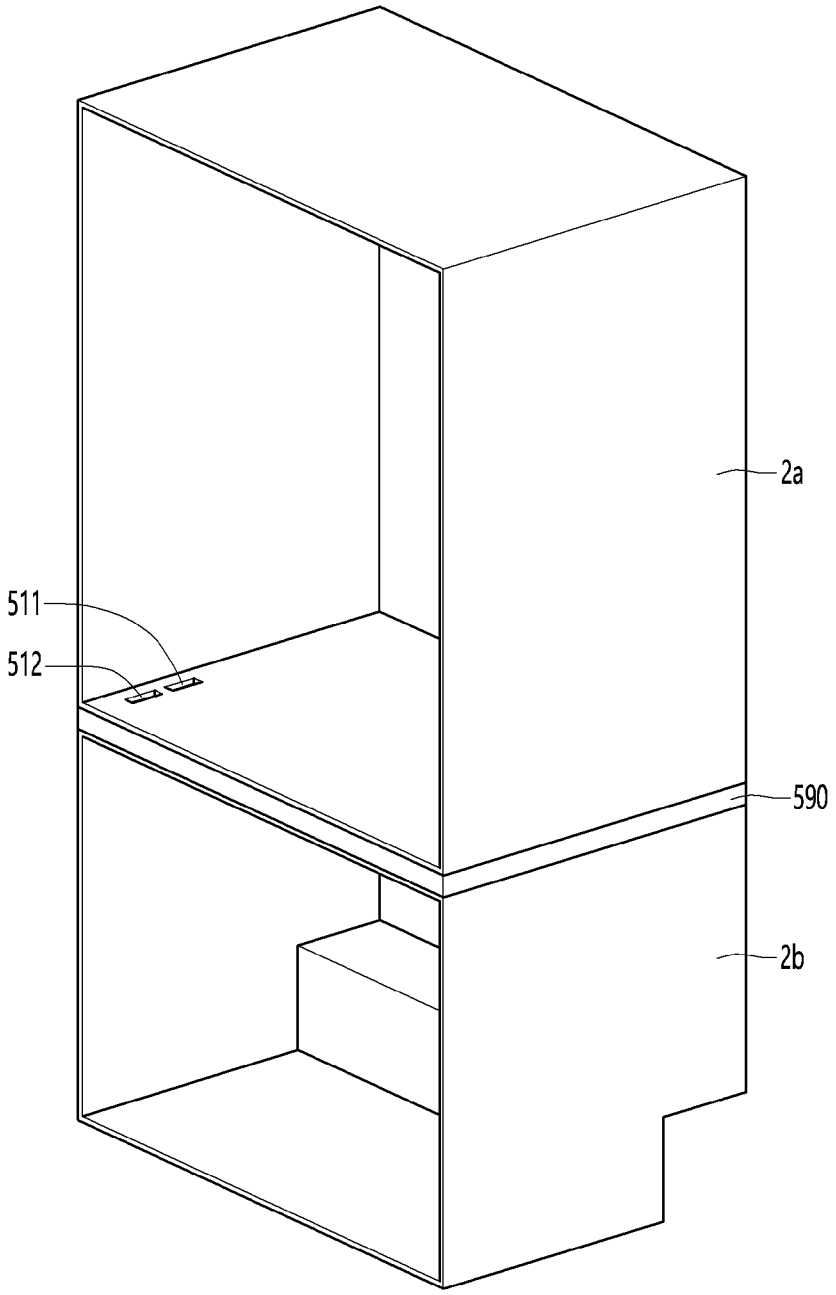

[Fig. 22]
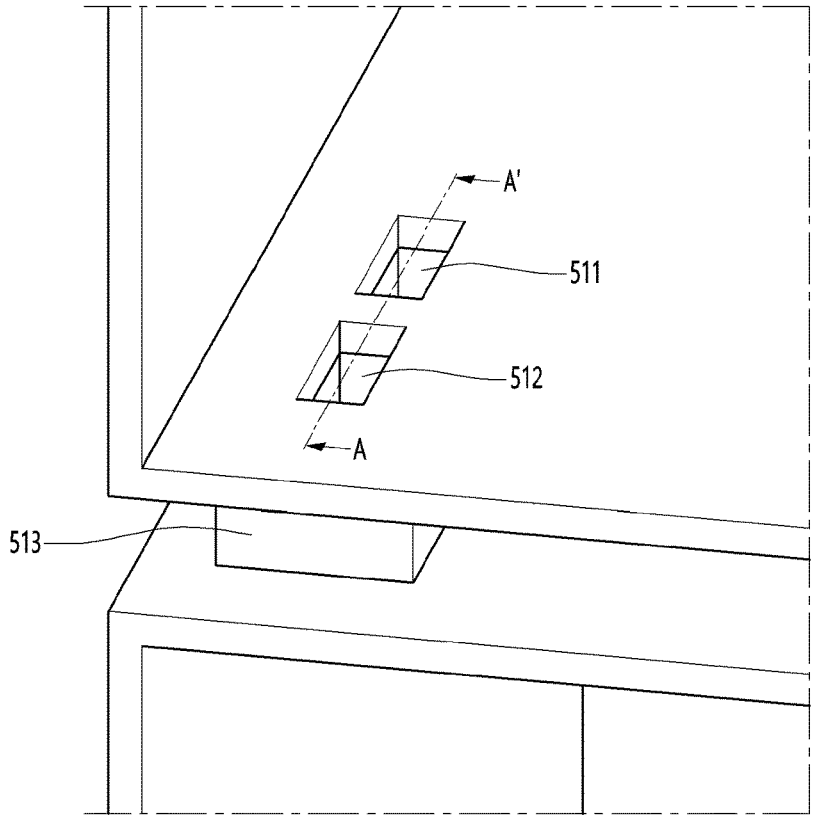
[Fig. 23]
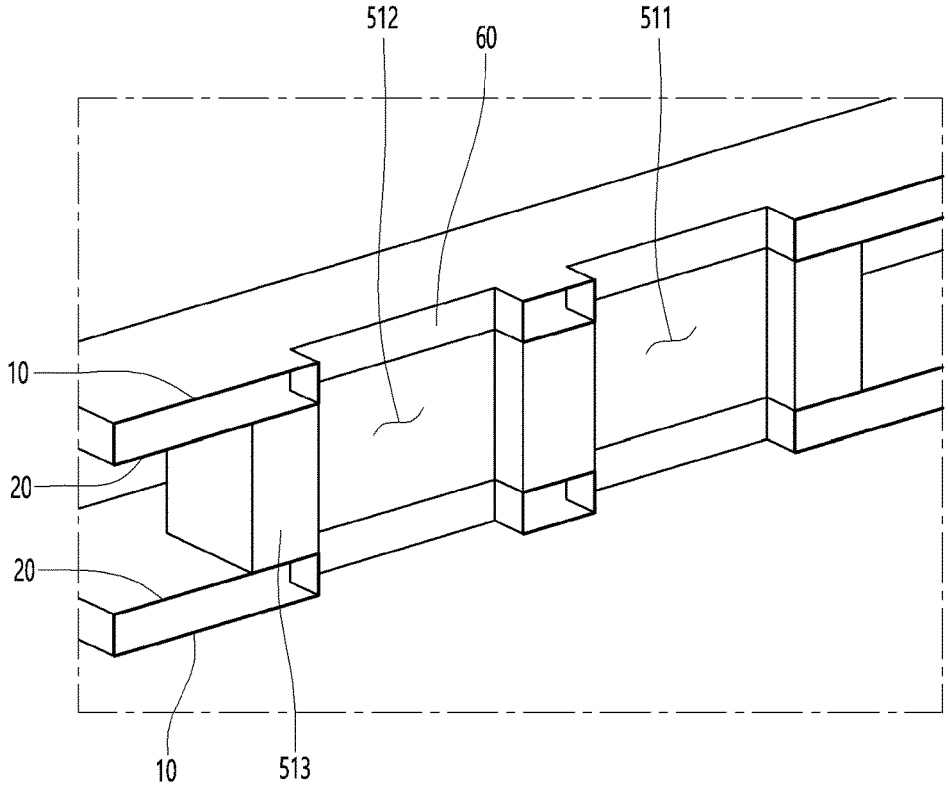

[Fig. 24]
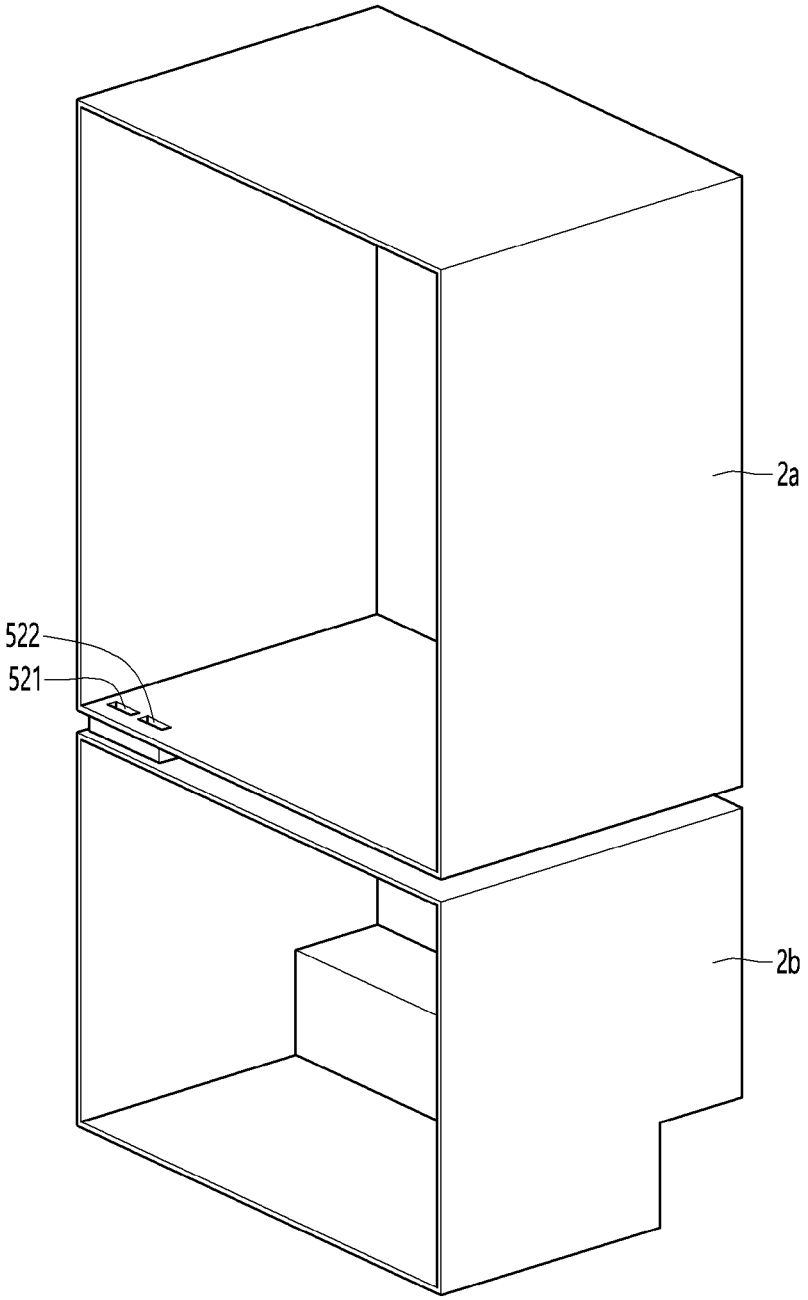

[Fig. 25]
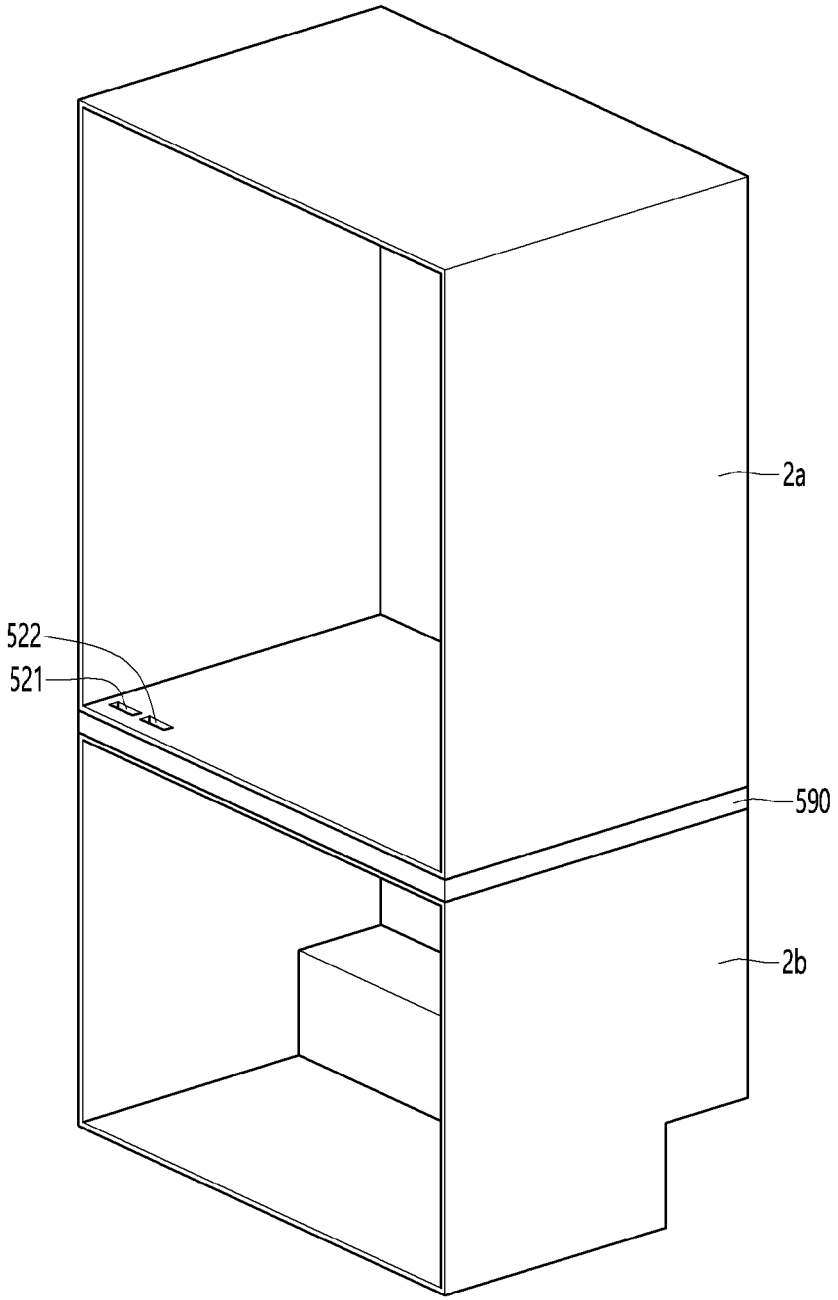

[Fig. 26]
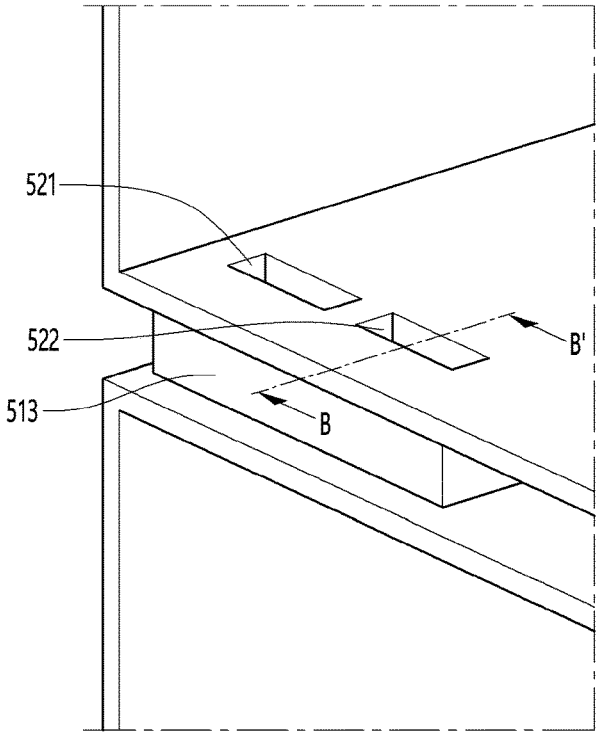
[Fig. 27]
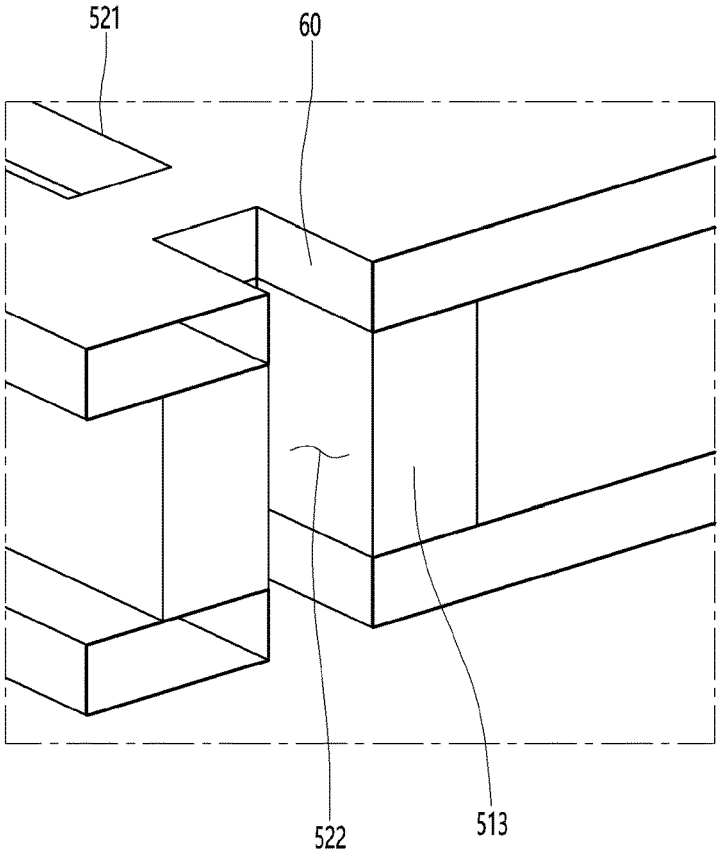

[Fig. 28]
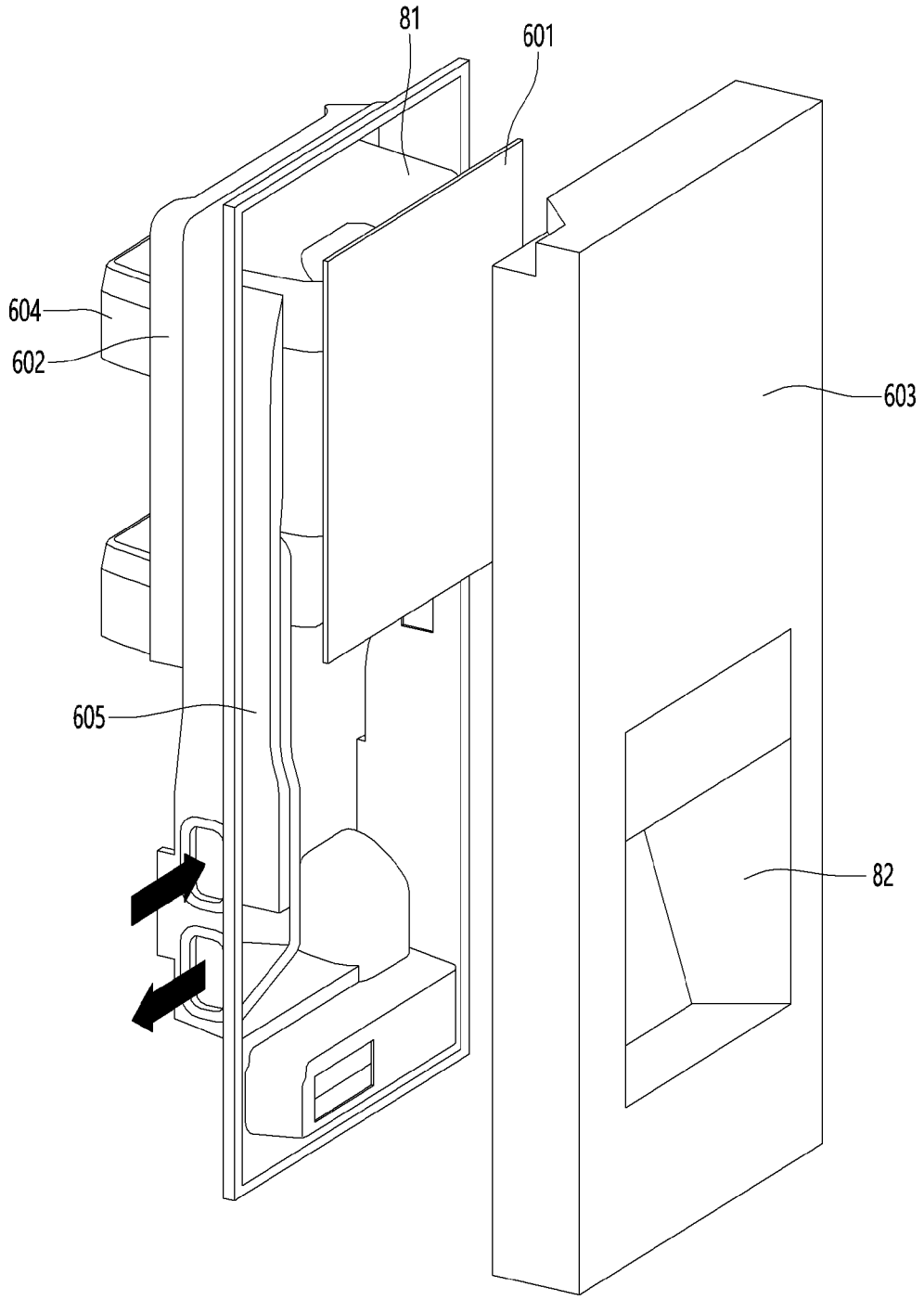

[Fig. 29]
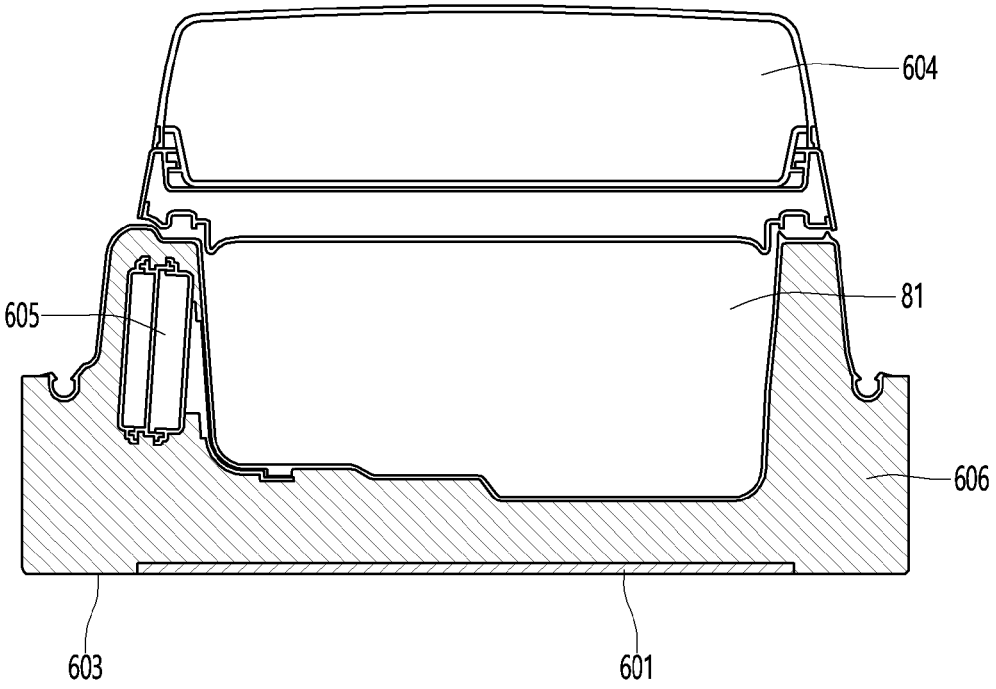

[Fig. 30]
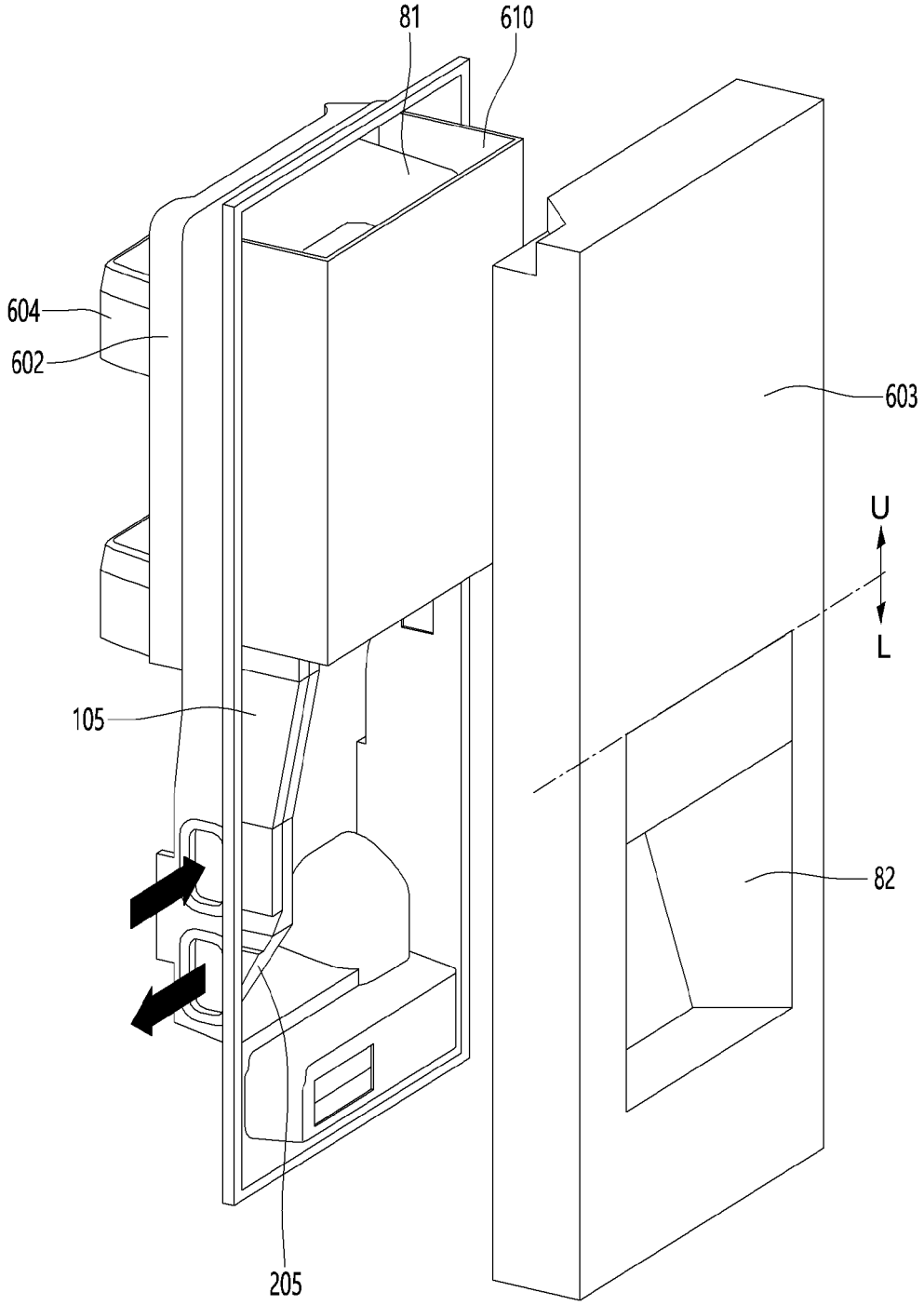

[Fig. 31]
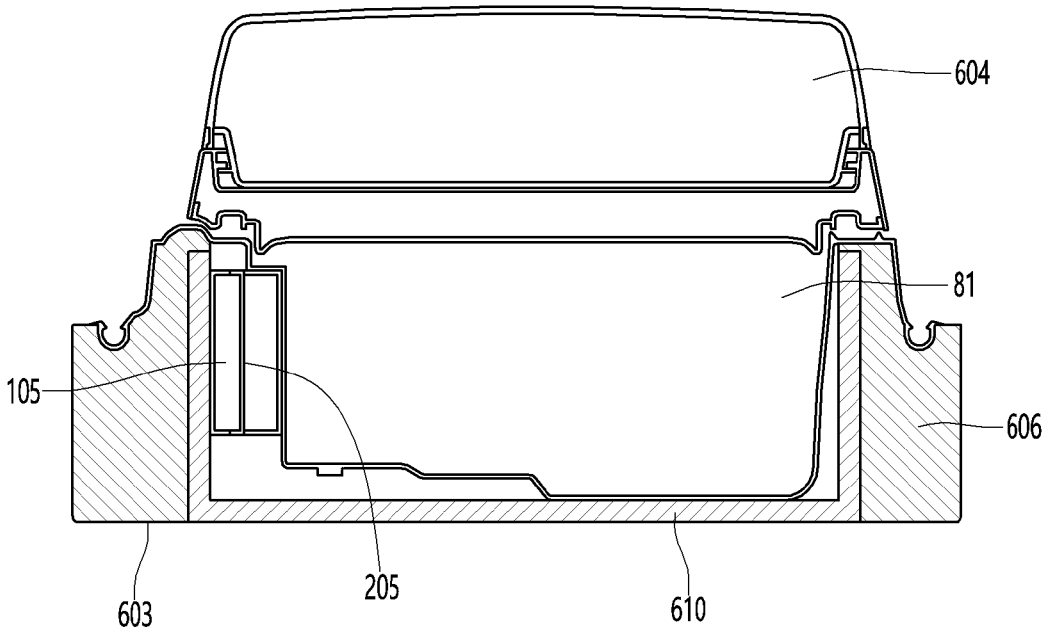
[Fig. 32]
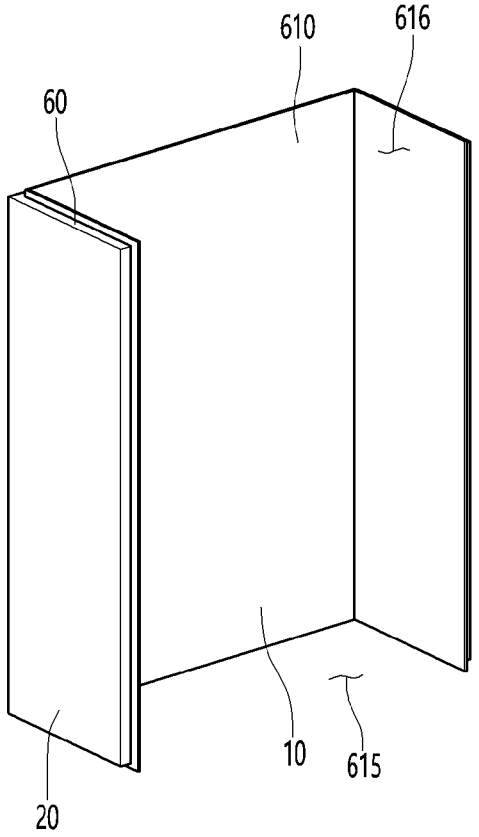

[Fig. 33]
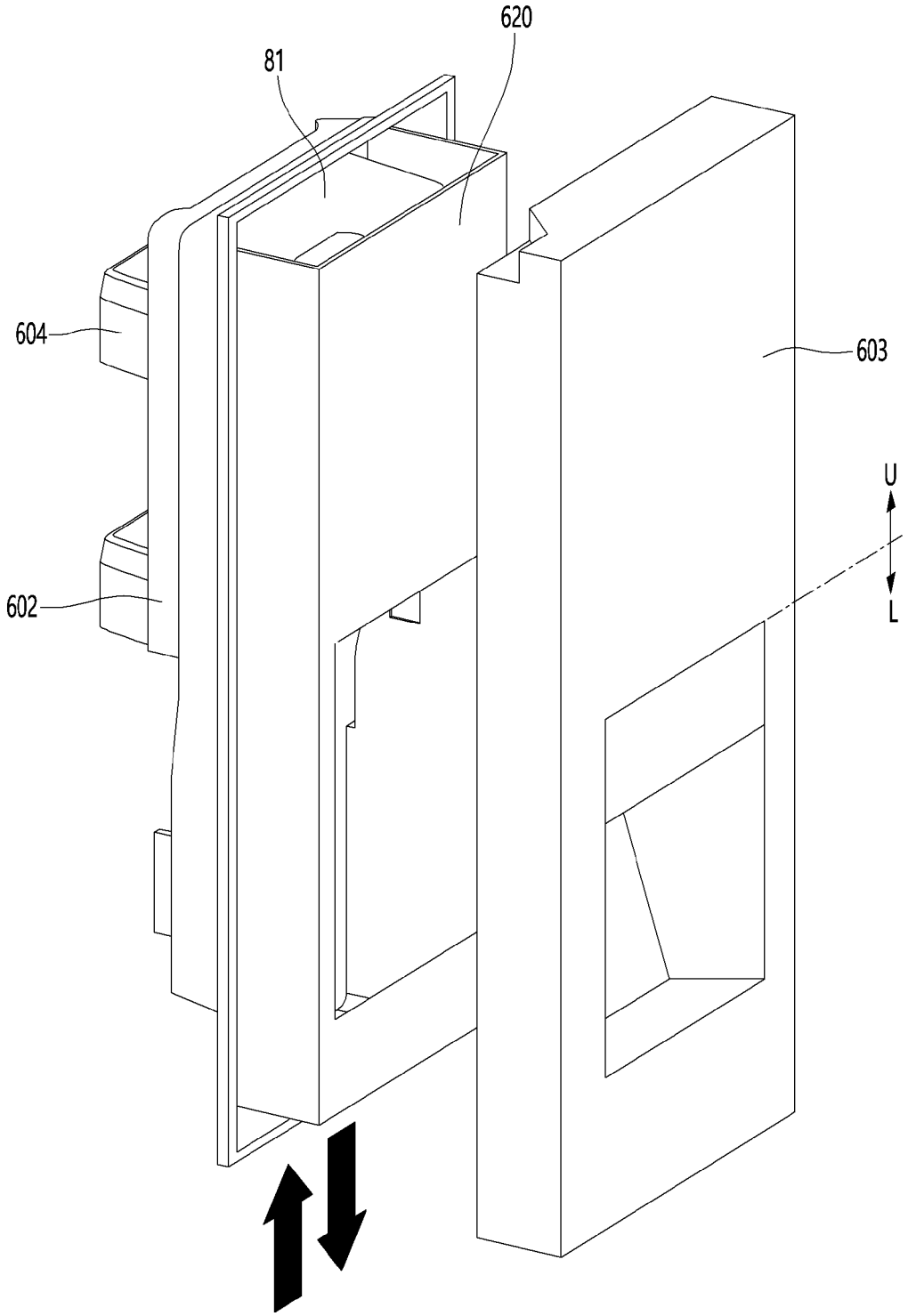

[Fig. 34]
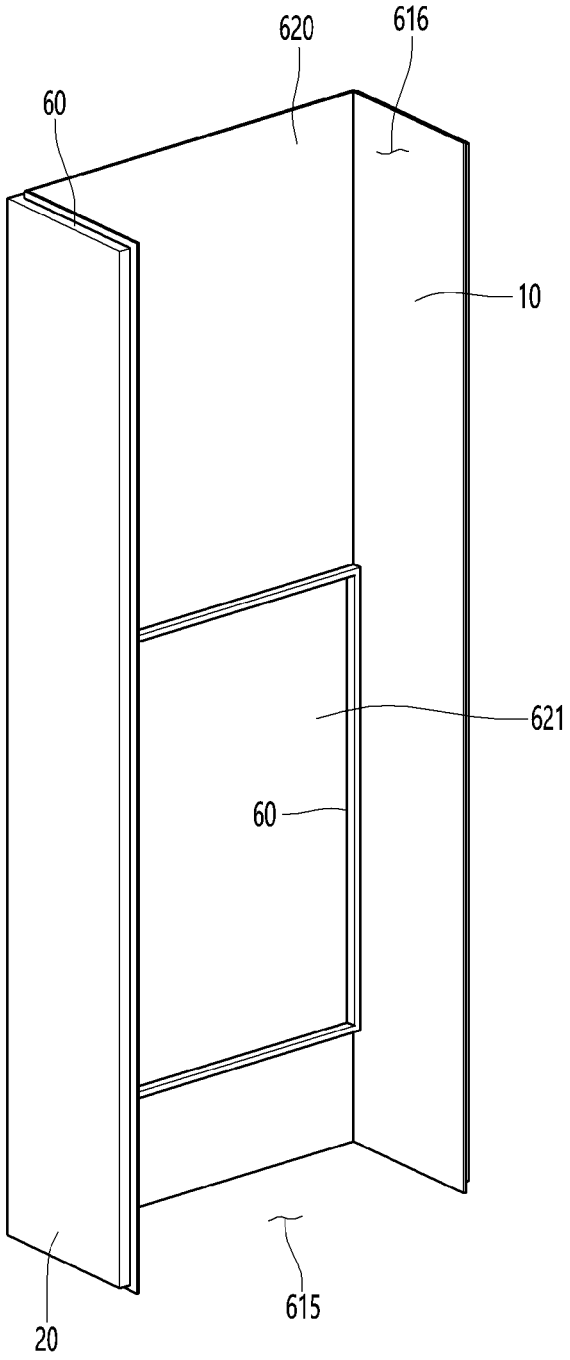

[Fig. 35]
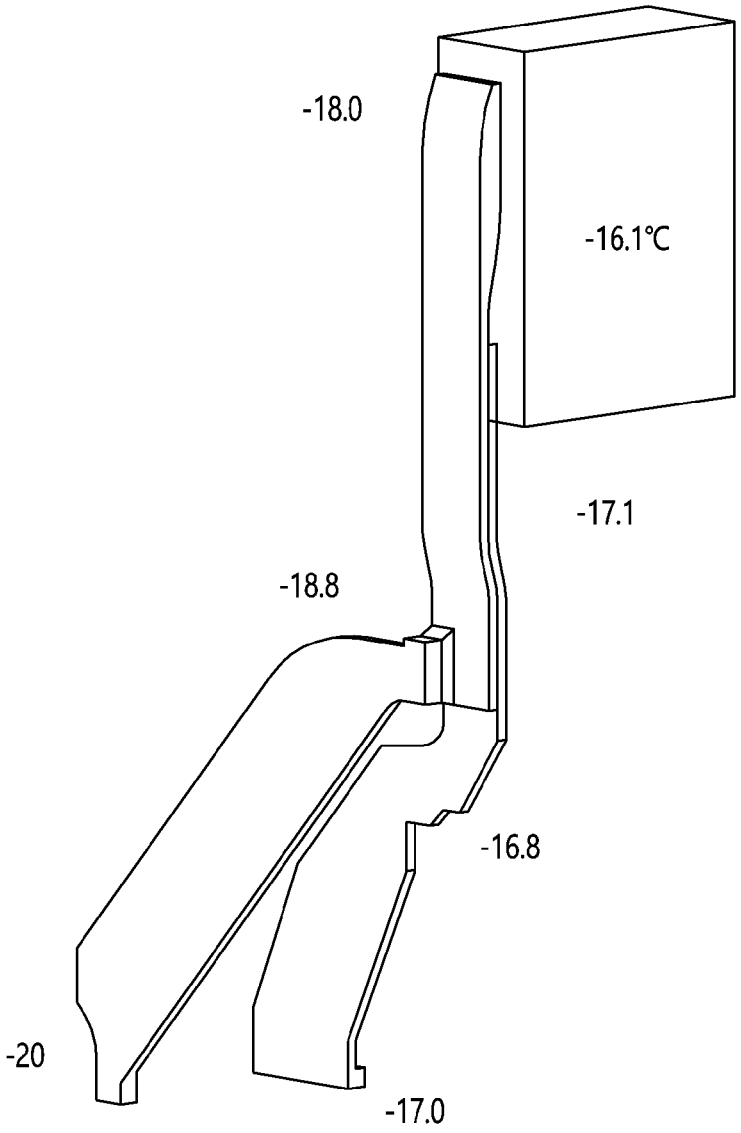

[Fig. 36]
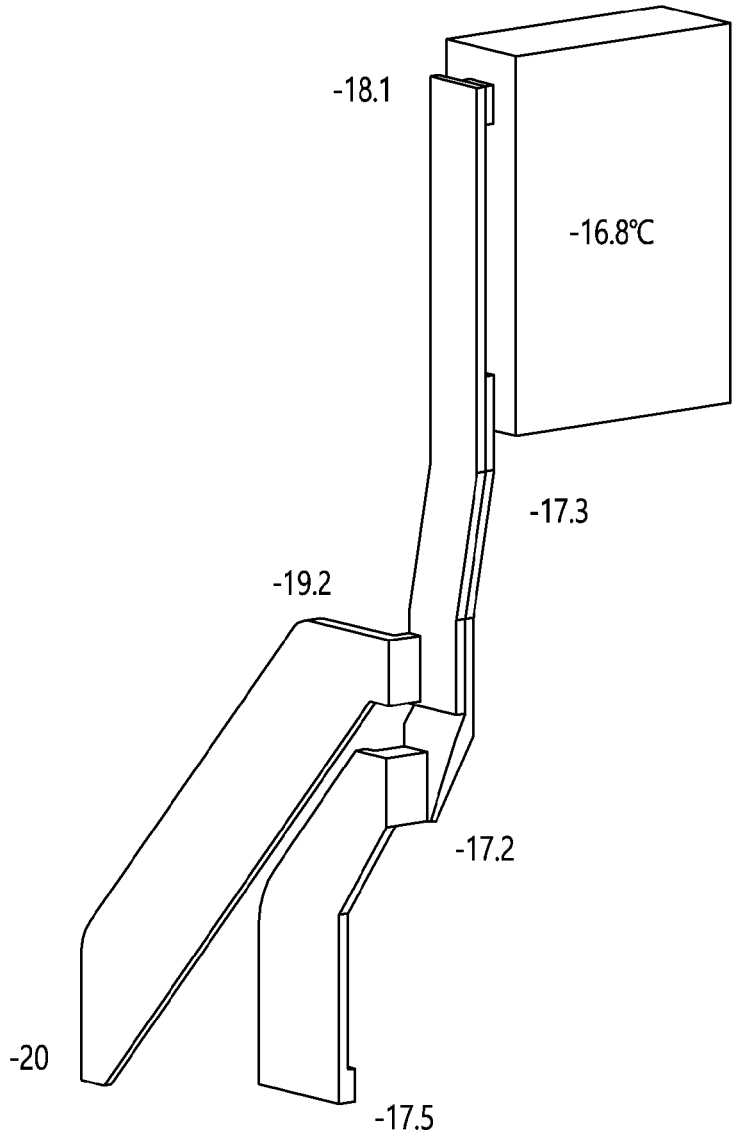

[Fig. 37]
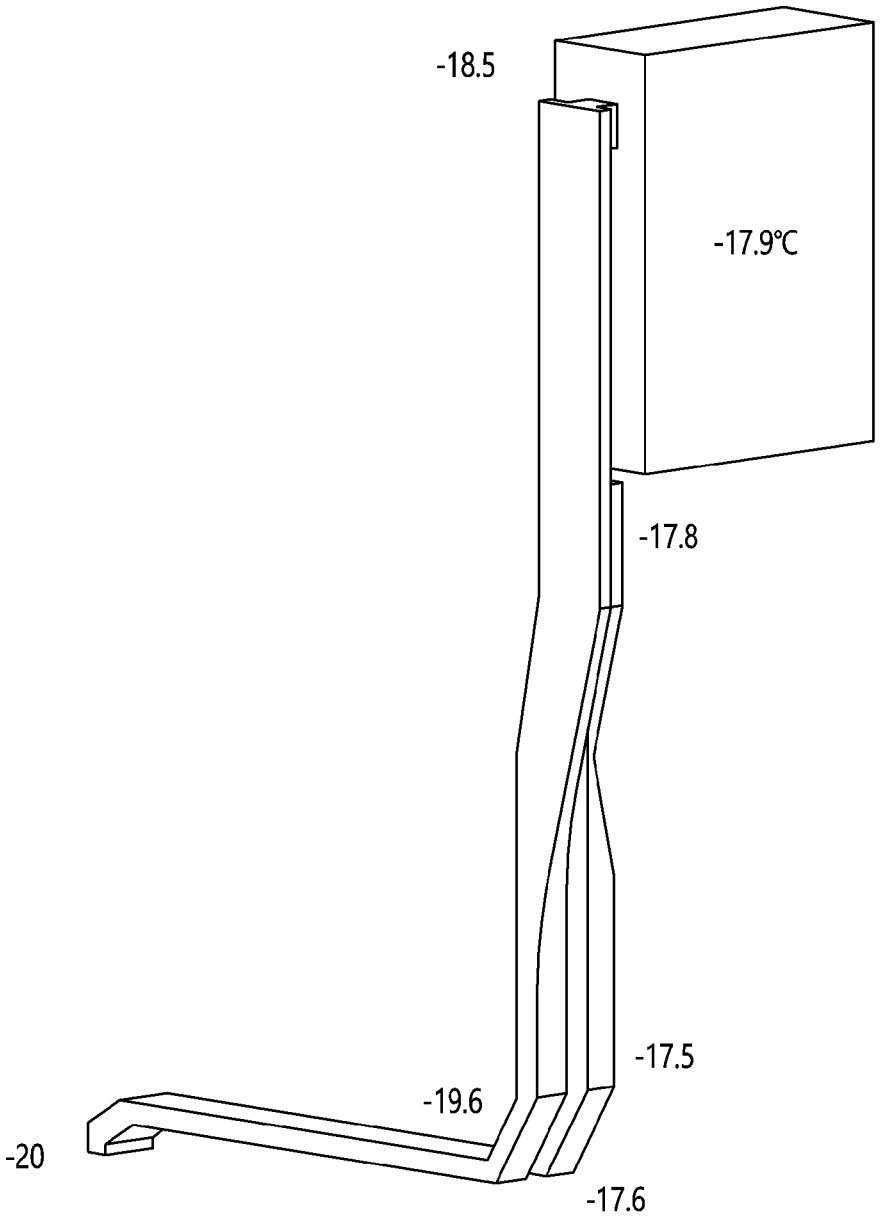

[Fig. 38]
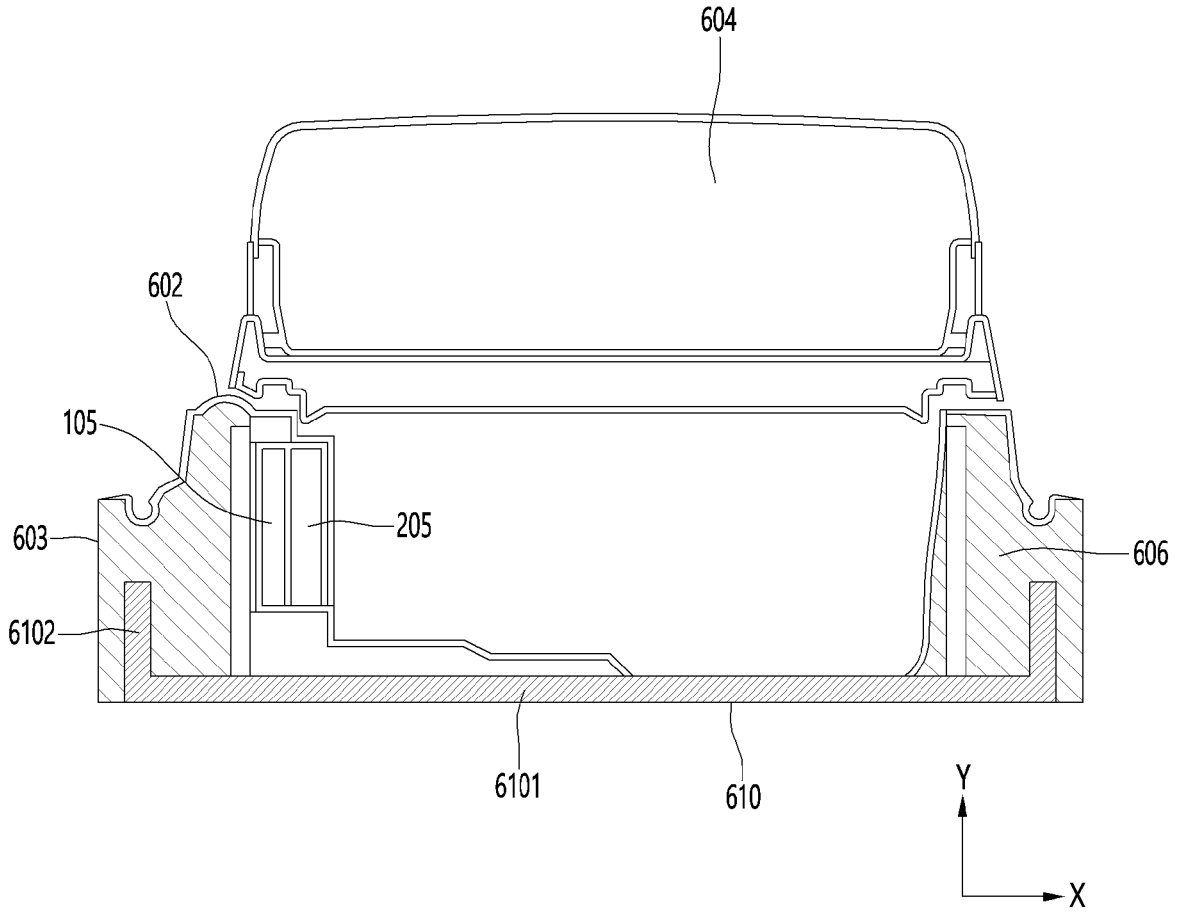

[Fig. 39]
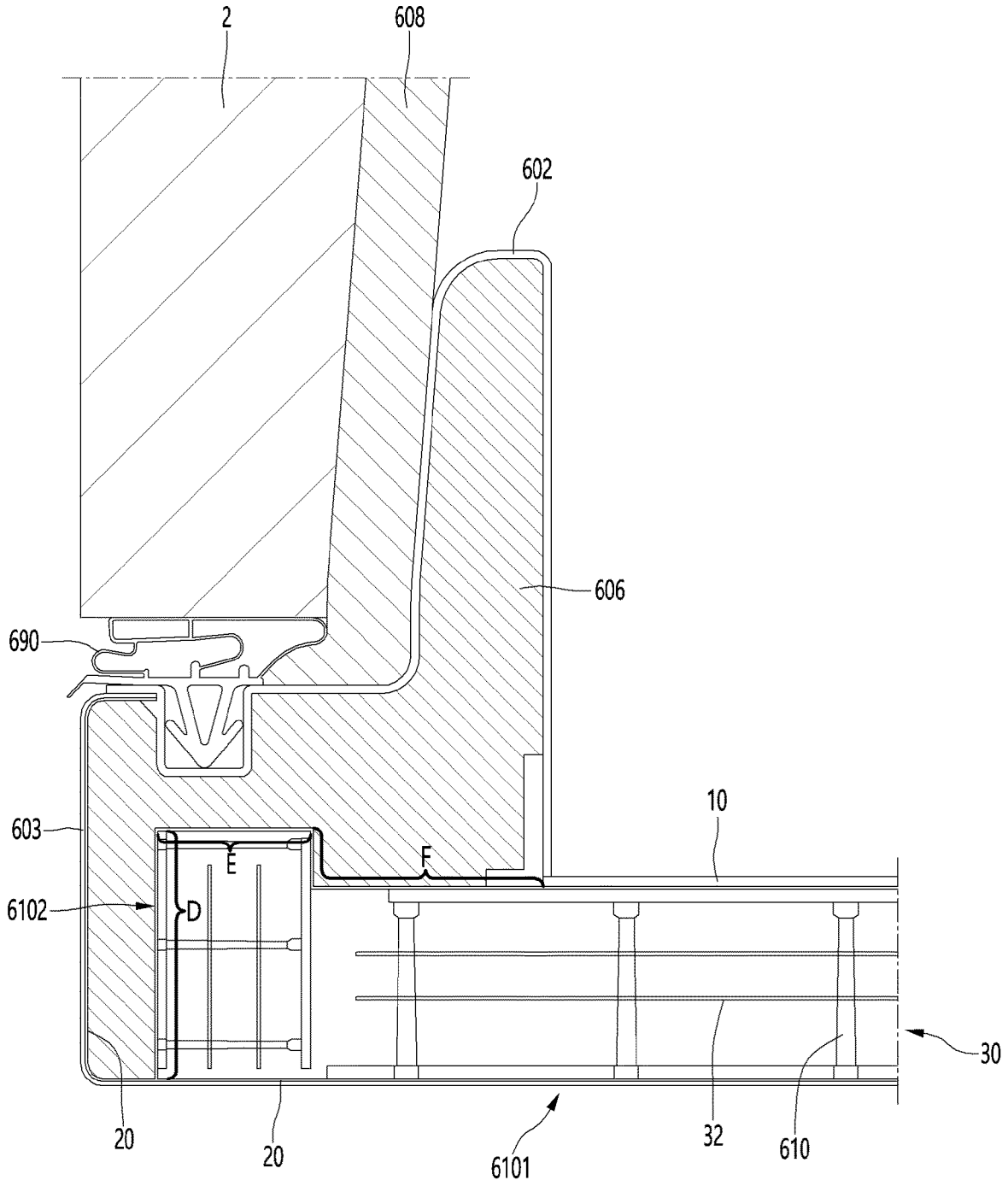

[Fig. 40]
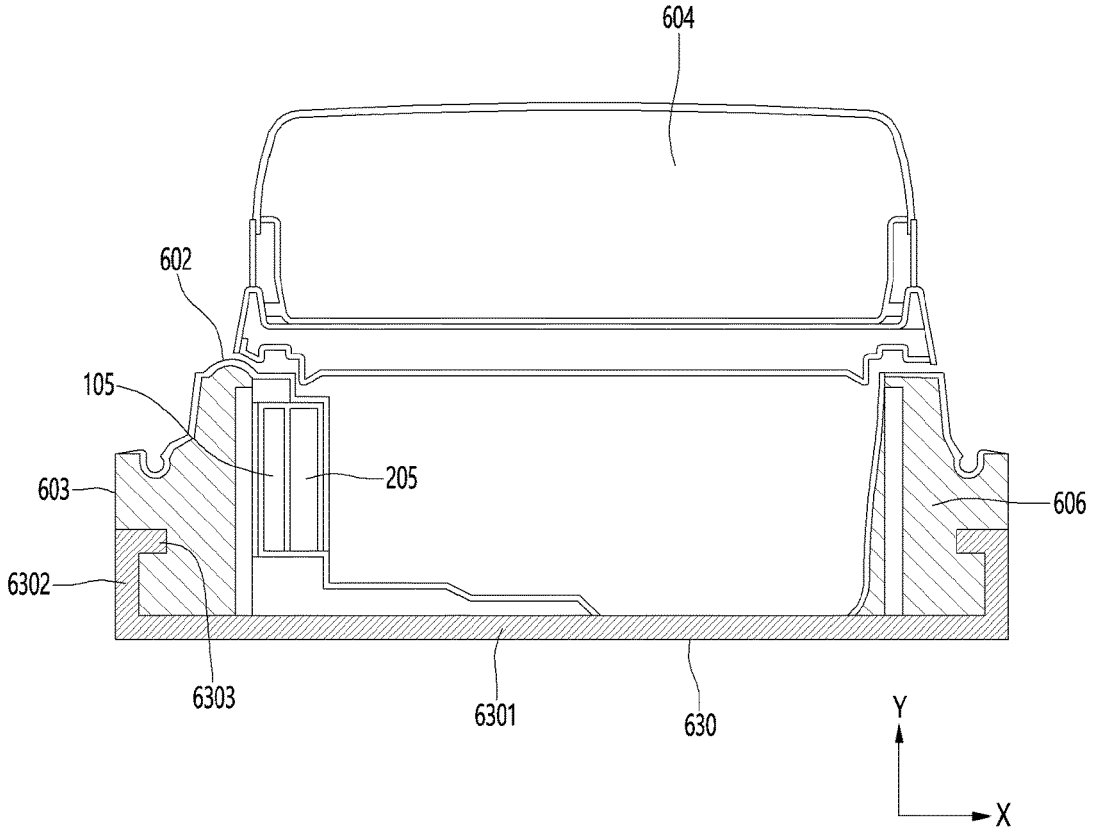
[Fig. 41]
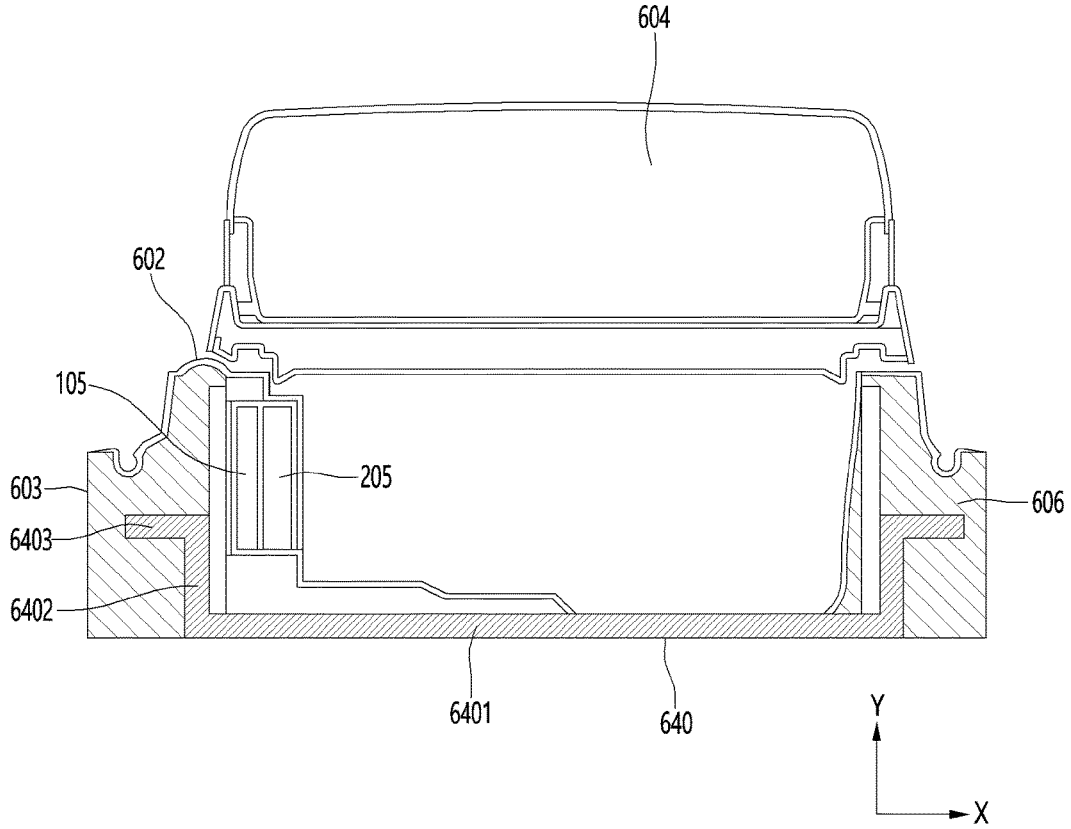

[Fig. 42]
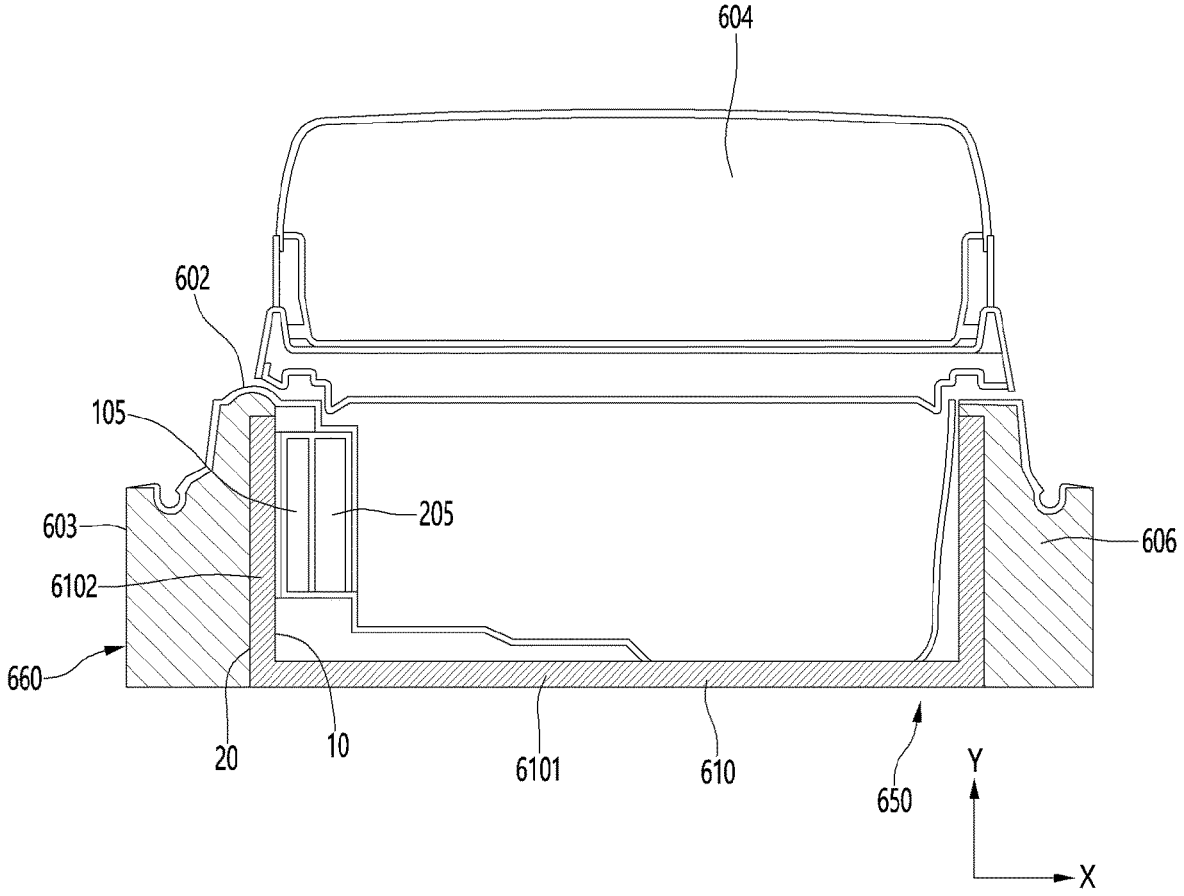

VACUUM ADIABATIC BODY AND REFRIGERATOR

CROSS-REFERENCE TO RELATED PATENT APPLICATIONS

This application is a U.S. National Stage Application under 35 U.S.C. § 371 of PCT Application No. PCT/KR2020/008974, filed Jul. 9, 2020, which claims priority to Korean Patent Application No. 10-2019-0082727, filed Jul. 9, 2019, whose entire disclosures are hereby incorporated by reference.

TECHNICAL FIELD

The present disclosure relates to a vacuum adiabatic body and a refrigerator.

BACKGROUND ART

A vacuum adiabatic body is a product for suppressing heat transfer by vacuuming the inside of a main body thereof. The vacuum adiabatic body may reduce heat transfer by convection and conduction, and hence is applied to heating apparatuses and refrigerating apparatuses. In a typical adiabatic method applied to a refrigerator, although it is differently applied in refrigeration and freezing, a foam urethane adiabatic wall having a thickness of about 30 cm or more is generally provided. However, the internal volume of the refrigerator is therefore reduced.

In order to increase the internal volume of a refrigerator, there is an attempt to apply a vacuum adiabatic body to the refrigerator.

First, Korean Patent No. 10-0343719 (Reference Document 1) of the present applicant has been disclosed. According to Reference Document 1, there is disclosed a method in which a vacuum adiabatic panel is prepared and then built in walls of a refrigerator, and the outside of the vacuum adiabatic panel is finished with a separate molding as Styrofoam. According to the method, additional foaming is not required, and the adiabatic performance of the refrigerator is improved. However, fabrication cost increases, and a fabrication method is complicated.

As another example, a technique of providing walls using a vacuum adiabatic material and additionally providing adiabatic walls using a foam filling material has been disclosed in Korean Patent Publication No. 10-2015-0012712 (Reference Document 2). Also, fabrication cost increases, and a fabrication method is complicated.

As further another example, there is an attempt to fabricate all walls of a refrigerator using a vacuum adiabatic body that is a single product. For example, a technique of providing an adiabatic structure of a refrigerator to be in a vacuum state has been disclosed in U.S. Patent Laid-Open Publication No. US2004/0226956A1 (Reference Document 3). However, it is difficult to obtain a practical level of an adiabatic effect by providing a wall of the refrigerator with sufficient vacuum. In detail, there are limitations that it is difficult to prevent a heat transfer phenomenon at a contact portion between an outer case and an inner case having different temperatures, it is difficult to maintain a stable vacuum state, and it is difficult to prevent deformation of a case due to a negative pressure of the vacuum state. Due to these limitations, the technology disclosed in Reference Document 3 is limited to a cryogenic refrigerator, and does not provide a level of technology applicable to general households.

Alternatively, the present applicant has applied for Korean Patent Publication No. 10-2017-0016187 (Reference Document 4) that discloses a vacuum adiabatic body and a refrigerator. This reference document proposes a single cooling space that is constructed using a single vacuum adiabatic body. However, a real refrigerator needs to be provided with a plurality of storage spaces having different temperatures, but there is a limitation that the conventional documents do not consider it.

In recent years, an ice maker is installed in the refrigerator so that consumers conveniently obtain ice. As a conventional technique related to the ice maker and the supply of the cool air to the ice maker, a cool air passage structure of a refrigerator, which is disclosed in KR Patent 10-2006-0041437 (Reference Document 5) and a refrigerator in which an ice maker is installed in a main body of the refrigerator, which is disclosed in KR Patent 10-2006-0076461 (Reference Document 6) have been proposed as a form in which the ice maker is installed in a refrigerating compartment door of the refrigerator.

In the related art, a duct is embedded in a foam portion providing a wall of the refrigerator, and cool air is supplied to the ice maker installed in the refrigerating compartment or the ice maker installed in the freezing compartment via the embedded duct.

According to the above technology, there is a limitation in that an inner space of the duct is reduced on the whole because it is difficult to thermally insulate the ducts to increase in a loss of cool air to the outside, and a thickness of the foam portion needs to increase so as to thermally insulate the duct. In addition, in the case of a vacuum adiabatic body, since an inner space of a vacuum space, which is an adiabatic space, is narrow and thin, it is impossible to embed the ducts in the first place.

In the case of the ice maker installed in the door disclosed in Reference Document 5, it is difficult to thermally insulate the ice maker, and in particular, it is difficult to thermally insulate the outside facing the outer space of the refrigerator rather than the inside facing the inner space of the refrigerator. A thick portion may be inserted to thermally insulate a gap between the ice maker and the outer space, but in this case, there is a limitation that a loss of the inner space increases.

DISCLOSURE OF INVENTION

Technical Problem

Embodiments provide a refrigerator in which a cool air loss of an ice maker is reduced in a door in which the ice maker is installed.

Embodiments also provide an adiabatic body, in which a waste of a space is reduced due to a thick wall required for a door to provide an ice-making space, and a refrigerator.

Embodiments also provide an adiabatic body, in which a complicated fabrication process of a door structure applied to a refrigerator is simplified, and a refrigerator.

Solution to Problem

In one embodiment, a vacuum adiabatic body includes: first and second plates configured to provide a vacuum space therein; and an outer case configured to contact the second plate and made of a metal material, the outer case being thicker than at least a portion of at least one of the first plate or the second plate, wherein at least two extension modules extending directions different from each other are provided in the vacuum space. Accordingly, adiabatic efficiency may be improved in a narrow space using the vacuum space.

The at least two extension modules may share the vacuum space to simply and conveniently fabricate the vacuum adiabatic body.

The outer case may have a thickness thicker than each of the first plate and the second plate to secure structural strength by the outer case and also improve thermal conductive resistance by the plate.

The vacuum adiabatic body may further include an inner cover coupled to the outer case, the inner case being made of a non-metal material, which is provided at a side of the first plate so that a component is mounted on the vacuum adiabatic body itself to improve fabrication and use of a product.

A foam adiabatic material may be filled in a space between the inner cover and the outer case to improve adiabatic performance.

The at least two extension modules may be bent to extend to provide a polygonal accommodation space in the vacuum adiabatic body, thereby realizing an effect of thermal insulation with respect to the outside of the accommodation space. Here, in the accommodation space, two boundary surfaces having different extending directions may be thermally insulated by the vacuum adiabatic body.

The support may be provided separately for each of the extension modules to sufficiently secure the structural strength of the vacuum space.

In another embodiment, a refrigerator includes a three-dimensional vacuum adiabatic module disposed in a gap between an outer case and an inner cover, the three-dimensional vacuum adiabatic module including a first plate and a second plate, which are provided to define a vacuum space therein, wherein the three-dimensional vacuum adiabatic module includes at least two extension modules extending in directions different from each other. Accordingly, a three-dimensional inner space that is capable of realizing a vacuum adiabatic effect may be provided to improve the adiabatic effect.

At least one of the first plate or the second plate may have a thickness less than that of the outer case to expect an effect of heat conduction reduction by the plate.

A heat conduction amount may significantly increase in an area on which the first and second plates are connected to each other. The area may be aligned adjacent to a gasket to prevent heat from being transferred to the outside through the gasket.

The refrigerator may further include a cool air passage disposed in an inner space of the three-dimensional vacuum adiabatic module. In this case, the adiabatic effect with respect to the cool air used for the ice maker provided in the door may increase to improve performance of the ice maker, thereby providing a large amount of ice.

The three-dimensional vacuum adiabatic module may include: a first extension module of which at least a portion extends along a front surface of the door; and a second extension module of which at least a portion extends along a side surface of the door to more accurately provide the adiabatic space in an inner space than an outer space. That is to say, since the lateral heat conduction is blocked, greater adiabatic performance may be realized in the inner space of the three-dimensional vacuum adiabatic module.

A foam adiabatic material may be filled in at least one side surface of the second extension module to improve the adiabatic effect with respect to the door.

The foam adiabatic material may be filled in both side surfaces of the second extension module to improve structural strength of a mechanical structure, thereby realizing the greater adiabatic effect.

The first extension module and the second extension module may be bent as a single body to extend to more accurately and conveniently provide the adiabatic space therein.

The first extension module and the second extension module may share the vacuum space to simplify the fabrication space.

The refrigerator may further include a third extension module bent from an end of the second extension module to provide the adiabatic space in more various shapes using the three-dimensional vacuum adiabatic module.

The second plate may contacts the outer case, and the foam adiabatic material may be filled outside the second plate to secure sufficient strength and adiabatic performance.

The inner cover may extend to the accommodation space to define a portion of a wall of the accommodation space, thereby sharing the components when the refrigerator is fabricated and more simplifying the components.

In further another embodiment, a refrigerator includes: a main body having an accommodation space and an opening configured to allow access to the accommodation space; and a door configured to open and close the accommodation space, wherein the door includes a vacuum adiabatic module disposed in a gap between an outer case and an inner cover and including a first adiabatic module and a second adiabatic module to define a vacuum space therein. A separate outer case that is separated from the plate may be provided in the vacuum adiabatic body to obtain an adiabatic effect by the plate and realize sufficient structural strength through the outer case.

The vacuum adiabatic module includes at least two extension modules having extension directions different from each other to more accurately provide a space that is thermally insulated by using the vacuum adiabatic module.

Advantageous Effects of Invention

According to the embodiment, the sufficient adiabatic operation with respect to the ice maker installed in the door may be performed to improve the performance of the ice maker and enhance customer's satisfaction.

Since the space required for the thermal insulation of the refrigerator door is more reduced, the space in which the article is placed in the door may be expanded.

According to the embodiment, the structural strength of the outer case and heat conduction reduction due to the plate may be achieved together to more simplify fabricate the door structure of the refrigerator.

BRIEF DESCRIPTION OF DRAWINGS

FIG. 1 is a perspective view of a refrigerator according to an embodiment.

FIG. 2 is a view schematically illustrating a vacuum adiabatic body used in a main body and a door of the refrigerator.

FIG. 3 is a view illustrating an internal configuration of a vacuum space according to various embodiments.

FIG. 4 is a view illustrating a conductive resistance sheet and a peripheral portion thereof according to various embodiments.

FIG. 5 is a graph illustrating a variation in adiabatic performance and a variation in gas conductivity according to a vacuum pressure by applying a simulation.

FIG. 6 is a graph illustrating results obtained by observing a time and a pressure in a process of exhausting the inside of the vacuum adiabatic body when a support is used.

FIG. 7 is a graph illustrating results obtained by comparing a vacuum pressure to gas conductivity.

FIG. 8 is a schematic perspective view of an ice-making cool air passage in the refrigerator according to an embodiment.

FIG. 9 is a schematic cross-sectional view of a freezing compartment-side ice-making cool air passage in the refrigerator according to an embodiment.

FIG. 10 is a schematic cross-sectional view of a refrigerating compartment-side ice-making cool air passage in the refrigerator according to an embodiment.

FIG. 11 is a front perspective view illustrating a connection end between first and second ice-making cool air passage in the refrigerator.

FIG. 12 is a rear perspective view illustrating a connection end between first and second door-side ice-making cool air passage in the refrigerator.

FIG. 13 is a view for explaining a relationship between the ice-making cool air passage and a mullion.

FIG. 14 is a view for explaining a structure on which the mullion is seated.

FIG. 15 is a side perspective view for explaining an installation of the ice-making cool air passage and an adiabatic structure in the refrigerator.

FIG. 16 is a schematic perspective view of an ice-making cool air passage in a refrigerator according to another embodiment.

FIG. 17 is a view illustrating a relationship between a mullion and a door according to another embodiment.

FIGS. 18 and 19 are views for explaining a switching structure of the ice-making cool air passage, wherein FIG. 18 is a view illustrating a mullion side, and FIG. 19 is a view illustrating a door side.

FIG. 20 is a perspective view of a refrigerator in which each vacuum adiabatic body provides each storage space.

FIG. 21 is a perspective view of the refrigerator in a state in which a gap maintenance portion is provided at a connection portion between the vacuum adiabatic bodies.

FIG. 22 is an enlarged view of an ice-making connection passage.

FIG. 23 is a cross-sectional view of the ice-making connection passage, taken along line A-A'.

FIGS. 24 to 27 are views of a refrigerator in which a freezing compartment and a freezing compartment are respectively provided by two vacuum adiabatic bodies as illustrated in FIGS. 20 to 23, wherein the ice-making cool air passage is provided in a bottom surface of the door according to an embodiment.

FIG. 28 is an exploded perspective view illustrating a door of the ice-making cool air passage embedded in a foaming material.

FIG. 29 is a horizontal cross-sectional view of a space in which an ice maker is installed in FIG. 28.

FIG. 30 is an exploded perspective view of a door according to an embodiment.

FIG. 31 is a horizontal cross-sectional view of the space in which the ice maker is installed according to an embodiment.

FIG. 32 is a perspective view of a first vacuum adiabatic module according to an embodiment.

FIG. 33 is an exploded perspective view of a door according to another embodiment.

FIG. 34 is a perspective view of a first vacuum adiabatic module according to another embodiment.

FIGS. 35 to 37 are views illustrating heat efficiency of the ice-making cool air passage embedded in the forming material and the ice-making cool air passage according to an embodiment, wherein FIG. 35 illustrates a case in which the ice-making cooling passage embedded in the forming material and an adiabatic panel are installed, FIG. 36 illustrates a case in which the side panel ice-making cool air passage and a first vacuum adiabatic module are installed, and FIG. 37 illustrates a case in which the mullion ice-making cool air passage and a second vacuum adiabatic module are installed.

FIG. 38 is a cross-sectional view of a door in which an ice maker and a door-side basket are installed.

FIG. 39 is an enlarged view of a corner of FIG. 38.

FIG. 40 is a cross-sectional view of a door to which a three-dimensional multi-bent vacuum adiabatic module is applied according to another embodiment.

FIG. 41 is a cross-sectional view of a door to which a three-dimensional multi-bent vacuum adiabatic module is applied according to further another embodiment.

FIG. 42 is a cross-sectional view of a door using a three-dimensional vacuum adiabatic module according to further another embodiment.

MODE FOR THE INVENTION

Hereinafter, exemplary embodiments will be described with reference to the accompanying drawings. The invention may, however, be embodied in many different forms and should not be construed as being limited to the embodiments set forth herein, and a person of ordinary skill in the art, who understands the spirit of the present invention, may readily implement other embodiments included within the scope of the same concept by adding, changing, deleting, and adding components; rather, it will be understood that they are also included within the scope of the present invention.

Hereinafter, for description of embodiments, the drawings shown below may be displayed differently from the actual product, or exaggerated or simple or detailed parts may be deleted, but this is intended to facilitate understanding of the technical idea of the present invention. It should not be construed as limited. However, it will try to show the actual shape as much as possible.

The following embodiments may be applied to the description of another embodiment unless the other embodiment does not collide with each other, and some configurations of any one of the embodiments may be modified in a state in which only a specific portion is modified in another configuration may be applied.

In the following description, the vacuum pressure means any pressure state lower than the atmospheric pressure. In addition, the expression that a vacuum degree of A is higher than that of B means that a vacuum pressure of A is lower than that of B.

FIG. 1 is a perspective view of a refrigerator according to an embodiment.

Referring to FIG. 1, the refrigerator 1 includes a main body 2 provided with a cavity 9 capable of storing storage goods and a door 3 provided to open and close the main body 2. The door 3 may be rotatably or slidably movably disposed to open/close the cavity 9. The cavity 9 may provide at least one of a refrigerating compartment and a freezing compartment.

Components constituting a refrigeration cycle in which cool air is supplied into the cavity 9. In detail, the components include a compressor 4 for compressing a refrigerant, a condenser 5 for condensing the compressed refrigerant, an expander 6 for expanding the condensed refrigerant, and an evaporator 7 for evaporating the expanded refrigerant to take heat. As a typical structure, a fan may be installed at a position adjacent to the evaporator 7, and a fluid blown from the fan may pass through the evaporator 7 and then be blown into the cavity 9. A freezing load is controlled by adjusting the blowing amount and blowing direction by the fan, adjusting the amount of a circulated refrigerant, or adjusting the compression rate of the compressor, so that it is possible to control a refrigerating space or a freezing space.

FIG. 2 is a view schematically illustrating a vacuum adiabatic body used in the main body and the door of the refrigerator. In FIG. 2, a main body-side vacuum adiabatic body is illustrated in a state in which walls of top and side surfaces are removed, and a door-side vacuum adiabatic body is illustrated in a state in which a portion of a wall of a front surface is removed. In addition, sections of portions at conductive resistance sheets are provided are schematically illustrated for convenience of understanding.

Referring to FIG. 2, the vacuum adiabatic body includes a first plate 10 for providing a wall of a low-temperature space, a second plate 20 for providing a wall of a high-temperature space, a vacuum space 50 defined as a gap between the first and second plates 10 and 20. Also, the vacuum adiabatic body includes the conductive resistance sheets 60 and 63 for preventing heat conduction between the first and second plates 10 and 20. A seal 61 for sealing the first and second plates 10 and 20 is provided so that the vacuum space 50 is in a sealing state. When the vacuum adiabatic body is applied to a refrigerator or a heating cabinet, the first plate 10 may be referred to as an inner case that is installed inside a control space controlling a temperature, and the second plate 20 may be referred to as an outer case that is installed outside the control space. A machine room 8 in which components providing a refrigeration cycle are accommodated is placed at a lower rear side of the main body-side vacuum adiabatic body, and an exhaust port 40 for forming a vacuum state by exhausting air in the vacuum space 50 is provided at any one side of the vacuum adiabatic body. In addition, a pipeline 64 passing through the vacuum space 50 may be further installed so as to install a defrosting water line and electric wires.

The first plate 10 may define at least a portion of a wall for a first space provided thereto. The second plate 20 may define at least a portion of a wall for a second space provided thereto. The first space and the second space may be defined as spaces having different temperatures. Here, the wall for each space may serve as not only a wall directly contacting the space but also a wall not contacting the space. For example, the vacuum adiabatic body of the embodiment may also be applied to a product further having a separate wall contacting each space.

Factors of heat transfer, which cause loss of the adiabatic effect of the vacuum adiabatic body, are heat conduction between the first and second plates 10 and 20, heat radiation between the first and second plates 10 and 20, and gas conduction of the vacuum space 50.

Hereinafter, a heat resistance unit provided to reduce adiabatic loss related to the factors of the heat transfer will be provided. Meanwhile, the vacuum adiabatic body and the refrigerator of the embodiment do not exclude that another adiabatic means is further provided to at least one side of the vacuum adiabatic body. Therefore, an adiabatic means using foaming or the like may be further provided to another side of the vacuum adiabatic body.

FIG. 3 is a view illustrating an internal configuration of the vacuum space according to various embodiments.

First, referring to FIG. 3A, the vacuum space 50 may be provided in a third space having a pressure different from that of each of the first and second spaces, preferably, a vacuum state, thereby reducing an adiabatic loss. The third space may be provided at a temperature between the temperature of the first space and the temperature of the second space. Since the third space is provided as a space in the vacuum state, the first and second plates 10 and 20 receive a force contracting in a direction in which they approach each other due to a force corresponding to a pressure difference between the first and second spaces. Therefore, the vacuum space 50 may be deformed in a direction in which the vacuum space 50 is reduced in volume. In this case, the adiabatic loss may be caused due to an increase in amount of heat radiation, caused by the contraction of the vacuum space 50, and an increase in amount of heat conduction, which is caused by contact between the plates 10 and 20.

The support 30 may be provided to reduce the deformation of the vacuum space 50.

The support 30 includes a bar 31. The bar 31 may extend in a substantially vertical direction with respect to the plates to support a distance between the first plate and the second plate. A support plate 35 may be additionally provided on at least any one end of the bar 31. The support plate 35 may connect at least two or more bars 31 to each other to extend in a horizontal direction with respect to the first and second plates 10 and 20. The support plate 35 may be provided in a plate shape or may be provided in a lattice shape so that an area of the support plate contacting the first or second plate 10 or 20 decreases, thereby reducing heat transfer. The bars 31 and the support plate 35 are fixed to each other at at least a portion so as to be inserted together between the first and second plates 10 and 20. The support plate 35 contacts at least one of the first and second plates 10 and 20, thereby preventing the deformation of the first and second plates 10 and 20. In addition, based on the extension direction of the bars 31, a total sectional area of the support plate 35 is provided to be greater than that of the bars 31, so that heat transferred through the bars 31 may be diffused through the support plate 35.

The support 30 may be made of a resin selected from PC, glass fiber PC, low outgassing PC, PPS, and LCP to obtain high compressive strength, a low outgassing and water absorption rate, low thermal conductivity, high compressive strength at a high temperature, and superior processability.

A radiation resistance sheet 32 for reducing heat radiation between the first and second plates 10 and 20 through the vacuum space 50 will be described. The first and second plates 10 and 20 may be made of a stainless material capable of preventing corrosion and providing a sufficient strength. Since the stainless material has a relatively high emissivity of 0.16, a large amount of radiation heat may be transferred. In addition, the support 30 made of the resin has a lower emissivity than the plates, and is not entirely provided to inner surfaces of the first and second plates 10 and 20. Thus, the support 30 does not have great influence on the radiation heat. Therefore, the radiation resistance sheet 32 may be provided in a plate shape over a majority of the area of the vacuum space 50 so as to concentrate on reduction of radiation heat transferred between the first and second plates 10 and 20. A product having a low emissivity may be used as the material of the radiation resistance sheet 32. In an embodiment, an aluminum foil having an emissivity of 0.02 may be used as the radiation resistance sheet 32. Also, since the transfer of radiation heat may not be sufficiently blocked using one radiation resistance sheet, at least two radiation resistance sheets 32 may be provided at a certain distance so as not to contact each other. Also, at least one radiation resistance sheet may be provided in a state of contacting the inner surface of the first or second plate 10 or 20.

Referring back FIG. 3*b*, the distance between the plates is maintained by the support 30, and a porous material 33 may be filled in the vacuum space 50. The porous material 33 may have a higher emissivity than that of the stainless material of the first and second plates 10 and 20. However, since the porous material 33 is filled in the vacuum space 50, the porous material 33 has a high efficiency for resisting the radiation heat transfer.

In this embodiment, the vacuum adiabatic body may be fabricated without the radiation resistance sheet 32.

Referring to FIG. 3*c*, the support 30 for maintaining the vacuum space 50 may not be provided. A porous material 333 may be provided to be surrounded by a film 34 instead of the support 30. Here, the porous material 33 may be provided in a state of being compressed so that the gap of the vacuum space is maintained. The film 34 made of, for example, a PE material may be provided in a state in which a hole is punched in the film 34.

In this embodiment, the vacuum adiabatic body may be fabricated without the support 30. That is to say, the porous material 33 may perform the function of the radiation resistance sheet 32 and the function of the support 30 together.

FIG. 4 is a view illustrating the conductive resistance sheet and the peripheral portion thereof according to various embodiments. A structure of each of the conductive resistance sheets are briefly illustrated in FIG. 2, but will be understood in detail with reference to the drawings.

First, a conductive resistance sheet proposed in FIG. 4*a* may be applied to the main body-side vacuum adiabatic body. Specifically, the first and second plates 10 and 20 are to be sealed so as to vacuum the inside of the vacuum adiabatic body. In this case, since the two plates have different temperatures from each other, heat transfer may occur between the two plates. A conductive resistance sheet 60 is provided to prevent heat conduction between different two kinds of plates.

The conductive resistance sheet 60 may be provided with the seal 61 at which both ends of the conductive resistance sheet 60 are sealed to define at least a portion of the wall for the third space and maintain the vacuum state. The conductive resistance sheet 60 may be provided as a thin foil in unit of micrometer so as to reduce the amount of heat conducted along the wall for the third space. The seals 61 may be provided as a weld. That is, the conductive resistance sheet 60 and the plates 10 and 20 may be fused to each other. To cause a fusing operation between the conductive resistance sheet 60 and the plates 10 and 20, the conductive resistance sheet 60 and the plates 10 and 20 may be made of the same material, and a stainless material may be used as the material. The seal 61 may not be limited to the weld and may be provided through a process such as cocking. The conductive resistance sheet 60 may be provided in a curved shape. Thus, a heat conduction distance of the conductive resistance sheet 60 is provided longer than a linear distance of each of the plates so that an amount of heat conduction is further reduced.

A change in temperature occurs along the conductive resistance sheet 60. Therefore, to block the heat transfer to the outside of the conductive resistance sheet 60, a shield 62 may be provided at the outside of the conductive resistance sheet 60 so that an adiabatic operation occurs. In other words, in case of the refrigerator, the second plate 20 has a high temperature, and the first plate 10 has a low temperature. In addition, heat conduction from high temperature to low temperature occurs in the conductive resistance sheet 60, and thus the temperature of the conductive resistance sheet 60 is suddenly changed. Therefore, when the conductive resistance sheet 60 is opened with respect to the outside thereof, the heat transfer through the opened place may seriously occur. To reduce the heat loss, the shield 62 is provided outside the conductive resistance sheet 60. For example, when the conductive resistance sheet 60 is exposed to any one of the low-temperature space and the high-temperature space, the conductive resistance sheet 60 does not serve as a conductive resistor as well as the exposed portion thereof, which is not preferable.

The shield 62 may be provided as a porous material contacting an outer surface of the conductive resistance sheet 60. The shield 62 may be provided as an adiabatic structure, e.g., a separate gasket, which is placed at the outside of the conductive resistance sheet 60. The shield 62 may be provided as a portion of the vacuum adiabatic body, which is provided at a position facing a corresponding conductive resistance sheet 60 when the main body-side vacuum adiabatic body is closed with respect to the door-side vacuum adiabatic body. To reduce the heat loss even when the main body and the door are opened, the shield 62 may be provided as a porous material or a separate adiabatic structure.

A conductive resistance sheet proposed in FIG. 4*b* may be applied to the door-side vacuum adiabatic body. In FIG. 4*b*, portions different from those of FIG. 4*a* are described in detail, and the same description is applied to portions identical to those of FIG. 4*a*. A side frame 70 is further provided outside the conductive resistance sheet 60. A component for the sealing between the door and the main body, an exhaust port necessary for an exhaust process, a getter port for vacuum maintenance, and the like may be placed on the side frame 70. This is because the mounting of components is convenient in the main body-side vacuum adiabatic body, but the mounting positions of components are limited in the door-side vacuum adiabatic body.

In the door-side vacuum adiabatic body, it is difficult to place the conductive resistance sheet 60 on a front end of the vacuum space, i.e., an edge side surface of the vacuum space. This is because, unlike the main body, a corner edge of the door is exposed to the outside. In more detail, if the conductive resistance sheet 60 is placed on the front end of the vacuum space, the corner edge of the door is exposed to the outside, and hence there is a disadvantage in that a separate adiabatic portion has to be configured so as to thermally insulate the conductive resistance sheet 60.

A conductive resistance sheet proposed in FIG. 4*c* may be installed in the pipeline passing through the vacuum space. In FIG. 4*c*, portions different from those of FIGS. 4*a* and 4*b* are described in detail, and the same description is applied to portions identical to those of FIGS. 4*a* and 4*b*. A conductive resistance sheet having the same shape as that of FIG. 4*a*, preferably, a wrinkled conductive resistance sheet 63 may be provided at a peripheral portion of the pipeline 64. Accordingly, a heat transfer path may be lengthened, and deformation caused by a pressure difference may be prevented. In addition, a separate shield may be provided to improve the adiabatic performance of the conductive resistance sheet.

A heat transfer path between the first and second plates 10 and 20 will be described with reference back to FIG. 4*a*. Heat passing through the vacuum adiabatic body may be divided into surface conduction heat ① conducted along a surface of the vacuum adiabatic body, more specifically, the conductive resistance sheet 60, support conduction heat ② conducted along the support 30 provided inside the vacuum adiabatic body, gas conduction heat ③ conducted through an internal gas in the vacuum space, and radiation transfer heat ④ transferred through the vacuum space.

The transfer heat may be changed depending on various depending on various design dimensions. For example, the support may be changed so that the first and second plates 10 and 20 may endure a vacuum pressure without being deformed, the vacuum pressure may be changed, the distance between the plates may be changed, and the length of the conductive resistance sheet may be changed. The transfer heat may be changed depending on a difference in temperature between the spaces (the first and second spaces) respectively provided by the plates. In the embodiment, a preferred configuration of the vacuum adiabatic body has been found by considering that its total heat transfer amount is smaller than that of a typical adiabatic structure formed by foaming polyurethane. In a typical refrigerator including the adiabatic structure formed by foaming the polyurethane, an effective heat transfer coefficient may be proposed as 19.6 mW/mK.

By performing a relative analysis on heat transfer amounts of the vacuum adiabatic body of the embodiment, a heat transfer amount by the gas conduction heat ③ may become the smallest. For example, the heat transfer amount by the gas conduction heat ③ may be controlled to be equal to or smaller than 4% of the total heat transfer amount. A heat transfer amount by solid conduction heat defined as a sum of the surface conduction heat ① and the support conduction heat ② is the largest. For example, the heat transfer amount by the solid conduction heat may reach 75% of the total heat transfer amount. A heat transfer amount by the radiation transfer heat ③ is smaller than the heat transfer amount by the solid conduction heat but larger than the heat transfer amount of the gas conduction heat. For example, the heat transfer amount by the radiation transfer heat ③ may occupy about 20% of the total heat transfer amount.

According to the heat transfer distribution, effective heat transfer coefficients (eK: effective K) (W/mK) of the surface conduction heat ①, the support conduction heat ②, the gas conduction heat ③, and the radiation transfer heat ④ may have an order of Math Equation 1 when comparing the transfer heat ①, ②, ③, and ④.

$$eK_{solid\ conduction\ heat} > eK_{radiation\ conduction\ heat} > eK_{gas\ conduction\ heat} \quad \text{[Equation 1]}$$

Here, the effective heat transfer coefficient (eK) is a value that may be measured using a shape and temperature differences of a target product. The effective heat transfer coefficient (eK) is a value that may be obtained by measuring a total heat transfer amount and a temperature at least one portion at which heat is transferred. For example, a calorific value (W) is measured using a heating source that may be quantitatively measured in the refrigerator, a temperature distribution (K) of the door is measured using heats respectively transferred through a main body and an edge of the door of the refrigerator, and a path through which heat is transferred is calculated as a conversion value (m), thereby evaluating an effective heat transfer coefficient.

The effective heat transfer coefficient (eK) of the entire vacuum adiabatic body is a value given by $k=QL/A\Delta T$. Here, Q denotes a calorific value (W) and may be obtained using a calorific value of a heater. A denotes a sectional area ($m^2$) of the vacuum adiabatic body, L denotes a thickness (m) of the vacuum adiabatic body, and $\Delta T$ denotes a temperature difference.

For the surface conduction heat, a conductive calorific value may be obtained through a temperature difference $\Delta T$ between an entrance and an exit of the conductive resistance sheet 60 or 63, a sectional area A of the conductive resistance sheet, a length L of the conductive resistance sheet, and a thermal conductivity (k) of the conductive resistance sheet (the thermal conductivity of the conductive resistance sheet is a material property of a material and may be obtained in advance). For the support conduction heat, a conductive calorific value may be obtained through a temperature difference $\Delta T$ between an entrance and an exit of the support 30, a sectional area A of the support, a length L of the support, and a thermal conductivity (k) of the support. Here, the thermal conductivity of the support may be a material property of a material and may be obtained in advance. The sum of the gas conduction heat ③, and the radiation transfer heat ④ may be obtained by subtracting the surface conduction heat and the support conduction heat from the heat transfer amount of the entire vacuum adiabatic body. A ratio of the gas conduction heat ③, and the radiation transfer heat ④ may be obtained by evaluating radiation transfer heat when no gas conduction heat exists by remarkably lowering a vacuum degree of the vacuum space 50.

When a porous material is provided inside the vacuum space 50, porous material conduction heat ⑤ may be a sum of the support conduction heat ② and the radiation transfer heat ④. The porous material conduction heat may be changed depending on various variables including a kind, an amount, and the like of the porous material.

According to an embodiment, a temperature difference $\Delta T_1$ between a geometric center formed by adjacent bars 31 and a point at which each of the bars 31 is located may be provided to be less than 0.5° C. Also, a temperature difference $\Delta T_2$ between the geometric center formed by the adjacent bars 31 and an edge of the vacuum adiabatic body may be provided to be less than 0.5° C. In the second plate 20, a temperature difference between an average temperature of the second plate and a temperature at a point at which a heat transfer path passing through the conductive resistance sheet 60 or 63 meets the second plate may be the largest. For example, when the second space is a region hotter than the first space, the temperature at the point at which the heat transfer path passing through the conductive resistance sheet meets the second plate becomes lowest. Similarly, when the second space is a region colder than the first space, the temperature at the point at which the heat transfer path passing through the conductive resistance sheet meets the second plate becomes highest.

This means that the amount of heat transferred through other points except the surface conduction heat passing through the conductive resistance sheet should be controlled, and the entire heat transfer amount satisfying the vacuum adiabatic body may be achieved only when the surface conduction heat occupies the largest heat transfer amount. For this, a temperature variation of the conductive resistance sheet may be controlled to be larger than that of the plate.

Physical characteristics of the components constituting the vacuum adiabatic body will be described. In the vacuum adiabatic body, force due to a vacuum pressure is applied to all of the components. Therefore, a material having a strength ($N/m^2$) of a certain level may be used.

Under such circumferences, the plates 10 and 20 and the side frame 70 may be made of a material having sufficient strength with which the plates 10 and 20 are not damaged by even the vacuum pressure. For example, when the number of bars 31 decreases to limit the support conduction heat, the deformation of each of the plates occurs due to the vacuum pressure, which may bad influence on an outer appearance of the refrigerator. The radiation resistance sheet 32 may be made of a material that has a low emissivity and may be easily subjected to thin film processing. Also, the radiation resistance sheet 32 has to ensure strength enough without being deformed by an external impact. The support 30 is provided to strength that is enough to support the force by the vacuum pressure and endure the external impact, and is to have processability. The conductive resistance sheet 60 may be made of a material that has a thin plate shape and may endure the vacuum pressure.

In an embodiment, the plate, the side frame, and the conductive resistance sheet may be made of stainless materials having the same strength. The radiation resistance sheet may be made of aluminum having weaker strength than that of each of the stainless materials. The support may be made of a resin having weaker strength than that of the aluminum.

Unlike the strength from the point of view of the materials, an analysis from the point of view of stiffness is required. The stiffness (N/m) may be a property that is not be easily deformed. Thus, although the same material is used, its stiffness may vary depending on its shape. The conductive resistance sheets 60 or 63 may be made of a material having strength, but the stiffness of the material may be low so as to increase in heat resistance and minimize the radiation heat as the conductive resistance sheet is uniformly spread without any roughness when the vacuum pressure is applied. The radiation resistance sheet 32 requires stiffness having a certain level so as not to contact another component due to deformation. Particularly, an edge of the radiation resistance sheet may generate the conduction heat due to drooping caused by the self-load of the radiation resistance sheet. Therefore, the stiffness having the certain level is required. The support 30 requires a stiffness enough to endure compressive stress from the plate and the external impact.

In an embodiment, the plate and the side frame may have the highest stiffness so as to prevent the deformation caused by the vacuum pressure. The support, particularly, the bar may have the second highest stiffness. The radiation resistance sheet may have stiffness that is lower than that of the support but higher than that of the conductive resistance sheet. Lastly, the conductive resistance sheet may be made of a material that is easily deformed by the vacuum pressure and has the lowest stiffness.

Even when the porous material 33 is filled in the vacuum space 50, the conductive resistance sheet may have the lowest stiffness, and each of the plate and the side frame may have the highest stiffness.

Hereinafter, the vacuum pressure may be determined depending on internal states of the vacuum adiabatic body. As already described above, a vacuum pressure is to be maintained inside the vacuum adiabatic body so as to reduce heat transfer. Here, it will be easily expected that the vacuum pressure is maintained as low as possible so as to reduce the heat transfer.

The vacuum space may resist to heat transfer by only the support 30. Here, a porous material 33 may be filled with the support inside the vacuum space 50 to resist to the heat transfer. The heat transfer to the porous material may resist without applying the support.

The case in which only the support is applied will be described.

FIG. 5 is a graph illustrating a variation in adiabatic performance and a variation in gas conductivity according to the vacuum pressure by applying a simulation.

Referring to FIG. 5, it may be seen that, as the vacuum pressure decreases, i.e., as the vacuum degree increases, a heat load in the case of only the main body (Graph 1) or in the case in which the main body and the door are combined together (Graph 2) decreases as compared to that in the case of the typical product formed by foaming polyurethane, thereby improving the adiabatic performance. However, it may be seen that the degree of improvement of the adiabatic performance is gradually lowered. Also, it may be seen that, as the vacuum pressure decreases, the gas conductivity (Graph 3) decreases. However, it may be seen that, although the vacuum pressure decreases, a ratio at which the adiabatic performance and the gas conductivity are improved is gradually lowered. Therefore, it is preferable that the vacuum pressure decreases as low as possible. However, it takes long time to obtain an excessive vacuum pressure, and much cost is consumed due to an excessive use of the getter. In the embodiment, an optimal vacuum pressure is proposed from the above-described point of view.

FIG. 6 is a graph illustrating results obtained by observing a time and a pressure in a process of exhausting the inside of the vacuum adiabatic body when the support is used.

Referring to FIG. 6, to create the vacuum space 50 to be in the vacuum state, a gas in the vacuum space 50 is exhausted by a vacuum pump while evaporating a latent gas remaining in the components of the vacuum space 50 through baking. However, if the vacuum pressure reaches a certain level or more, there exists a point at which the level of the vacuum pressure does not increase any more ($\Delta t_1$). Thereafter, the getter is activated by disconnecting the vacuum space 50 from the vacuum pump and applying heat to the vacuum space 50 ($\Delta t_2$). If the getter is activated, the pressure in the vacuum space 50 decreases for a certain period of time, but then normalized to maintain a vacuum pressure having a certain level. The vacuum pressure that maintains the certain level after the activation of the getter is approximately $1.8\times10^{6}$ Torr.

In the embodiment, a point at which the vacuum pressure does not substantially decrease any more even though the gas is exhausted by operating the vacuum pump is set to the lowest limit of the vacuum pressure used in the vacuum adiabatic body, thereby setting the minimum internal pressure of the vacuum space 50 to $1.8\times10^{-6}$ Torr.

FIG. 7 is a graph illustrating results obtained by comparing the vacuum pressure with gas conductivity.

Referring to FIG. 7, gas conductivity with respect to the vacuum pressure depending on a size of the gap in the vacuum space 50 was represented as a graph of effective heat transfer coefficient (eK). The effective heat transfer coefficient (eK) was measured when the gap in the vacuum space 50 has three sizes of 2.76 mm, 6.5 mm, and 12.5 mm. The gap in the vacuum space 50 is defined as follows. When the radiation resistance sheet 32 exists inside vacuum space 50, the gap is a distance between the radiation resistance sheet 32 and the plate adjacent thereto. When the radiation resistance sheet 32 does not exist inside vacuum space 50, the gap is a distance between the first and second plates.

It was seen that, since the size of the gap is small at a point corresponding to a typical effective heat transfer coefficient of 0.0196 W/mK, which is provided to an adiabatic material formed by foaming polyurethane, the vacuum pressure is $2.65\times10^{-1}$ Torr even when the size of the gap is 2.76 mm.

Meanwhile, it was seen that the point at which reduction in adiabatic effect caused by the gas conduction heat is saturated even though the vacuum pressure decreases is a point at which the vacuum pressure is approximately $4.5\times10^3$ Torr. The vacuum pressure of $4.5\times10^3$ Torr may be defined as the point at which the reduction in adiabatic effect caused by the gas conduction heat is saturated. Also, when the effective heat transfer coefficient is 0.1 W/mK, the vacuum pressure is $1.2\times10^2$ Torr.

When the vacuum space 50 is not provided with the support but provided with the porous material, the size of the gap ranges from a few micrometers to a few hundreds of micrometers. In this case, the amount of radiation heat transfer is small due to the porous material even when the vacuum pressure is relatively high, i.e., when the vacuum degree is low. Therefore, an appropriate vacuum pump is used to adjust the vacuum pressure. The vacuum pressure appropriate to the corresponding vacuum pump is approximately $2.0\times10^4$ Torr. Also, the vacuum pressure at the point at which the reduction in adiabatic effect caused by the gas conduction heat is saturated is approximately $4.7\times10^{-2}$ Torr. Also, the pressure where the reduction in adiabatic effect caused by gas conduction heat reaches the typical effective heat transfer coefficient of 0.0196 W/mK is 730 Torr.

When the support and the porous material are provided together in the vacuum space, a vacuum pressure may be created and used, which is middle between the vacuum pressure when only the support is used and the vacuum pressure when only the porous material is used. When only the porous material is used, the lowest vacuum pressure may be used.

The vacuum adiabatic body includes a first plate defining at least a portion of a wall for the first space and a second plate defining at least a portion of a wall for the second space and having a temperature different from the first space. The first plate may include a plurality of layers. The second plate may include a plurality of layers The vacuum adiabatic body may further include a seal configured to seal the first plate and the second plate so as to provide a third space that is in a vacuum state and has a temperature between a temperature of the first space and a temperature of the second space.

When one of the first plate and the second plate is disposed in an inner space of the third space, the plate may be represented as an inner plate. When the other one of the first plate and the second plate is disposed in an outer space of the third space, the plate may be represented as an outer plate. For example, the inner space of the third space may be a storage room of the refrigerator. The outer space of the third space may be an outer space of the refrigerator.

The vacuum adiabatic body may further include a support that maintains the third space.

The vacuum adiabatic body may further include a conductive resistance sheet connecting the first plate to the second plate to reduce an amount of heat transferred between the first plate and the second plate.

At least a portion of the conductive resistance sheet may be disposed to face the third space. The conductive resistance sheet may be disposed between an edge of the first plate and an edge of the second plate. The conductive resistance sheet may be disposed between a surface on which the first plate faces the first space and a surface on which the second plate faces the second space. The conductive resistance sheet may be disposed between a side surface of the first plate and a side surface of the second plate.

At least a portion of the conductive resistance sheet may extend in a direction that is substantially the same as the direction in which the first plate extends.

A thickness of the conductive resistance sheet may be thinner than at least one of the first plate or the second plate. The more the conductive resistance sheet decreases in thickness, the more heat transfer may decrease between the first plate and the second plate.

The more the conductive resistance sheet decreases in thickness, the more it may be difficult to couple the conductive resistance sheet between the first plate and the second plate.

One end of the conductive resistance sheet may be disposed to overlap at least a portion of the first plate. This is to provide a space for coupling one end of the conductive resistance sheet to the first plate. Here, the coupling method may include welding.

The other end of the conductive resistance sheet may be arranged to overlap at least a portion of the second plate. This is to provide a space for coupling the other end of the conductive resistance sheet to the second plate. Here, the coupling method may include welding.

As another embodiment of replacing the conductive resistance sheet, the conductive resistance sheet may be deleted, and one of the first plate and the second plate may be thinner than the other. In this case, any thickness may be greater than that of the conductive resistance sheet. In this case, any length may be greater than that of the conductive resistance sheet. With this configuration, it is possible to reduce the increase in heat transfer by deleting the conductive resistance sheet. Also, this configuration may reduce difficulty in coupling the first plate to the second plate.

At least a portion of the first plate and at least a portion of the second plate may be disposed to overlap each other. This is to provide a space for coupling the first plate to the second plate. An additional cover may be disposed on any one of the first plate and the second plate, which has a thin thickness. This is to protect the thin plate.

The vacuum adiabatic body may further include an exhaust port for discharging a gas in the vacuum space.

Hereinafter, as one embodiment, a detailed configuration of the refrigerator in which the vacuum adiabatic body is applied to at least the main body will be described. This embodiment illustrates a case in which an ice maker is installed in the refrigerating compartment door.

The ice maker may include a narrow-scale ice maker which receives cool air having a temperature of below zero and water to make ice and a board-scale ice maker including a dispensing structure for dispensing ice, a crusher that crushes ice, an ice bin containing ice, and a chute discharging ice.

This embodiment illustrates that the ice maker is installed in the refrigerating compartment door of the refrigerator in which the refrigerating compartment is disposed at an upper side, and the freezing compartment is disposed at a lower side. The ice maker may be provided in an upper portion of the refrigerating compartment door to perform a service so that ice drops downward through a dispenser disposed below the ice maker.

This embodiment is not limited to the above-mentioned range and may have various deformable applications.

FIG. 8 is a schematic perspective view of the ice-making cool air passage in the refrigerator according to an embodiment.

Referring to FIG. 8, the main body 2 and the door 3 are provided, and the main body 2 and the door 3 may be provided as vacuum adiabatic bodies. The main body 2 may be divided vertically by the mullion 300. A lower accommodation space may be provided as a freezing compartment F, and an upper compartment accommodation space may be provided as a refrigerating compartment R. The evaporator 7 may be placed along one side, preferably, a rear surface, inside the freezing compartment F.

An ice maker 81 and a dispenser 82 serving ice of the ice maker 81 to a user provided in the door.

To connect the evaporator 7 to the ice maker 81 so that cool air of the evaporator is supplied to the ice maker 81, a first ice-making cool air passage 100 and a second ice-making cool air passage 200 are provided. In the first ice-making cool air passage 100, the cool air flowing from the evaporator to the ice maker may flow. The cool air discharged from the ice maker to return to the evaporator may flow in the second ice-making cool air passage 200.

A door-side cool air passage (see reference numerals 105 and 205 in FIG. 15) may be provided in the door 3 and may operate together with the first and second ice-making cool air passages 100 and 200 to perform an inflow and outflow of the cool air through which the ice maker is connected.

The first ice-making cool air passage 100 and the second ice-making cool air passage 200 pass through the mullion. In other words, the ice-making cool air passages 100 and 200 may not be inserted into the inside of the vacuum adiabatic body, that is, the inside of the vacuum space serving as an adiabatic space. Accordingly, it is possible to prevent an adiabatic loss of the vacuum adiabatic body itself from occurring.

The ice-making cool air passage passing through the mullion may pass through the inside of the side panel 800. The side panel 800 may perform a function of guiding a shelf in the refrigerator or fixing a component and may be provided on a side surface of the refrigerator. The side panel 800 may be provided as a plate-shaped cover, or an inner space of the cover may be provided as an adiabatic space. Also, the inside of the adiabatic space may be thermally insulated by a foaming material. The side panel may be referred to as any of the cover, all of the cover and the adiabatic space, and both the cover, the adiabatic space, and the foam portion. The side panel 800 may be referred to as the cover.

The inner space of the side panel is covered from the space in the refrigerator so that a temperature atmosphere in the refrigerator and the ice-making cool air passages 100 and 200 are not affected with respect to each other.

This will be described in detail.

It is possible to prevent the cool air of the first ice-making cool air passage 100 from being heat-exchanged with the inside of the refrigerating compartment to lose the cool air and deteriorate ice-making ability of the ice maker. The cool air of the ice-making cool air passage 100 may be continuously supplied to the refrigerating compartment to prevent stored items in the refrigerating compartment from being supercooled. Of course, an irreversible loss due to unnecessary heat exchange may be reduced.

The supercooling of the stored items in the refrigerating compartment by the cool air of the second ice-making cool air passage 200 may be prevented to reduce the irreversible loss due to the unnecessary heat exchange.

The first ice-making cool air passage 100 and the second ice-making cool air passage 200 may be spaced a predetermined distance from each other to prevent heat exchange from occurring between the ice-making cool air passages 100 and 200.

The first and second ice-making cool air passages 100 and 200 may be provided as passages connecting the evaporator to the ice maker to provide the shortest distance, thereby reducing the adiabatic loss. For this, the first and second ice-making cool air passages 100 and 200 have an inclined section having a certain angle that is different from vertical and horizontal states.

FIG. 9 is a schematic cross-sectional view of the freezing compartment-side ice-making cool air passage in the refrigerator according to an embodiment, and FIG. 10 is a schematic cross-sectional view of the refrigerating compartment-side ice-making cool air passage in the refrigerator according to an embodiment.

Referring to FIG. 9, the evaporator 7, a blower fan 150, and the first ice-making cool air passage 100 are disclosed. The evaporator 7 is placed along a rear side inside the freezing compartment to generate cool air. The blower fan 150 is placed at one side adjacent to the evaporator 7 to blow the cool air generated in the evaporator to an inlet-side of the first ice-making cool air passage 100.

The second ice-making cool air passage 200 may be disposed in front of the first ice-making cool air passage 100. In other words, when based on the evaporator 7, a discharge end of the second ice-making cool air passage 200 may be disposed farther than an inlet end of the first ice-making cool air passage 100. As a result, it is possible to prevent backflow of the blown cool air or a loss of a blowing pressure.

The first and second ice-making cool air passages 100 and 200 may not be disposed in or not pass through the vacuum space of the vacuum adiabatic body that is an adiabatic space at the freezing compartment-side. The first and second ice-making cool air passages 100 and 200 may be disposed in the inner space of the freezing compartment F in which a freezing atmosphere is formed.

The first and second ice-making cool air passages 100 and 200 may have a narrow and wide channel cross-section, and the wide surface of the channel may be disposed to face a side surface of the freezing compartment in the refrigerator. Accordingly, the larger space inside the freezing compartment may be obtained.

The blower fan 150 may directly suction the cool air of the evaporator 7, and for this purpose, the blower fan 150 may be disposed at a position adjacent to the evaporator 7. The blower fan 150 may be controlled together with other blowing proposes within the refrigerator, for example, an air circulation within the refrigerator. However, in consideration of the narrow channel of the ice-making cool air passage, the blower fan 150 may be separately provided for only the purpose of blowing the air to the inlet-side of the first ice-making cool air passage 100. The discharge end of the blower fan 150 may be sealed with the inlet end of the first ice-making cool air passage 100 to blow air at a high pressure in consideration of a pipeline loss.

The first and second ice-cooling passages 100 and 200 may not be thermally insulated by a separate adiabatic structure in the freezing compartment. Of course, if a difference in temperature atmosphere between the cool air inside the ice-making cool air passages 100 and 200 and the freezing compartment is large according to the passage structure of the cool air, a separate adiabatic structure for the ice-making cool air passage is not excluded.

Referring to FIG. 10, the first and second ice-making cool air passages 100 and 200 may move along the side surface of the refrigerating compartment R, and a wide surface of the channel may be disposed on the side surface of the refrigerating compartment. Thus, the description in the freezing compartment F may be applied as well. Differences with respect to the descriptions in the freezing compartment will be described.

The first and second ice-making cool air passages 100 and 200 may be disposed in the inner space of the side panel 800. The side panel is a portion for selecting a fixed position of the shelf or the like disposed in the refrigerator and allowing an operation of the shelf or the like. A rail 810 may be installed on the side panel to allow a slide operation of the shelf or the like.

It may be seen that the first ice-making cool air passage 100 extends by a certain distance toward the door-side. The first ice-making cool air passage 100 may be provided to be inclined to face the door-side, and the second ice-making cool air passage 200 may be provided to be inclined relatively slightly when compared to the first ice-making cool air passage 100.

The first and second ice-making cool air passages 100 and 200 may contact the inner surface of the vacuum adiabatic body. Accordingly, an adiabatic effect using the vacuum adiabatic body having a high adiabatic effect may be obtained, and a wider space within the refrigerator may be obtained by allowing the side panel to have a thickness as thin as possible.

The first and second ice-making cool air passages 100 and 200 may not be disposed in or not pass through the vacuum space of the vacuum adiabatic body that is an adiabatic space at the refrigerating compartment-side. The first and second ice-making cool air passages 100 and 200 may be disposed in the inn space of the refrigerating compartment R in which a refrigerating atmosphere is formed.

Hereinafter, a portion at which the first and second ice-making cool air passages 100 and 200 are connected to the door-side cool air passages 105 and 205 will be described.

The connection ends of the first and second ice-making cool air passages 100 and 200 and the connection ends of the first and second door-side cool air passages 105 and 205 may contact each other to the ice-making cool air to be introduced and discharged when the door is closed and may be spaced apart from each other so as not to supply the ice-making cool air when the door is opened.

FIG. 11 is a front perspective view illustrating the connection end between first and second ice-making cool air passage in the refrigerator, and FIG. 12 is a rear perspective view illustrating the connection end between first and second door-side ice-making cool air passage in the refrigerator.

Referring to FIG. 11, a first docking portion 104 and a second docking portion 204 may be disposed vertically on an inner side surface of the front portion of the side panel 800.

The first docking portion 104 may be an outlet end of the first ice-making cool air passage 100, and the second docking portion 204 may be an inlet end of the second ice-making cool air passage 100. The first docking portion 104 may be disposed to be spaced apart from the second docking portion 204 above the second docking portion 204.

A narrow and wide channel of each of the ice-making cool air passages 100 and 200 may be erected vertically, and the two channels of the ice-making cool air passages 100 and 200 may be arranged in series with each other.

A vertical positional relationship of the docking portions 104 and 204 has a structure in which the inlet end of the first ice-making cool air passage 100 is disposed behind the inlet end of the second ice-making cool air passage 200, and the ice making cool air passage is gradually inclined forward.

To reverse the vertical relationship between the docking portions 104 and 204, the passage has to be twisted or bent while the two ice-making cool air passages extends, which may lead to the space loss in the refrigerator. The docking portions 104 and 204 may be configured as shown in order to provide natural circulation of the cool air discharged after the heavy cool air is supplied to the upper portion of the ice maker and then discharged to the lower side of the ice maker.

The first and second docking portions 104 and 204 may be disposed on the inner surface of the front end of the side panel 800. The inner surface of the front end may be provided to be inclined to be wider toward the outside of the main body. Thus, during the opening and closing operation of the door, the connection ends of the first and second ice-making cool air passages 100 and 200 and the connection ends of the first and second door-side cool air passages 105 and 205 may not interfere with each other and thus be smoothly opened and sealed.

Referring to FIG. 12, openings 811 and 812 may be defined in a side surface of the door 3 corresponding to the docking portions 104 and 204. Like the docking portions 104 and 204, the positional relationship of the openings may be provided to be inclined and may be arranged in series vertically.

The docking portion and the opening may be in contact with each other to provide a passage for the cool air, and a soft sealing material is interposed at both contact surfaces to prevent the cool air from leaking.

FIG. 13 is a view for explaining a relationship between the ice-making cool air passage and the mullion.

Referring to FIG. 13, the mullion 300 may be provided as a combined portion in which a foam portion is foamed in the case to partition the space within the refrigerator. The first and second ice-making cool air passages 100 and 200 may pass through the mullion 300 and be supported by the mullion 300.

In the first ice-making cool air passage 100, a portion 101 within the first freezing compartment, in which the inlet end is disposed in the space of the freezing compartment, a first mullion portion 102 which passes through the mullion and of which at least a portion is disposed in the mullion, and a portion 103 within the first side panel, which is disposed on the side panel 800. The outlet end of the first ice-making cool air passage 100 may be disposed on the inside and the surface of the side panel or may protrude to the outside of the side panel.

Likewise, in the second ice-making cool air passage 200, a portion 201 within the second freezing compartment, in which the outlet end is disposed, a second mullion portion 202 which passes through the mullion and of which at least a portion is disposed in the mullion, and a portion 203 within the second side panel, which is disposed on the side panel 800. The inlet end of the second ice-making cool air passage 200 may be disposed on the inside and the surface of the side panel or may protrude to the outside of the side panel.

Since the first ice-making cool air passage 100 is installed in the refrigerator, a narrow and wide channel is installed close to the inner surface of the vacuum adiabatic body. This is the same also in the case of the second ice-making cool air passage 200. Thus, to ensure a smooth flow in the passage, the ice-making cool air passages 100 and 200 are bent toward the door-side at the connection portion with the door. An end of the ice-making cool air passage bent in the door direction may provide the docking portions 104 and 204. When the ice-making cool air passages 100 and 200 may be not only bent in front-rear and upward-downward directions but also bent in the lateral direction of the docking portions 104 and 204 with respect to the front of the refrigerator to guide the smooth flow of the air.

FIG. 14 is a view for explaining a structure on which the mullion is seated.

Referring to FIG. 14, the mullion 300 may be fixed to the inside of the vacuum adiabatic body. As an example for fixing the mullion 300 to the inside of the vacuum adiabatic body, the mullion seating frame 130 may be provided. The mullion 300 may be configured so that the mullion adiabatic material 320 is provided inside the mullion panel 321, and as a whole, a smooth adiabatic operation of the refrigerating and freezing spaces by the mullion 300 may be achieved.

The mullion seating frame 130 may have a vacuum adiabatic body extension extending along the inner surface of the vacuum adiabatic body and a mullion extension extending toward the mullion 300. The vacuum adiabatic body extension may be a portion extending vertically in the drawing, and the mullion extension may be a portion extending horizontally in the drawing.

As a preferable example, a frame having a cross-sectional structure that is bent once may be at least partially coupled to the mullion seating frame 130 along both sides and the rear surface of the inner surface of the vacuum adiabatic body.

The mullion 300 may be disposed on the mullion seating frame 130, and the ice-making cool air passages 100 and 200 that passes through a portion of the mullion may be disposed inside the side panel 800. An adiabatic material is disposed inside the side panel 800 to allow the ice-making cool air passages 100 and 200 to be thermally insulated with respect to a relatively high temperature atmosphere in the refrigerating space.

A structure and a coupling method in which the ice-making cool air passages 100 and 200 are coupled to the mullion 300 and the side panel 800 will be described. As described above, a side panel adiabatic material 820 may be provided inside the side panel 800 to allow the inside of the side panel to be thermally insulated with respect to the inner space of the refrigerator. The mullion 300 may be provided with a mullion adiabatic material 320 inside the mullion panel 321 to thermally insulate and partition the space. The mullion adiabatic material 320 and the side panel adiabatic material 820 may preferably exemplify a foam adiabatic material.

The coupling method of the ice-making cool air passages 100 and 200, the mullion 300, the side panel 800, the mullion adiabatic material 320, and the side panel adiabatic material 820 will be described in detail. The portions may contribute to increase in adiabatic efficiency by allowing a distance between the portions to decrease as short as possible.

First, the ice-making cool air passages 100 and 200 may be disposed in the refrigerator in a state of being coupled to the side panel adiabatic material 820 and then be coupled to the inner surface of the vacuum adiabatic body. Here, the location in the refrigerator may mean that it is disposed at a fixed position in the refrigerator according to the design to prepare or wait for the following coupling process.

As a more specific example, the ice-making cool air passages 100 and 200 are coupled to the mullion panel 321 and the side panel 800. Thereafter, the side panel adiabatic material 820 may be foamed inside the side panel 800 so that all the portions are coupled to each other using the foaming material. Thereafter, it may be fixed to the inner surface of the vacuum adiabatic body.

As another example, after the ice-making cool air passages 100 and 200 are assembled on the inner surface of the vacuum adiabatic body, the mullion panel 321 and the side panel 800 may be coupled to each other. Thereafter, the side panel adiabatic material 820 may be foamed so that the mullion panel 321 and the side panel 800 are coupled to each other to form one body.

For another example, the side panel adiabatic material 820 may be foamed and integrated using a separate mold outside the ice-making cool air passages 100 and 200. Thereafter, an assembly of the ice-making cool air passage 100 and 200 and the side panel adiabatic material 820 may be coupled to the mullion panel 321 and the side panel 800. After that, it may be fixed to the inner surface of the vacuum adiabatic body.

In all of the above examples, the foaming process of the mullion adiabatic material 320 may be performed together with the foaming process of the side panel adiabatic material 820, and the coupling operation by the foaming portion may also be performed.

On the other hand, as another method, the ice-making cool air passages 100 and 200 may be disposed while the mullion adiabatic material 320 is foamed, and the assembly of the side panel 800 and the mullion panel 321 may be coupled to each other. Thereafter, the side panel adiabatic material 820 may be foamed to couple both the portions to each other. After all the coupling is completed, it may be coupled to the inner surface of the vacuum adiabatic body.

When the ice-making cool air passages 100 and 200 are fixed to the mullion panel 321 and the side panel 800, the ice-making cool air passages 100 and 200 may be disposed to pass through the mullion panel 321 and the side panel 800. In this case, each panel may become a foam cover so that a foam portion is filled in the foam cover by the foaming operation. All the portions may be coupled by the foam portion. In the coupled state, it may be seated on the inner surface of the vacuum adiabatic body.

The portions of fixing the ice-making cool air passages 100 and 200 may correspond to all portions of the mullion panel 321, the side panel 800, the mullion adiabatic material 320, and the side panel adiabatic material 820. In some cases, it may be one or two or more portions selected from the four portions.

The mullion panel 321 and the side panel 800 may be provided as one body, and thus, the single structure that is provided as one body may be provided as the foam covers that are conveniently used in the foaming process.

To prevent the ice-making cool air passages 100 and 200 from interfering with the mullion seating frame 130, a portion of the ice-making cool air passages 100 and 200 may be bent at an angle $\alpha$. The angle $\alpha$ is for the purpose of allowing the ice-making cool air passage to pass over the mullion extension of the mullion seating frame. In another case, a cutoff portion may be provided in the mullion seating frame 130 to cut a portion through which each of the ice-making cool air passages 100 and 200 pass.

Hereinafter, an ice-making cool air passage according to another embodiment will be described.

This embodiment differs from the ice-making cool air passage according to the foregoing embodiment in that many portions of the ice-making cool air passage are accommodated in the mullion.

In other words, in the foregoing embodiment, although the ice-making cool air passage passes through the mullion, many portions are disposed inside the side panel. On the other hand, in this embodiment, the ice-making cool air passage is different in that being guided to a door-side, that is, to a front side through the mullion.

Accordingly, the ice-making cool air passage according to the forgoing embodiment may be referred to as a side panel-side ice-making cool air passage, and the ice-making cool air passage according to this embodiment may be referred to as a mullion-side ice-making cool air passage. However, to avoid the complexity of the excessive terms, the portions that may be understood in each portion of the text will be referred to as an ice-making cool air passage and then explained. However, in the portion at which special classification is necessary, different names are given and explained.

In the description of the following embodiment, the portions to which the content of the foregoing embodiment may be applied as it is will be applied to the description of the foregoing embodiment. In the case in which the same operation is performed, the same reference numeral will be given.

FIG. 16 is a schematic perspective view of an ice-making cool air passage in a refrigerator according to another embodiment. FIG. 17 is a view illustrating a relationship between a mullion and a door according to another embodiment.

Referring to FIGS. 16 and 17, a blower fan 150 transfers cool air generated in an evaporator to an inlet-side of a first ice-making cool air passage 100. The first ice-making cool air passage 100 extends along the mullions within the mullions. In this embodiment, a second ice-making cool air passage 200 may not move along the mullion, but may be guided directly to a freezing compartment from a lower end of a door. Thus, it is possible to prevent unnecessary waste of an inner adiabatic space of the mullion.

The second ice-making cool air passage 200 may be disposed at one side of the first ice-making cool air passage 100. Specifically, a discharge end of the second ice-making cool air passage 200 and an inlet end of the first ice-making cool air passage 100 may be disposed at left and right sides of a front end of the mullion.

The first and second ice-making cool air passages 100 and 200 may not be disposed in or not pass through the vacuum space of the vacuum adiabatic body that is an adiabatic space at the freezing compartment-side. The first and second ice-making cool air passages 100 and 200 may be disposed in the inner space of the freezing compartment F in which a freezing atmosphere is formed.

The first ice-making cool air passage 100 may have a narrow and wide flat channel cross-section, and the wide surface of the channel may be disposed along a plane of the mullion of the freezing compartment. Accordingly, a thickness of the mullion may be less or greater than that of the space within the refrigerator.

The first ice-making cool air passage 100 extends forward from the inside of the mullion. The first ice-making cool air passage 100 may have an extension 133 disposed inside the mullion 300 and extending forward and backward from the mullion in a state of being laid flatly, a downward inclined portion 132 that is inclined downward toward an evaporator 7 from a rear portion of the extension 133, a portion 131 within the freezing compartment, which extends to the inside of the freezing compartment, and an upward inclined portion that is inclined upward toward a door from the front portion of the extension 133.

The inclined portions 132 and 134 are configured to reduce a flow loss due to the narrow inner space of the channel by gently providing the passage. In the drawing, each of the inclined portions is indicated to be inclined at an angle $\alpha$.

The portion 131 within the freezing compartment may be provided to improve ice-making performance of the ice maker by suctioning evaporator discharge air at a low temperature as much as possible.

An outlet of the upward inclined portion 134 may be provided at a portion that is aligned with a bottom surface of the door at a top surface of a front end of the mullion. A cool air passage extending from the ice maker may be connected to the bottom surface of the door.

The second ice-making cool air passage 200 may be disposed in a state of being aligned in a left and right direction with the outlet of the first ice-making cool air passage 100. All of the ice-making cool air passages 100 and 200 may be provided with narrow channels that are long in the left and right direction. This is done for allowing the ice-making cool air passages 100 and 200 to be in maximally insulated state in consideration of the narrow front and rear width of the door. The second ice-making cool air passage 200 may be provided as a structure that is similar to the upward inclined portion 134.

The door-side cool air passages 105 and 205 are the same as in the foregoing embodiment except that an end of the passage connected to the ice maker is led out from a lower end surface of the door, and the end is aligned in the left and right direction rather than a vertical direction.

In the inside of the mullion 300, the ice-making cool air passages 100 and 200 may be placed as close as possible to the freezing compartment F to prevent a cool air loss from occurring.

The inlet and outlet ends of the ice-making cool air passage may be exposed to the outside when the door is opened. Also, since an opened structure connected to the freezing compartment is provided, a switching structure may be provided.

FIGS. 18 and 19 are views for explaining the switching structure of the ice-making cool air passage, wherein FIG. 18 is a view illustrating a mullion side, and FIG. 19 is a view illustrating a door side.

Referring to FIG. 18, a switching door structure may be provided at an end of the ice-making cool air passage. In the switching door structure, a passage door 135 capable of opening and closing an opening of an upward inclined portion 134, a spring 136 guiding a rotation operation of the passage door, and a stopper 137 stopping the rotation of the door that rotates by force of the spring 36.

Since an end of the upward inclined portion 134 is provided to be inclined, a portion of the upward inclined portion 134 contacts the door when the door is closed to automatically open the passage door 135. A portion that is hung on the door when the door is opened may be released to allow the passage door 135 to be automatically closed. When the passage door 135 is closed, a limit by which the door is hung on the stopper 137 may be set.

Referring to FIG. 19, a pusher 1351 may be provided at a portion that is adjacent to outlet-side opening ends of the door-side cool air passages 105 and 205 on a bottom surface of the door. The pusher may push the passage door 135 to open the passage door.

The positional relationship between the pusher 1351 and the passage door 135 may be provided so that that when the door 3 is closed with respect to the main body 2, the pusher 1351 and the passage door 135 are disposed at positions at which the pusher 1351 and the passage door 135 are aligned with each other. In addition to the non-sharped shape, each of the pusher 1351 and the passage door 135 may be variously changed in shape.

According to the switching door structure, the opening/closing of the door 3 with respect to the main body 2 and the opening/closing of the ice-making cool air passage may be performed in reverse. That is, when the door is closed, the ice-making cool air passage is opened, and when the door is opened, the ice-making cool air passage may be closed. Accordingly, it is possible to improve the thermal performance by blocking leakage of the strong cool air used for ice-making. It may previously block foreign substances from being introduced.

The switching door structure may further be provided with structures that are opposite to each other. In other words, the passage door, the stopper, and the spring may be provided at the end of the door-side cool air passage, and the pusher may be provided at the end of the ice-making cool air passage. Accordingly, the cool air loss in the door-side cool air passage may be reduced.

In the switching door structure, a pair of switching structures may be provided at both the end of the ice-making cool air passage and the end of the door-side cool air passage, respectively. Accordingly, the door may be provided at both the end of the ice-making cool air passage and the end of the door-side cool air passage to prevent the cool air from leaking and to prevent the foreign substances from being introduced.

Hereinafter, the structure of the ice-making cool air passage in the case of the refrigerator according to the embodiment in which the vacuum adiabatic bodies are separated from each other will be described. For the portions without specific description, it is assumed that the contents of the foregoing embodiment are applied as it is. On the other hand, in the following contents, the door is not shown for convenience, but it is naturally understood that door is provided.

FIG. 20 is a perspective view of the refrigerator in which each vacuum adiabatic body provides each storage space. FIG. 21 is a perspective view of the refrigerator in a state in which a gap maintenance portion is provided at a connection portion between the vacuum adiabatic bodies.

In the refrigerator according to the embodiment, for example, a lower side may provide a refrigerating compartment as a storage space above the freezing compartment.

Referring to FIG. 20, a first body 2*a* and a second body 2*b* may be provided by independent vacuum adiabatic bodies. The bodies 2*a* and 2*b* may be spaced apart from each other. Components that are necessary for the operation of the refrigerator may be accommodated in a gap between the bodies 2*a* and 2*b* spaced apart from each other.

A gap maintenance portion 590 is provided in the gap between the vacuum adiabatic bodies so that the two upper and lower vacuum adiabatic bodies are firmly coupled to each other to form one body, thereby increasing in impact resistance. Components required for the operation of the refrigerator may be accommodated between the two vacuum adiabatic bodies provided by the gap maintenance portion 590.

In the evaporator provided in the second body 3*b*, contents required for the ice-making may be supplied to the first body 2*a*. For this, the first body 2*a* may be provided with a first ice-making connection passage 511 and a second ice-making connection passage 512 Although not shown, the ice-making connection passage having the same structure may extend from the second body 2*b*. The ice-making cool air passage may be inserted into the ice-making connection passage.

To supply the cool air from the evaporator to the ice maker using the ice-making cool air passage, the ice-making cool air passages 100 and 200 has to pass through a gap generated by the gap maintenance portion 590 and a wall of the vacuum adiabatic body.

As described above, the heat loss occurs along a supply path of the cool air, and particularly, the outside of the vacuum adiabatic body, i.g., the gap between the two vacuum adiabatic bodies provided by the gap maintenance portion 590, may act as an external space having room temperature. The room-temperature space may act as a major path for depriving the cool air required for ice-making, and thermal insulation in the path may create a limitation in supplying the cool air to the ice maker. Thus, this limitation has to be solved.

FIG. 22 is an enlarged view of the ice-making connection passage, and FIG. 23 is a cross-sectional view of the ice-making connection passage, taken along line A-A'.

Referring to FIGS. 22 and 23, it may be seen that the embodiment corresponds to a case in which the ice-making cool air is guided along the side surface of the refrigerator (see FIG. 8).

The ice-making connection passages 511 and 512 that connect the inner spaces of the bodies 2*a* and 2*b* are spaced apart from each other. A conductive resistance sheet 60 may be provided on a wall surface of each vacuum adiabatic body through which the ice-making connection passage passes to reduce thermal conductivity.

An ice-making passage adiabatic material 513 may be provided on an outer surface of each of the ice-making connection passages 511 and 512. A porous material may be provided as the ice-making passage adiabatic material 513 for thermal insulation. The ice-making passage adiabatic material 513 may also perform a role of supporting an impact absorbing function of the vacuum adiabatic body, a role of supporting a load of the first body 2*a*, and preventing damage of the gap maintenance portion 590.

FIGS. 24 to 27 are views of a refrigerator in which the freezing compartment and the freezing compartment are respectively provided by two vacuum adiabatic bodies, wherein the ice-making cool air passage is provided in the bottom surface of the door according to an embodiment. The description related to FIGS. 20 to 23 may be applied as it is without any specific explanation.

Referring to FIGS. 24 and 25, the two main bodies 2*a* and 2*b* are coupled to each other by the gap maintenance portion 590, and a pair of left and right ice-making connection passages 521 and 522 are provided on front portions of the main bodies 2*a* and 2*b*.

Referring to FIGS. 26 and 27, the ice-making connection passages 521 and 522 may pass through the ice-making cool air passages 100 and 200, and the conductive resistance sheet may be provided on the exposed wall surface of each vacuum adiabatic body provided with the ice-making connection passage to reduce a conductive heat loss. The ice-making passage adiabatic material 513 may perform the impact absorbing function of the vacuum adiabatic body, support the load of the first body, and prevent the damage of the body.

In the refrigerator according to this embodiment, a portion corresponding to the mullion in which the ice-making cool air passage is accommodated is not provided. In other words, the inner space of the portion at which the gap maintenance portion 590 is disposed may have room temperature and may not be suitable for allowing very cool air of the ice maker to pass. Reflecting this reason, it is more preferable not to locate an ice-making cool air passage in the gap between the gap maintenance portions 590.

However, it is not excluded from the aspect of the right of the present patent in which the ice-making cool air passage is disposed on the position at which the gap maintenance portion 590 is disposed. It may also be possible that the ice-making cool air passage is disposed in the gap maintenance portion if a sufficient adiabatic operation is performed. Nevertheless, deterioration in energy efficiency due to the adiabatic loss may occur. On the other hand, in this case, in each of the main bodies 2*a* and 2*b*, portions cut to allow the ice-making cool air passage to pass may be different from each other.

Hereinafter, an effect of the ice-making cool air passage according to an embodiment while reviewing a structure of the door that performs the ice making by using the cool air supplied using the ice-making cool air passage having various structures will be described.

A passage, in which the ice-making cool air passage is embedded in the foam portion that is the adiabatic space, is referred to as a foam-embedded ice-making cool air passage, a passage embedded in the side panel that is the inner space within the refrigerator, which is illustrated in FIG. 8, is referred to as a panel-side ice-making cool air passage, and a passage embedded in the mullion that is the inner space within the refrigerator, which is illustrated in FIG. 16, is referred to as a mullion-side ice-making cool air passage.

First, the case of the foam-embedded ice-making cool air passage will be described.

FIG. 28 is an exploded perspective of the door, and FIG. 29 is a horizontal cross-sectional view of a space in which an ice maker is installed. Referring to FIGS. 28 and 29, it is seen that a foam-embedded ice-making cool air passage is provided, an ice maker is provided in the door of the refrigerating compartment, and a rectangular adiabatic panel is installed outside the ice maker.

In an adiabatic structure of the door, the foam adiabatic material 606 is interposed in a gap between an outer case 603 and an inner cover 602 as a whole to improve the adiabatic performance of the door. The ice maker 81 and a basket 604 may be provided in the inner cover 602.

The ice-making cool air passage may be led in and out along the side surface of the door to extend vertically from the side surface of the door.

An adiabatic panel 601 may be inserted into the gap between the foam adiabatic material 606 and the outer case 603 so as to be contributed to the improvement of the adiabatic performance of the door.

The outer case 603 may have a shape of which both ends are bent inward, and an opening for a dispenser 82 may be provided in a lower portion of the outer case 603.

Second, a case of the side panel ice-making cool air passage will be described.

FIG. 30 is an exploded perspective view of a door, FIG. 31 is a horizontal cross-sectional view of the space in which the ice maker is installed, and FIG. 32 is a perspective view of a first vacuum adiabatic module.

Referring to FIGS. 30 and 32, it is seen that a side panel ice-making cool air passage is provided, an ice maker is provided in the door of the refrigerating compartment, and a first vacuum adiabatic module is installed as a three-dimensional vacuum adiabatic module outside the ice maker. A partial technique of various vacuum adiabatic bodies illustrated in FIGS. 1 to 4 may be applied to the first vacuum adiabatic module. However, the first vacuum adiabatic module may be provided in a three-dimensionally curved shape.

The three-dimensional vacuum adiabatic module may not only prevent heat transfer in one direction, but also prevent heat transfer in multiple directions. The first vacuum adiabatic module 610 may prevent heat transfer in the left and right direction as well as the forward direction with respect to the refrigerator door.

The first vacuum adiabatic module 610 may be provided with an upper opening 616 at an upper portion thereof. The upper opening may be opened so that water is introduced toward the door, and a wire passes therethrough. A lower opening 615 may be provided in a lower portion of the first vacuum adiabatic module 610. The lower opening 615 may be opened to provide a dispensing function for water or ice and lead in/out from the wire toward the door.

In the adiabatic structure of the door, the first vacuum adiabatic module 610 may be thermally insulated by being wrapped using a front surface of the door and a side surface of the door, and a foam adiabatic material 606 may be provided outside the side surface of the first vacuum adiabatic module. The inner cover 602, the ice maker 81, the basket 604, and the door-side cool air passage 105, 205 may be disposed inside the first vacuum adiabatic module 610. This is done for a reason this embodiment is different from the first case in that lateral heat conduction is not blocked.

The door-side cool air passages 105 and 205 are shielded once again from the outside by the first vacuum adiabatic module 610. In other words, the door-side cool air passage 105 and 205 are substantially disposed inside the space that is defined by the first vacuum adiabatic module 610 and the space within the refrigerator as walls, and the door-side cool air passages 105 and 205 may be substantially free of a cool air loss.

The ice-making cool air passage may be led in and out along the side surface of the door to extend vertically from the side surface of the door. The outer case 603 may have a shape of which both ends are bent inward, and an opening for a dispenser 82 may be provided in a lower portion of the outer case 603.

Third, the case of the mullion-side ice-making cool air passage will be described.

FIG. 33 is an exploded perspective view of the door, and FIG. 34 is a perspective view of a first vacuum adiabatic module. A cross-sectional view of the door is the same as that in FIG. 31.

In the case of the mullion-side ice-making cool air passage, as illustrated in FIG. 16, the ice-making cool air passage is provided inside the mullion. Also, when compared to the second case, in the door, it is characteristically different that the three-dimensional vacuum adiabatic module is changed to the second vacuum adiabatic module 620.

Specifically, in the outer case 603, a portion on which the dispenser 82 is disposed is referred to as a lower portion L, and an upper portion thereof is referred to as an upper portion U. Here, in the case of the side panel side ice-making cool air passage, only the upper portion may be thermally insulated, and the mullion-side ice-making cool air passage may thermally insulate both the upper portion and the lower portion.

The second vacuum adiabatic module 620 further includes a window dispenser 621 of which a front surface is opened in the form of a window in addition to the upper and lower openings 615 and 616. The window dispenser may allow a user to approach an ice dispenser structure. The conductive resistance sheet may be additionally provided at an edge of the window dispenser 621 so that small heat conduction between the inner and outer plates occurs.

That the door-side cool air passages 105 and 205 are thermally insulated by the vacuum adiabatic module may be the same as the case of the second vacuum adiabatic module 620.

The results of the experiment will be described for the above-described three cases.

FIGS. 35 to 37 are views illustrating thermal efficiency of the ice-making cool air passage in the above-described three cases. FIGS. 35 to 37 are views illustrating a case in which the foam-embedded ice-making cool air passage and the adiabatic panel are installed, FIG. 36 is a view illustrating a case in which the side panel ice-making cool air passage and the first vacuum adiabatic module are installed, and FIG. 37 is a view illustrating a case in which the mullion ice-making cool air passage and the second vacuum adiabatic module are installed.

Each experiment are performed under inflow air having a temperature of about 20 degrees Celsius below zero, a flow rate of about 0.2 CMM, external air having a temperature of about 20 degrees Celsius, a refrigerating compartment temperature of about 3.6 degrees Celsius, and a freezing compartment temperature of about 18 degrees Celsius.

Referring to FIGS. 35 to 37, it is seen that the temperature rise of the cool air at each point appears as a numerical value. Since the temperature rise in the third case is the smallest, it may be considered as having the best adiabatic effect.

Table 1 is a table of the results of experiments with respect to the cool air loss. Here, a heat penetration amount is expressed by a unit of watts (W), and a pressure loss is expressed by a unit of MPa.

TABLE 1

| | Heat penetration amount (1) | Pressure loss (1) | Heat penetration amount (2) | Pressure loss (2) | Heat penetration amount (3) | Pressure loss (3) |
|---|---|---|---|---|---|---|
| Ice-making passage inlet | 4.55 | 21.9 | 3.42 | 18.6 | 1.46 | 14.5 |
| Door inflow duct | 1.74 | 17.9 | 1.75 | 21.3 | 2.42 | 27.9 |
| Ice-making room | 5.78 | 4.0 | 5.33 | 5.7 | 5.05 | 3.3 |
| Door discharge duct | 0.61 | 14.3 | 0.94 | 14.2 | 0.92 | 11.7 |
| Ice-making passage discharge | 2.12 | 14.5 | 1.86 | 15.0 | 0.14 | 3.7 |
| Total | 14.81 | 72.6 | 13.30 | 74.8 | 9.99 | 61.2 |

Referring to Table 1, when compared to the first case, in the second case, an ice-making amount increases by about 10%, and in the third case, an ice-making amount increases by about 20%.

Hereinafter, an example of the three-dimensional vacuum adiabatic module will be described, and a door to which the three-dimensional vacuum adiabatic module is applied will be described in more detail.

The door described in the following description may be defined as another vacuum adiabatic body to which the three-dimensional vacuum adiabatic module is applied. The vacuum adiabatic body described in the following description may be applied to the door that opens or closes the opening of the refrigerator to constitute a portion of the refrigerator.

FIG. 38 is a cross-sectional view of a door in which an ice maker and a door-side basket are installed, and FIG. 39 is an enlarged view of a corner of FIG. 38. FIG. 38 is an emphasized view and may be changed in a specific configuration.

Referring to FIGS. 38 and 39, the three-dimensional vacuum adiabatic module 610 thermally insulates the front surface and both side surfaces of the door. The door-side cool air passages 105 and 205 and the ice maker are disposed in an inner region that is thermally insulated by the three-dimensional vacuum adiabatic module 610. According to such a configuration, adiabatic efficiency may be high, and strength of the door may also be improved.

The configuration of the door will be described in more detail.

The door includes an outer case 603 made of a metal material and defining an outer appearance of a product and an inner case 602 on which a gasket 690 is seated and which is made of a nonmetal material to reduce heat transfer from the outer case 603. The outer case 603 and the inner case 602 may be provided as a single body to define an outer appearance of the door. The three-dimensional vacuum adiabatic module is provided to provide an adiabatic structure along the outer appearance of the door. According to the three-dimensional vacuum adiabatic module 610, the front and side surfaces of the door may be thermally insulated. Ends of the outer case 603 and the inner cover 602 may be coupled to each other.

The ice maker coupled to the inner cover 602 and the basket coupled to the inner cover may be additional another products of the door, and usability of the door may be further improved. The inner cover may extend into the refrigerator to provide an inner space within the refrigerator.

The inner cover 602 may use an ABS resin having high strength to protect a thin conductive resistance sheet together with the inner foam portion.

At least a portion of the space between the inner cover 602 and the outer case 603 may be filled with a foam adiabatic material made of polyurethane. The foam adiabatic material may be provided on an edge of the door to increase in deformation strength of the door against external force.

A first plate 10 and a second plate 20 may be provided to define a vacuum space of the three-dimensional vacuum adiabatic module 610. The second plate 20 may be in contact with the outer case 603, and an outer surface of the second plate 20 may be filled with the foam portion.

At least one of the first and second plates 10 and 20 may be provided to have a thickness less than that of the outer case 603.

For example, one of the first and second plates including areas D, E, and F among the first and second plates may be a thickness less than that of the outer case. The first and second plates 10 and 20 may be in contact with each other to provide a seal 61.

The reason why at least one of the first and second plates is provided thinner than the outer case will be described.

If the conductive resistance sheet is used as a separate portion in the connection portion between the first and second plates, dew may be extremely generated on the conductive resistance sheet. To cope with the dew generation, the thickness of the door may increase due to an increase in thickness of the adiabatic material in a peripheral portion.

As a length of a heat conduction path provided by the conductive resistance sheet increases, the thickness of the conductive resistance sheet may increase. The shorter the length of the heat conduction path provided by the conductive resistance sheet, the greater the thickness of the conductive resistance sheet. On the other hand, the thinner the thickness of the conductive resistance sheet, the greater the difficulty in welding the conductive resistance sheet to the first and second plates.

In an embodiment, to solve this limitation, at least a portion of the first and second plates 10 and 20 may be provided by itself to be thinner than the outer case so that a function of the conduction resistance sheet is performed. As a result, the conductive resistance sheet having a long thermal conductivity pass may be provided to minimize an occurrence of the dew by minimizing an amount of heat transfer in the vicinity of the conductive resistance sheet.

In this case, the thickness of the adiabatic material in the vicinity of the door may be reduced in a Y-axis direction (a front and rear direction of the door), and a door thickness in the Y-axis direction may be reduced.

In the three-dimensional vacuum adiabatic module 610, a first extension module 6101 extending in an X-axis direction and a second extension module 6102 extending along a lateral direction of the door in the Y-axis direction may be provided as one body. The extension modules 6101 and 6102 may share the vacuum space and be bend to extend substantially at an angle of about 90 degrees. The three-dimensional vacuum adiabatic module 610 may have a single vacuum space in which different extension modules 6101 and 6102 communicate with each other. The different extension modules 6101 and 6102 may have a support 30 and a radiation resistor 32 provided therein. A separate portion of the support and the radiation resistor may be used for each extension module.

Accordingly, a heat loss in the lateral direction (the X-axis direction) of the door may be reduced by allowing the vacuum space that is defined in only the X-axis direction, to extend in another axial direction (for example, the Y-axis direction). Thus, when compared to the case of using the foam adiabatic material, the thickness of the adiabatic material of the peripheral portion of the door may be reduced in the X-axis direction, and the door thickness in the X-axis direction may be reduced.

As a result, according to the three-dimensional vacuum adiabatic module, since the thickness of the door is be reduced, a size of the door of the refrigerator may be provided to be smaller, and the inner space of the door may be provided to be larger.

The characteristics of the three-dimensional vacuum adiabatic module may be understood through comparison with a vacuum adiabatic panel (vacuum insulation panel) having a low degree of vacuum, with an adiabatic material made of a porous material, and having a metal or non-metal outer shell.

First, in the case of a vacuum insulating panel having a metal outer shell, it is difficult to fabricate a panel in a bent shape while supporting the porous material therein, and the inside and outside of the bent outer shell may communicate with each other to cause leakage of the cool air and the dew generation.

In the case of the vacuum adiabatic panel in which the outer shell is made of the nonmetal, an outgassing is too large, and thus it is difficult to maintain the vacuum. Thus, there is a limitation in that separate coating is required to prevent the outgassing.

The three-dimensional vacuum adiabatic module has the advantage of solving these limitations. Particularly, when applied to the door of the refrigerator, a wall thickness of the refrigerator door may be reduced, and a size of the refrigerator door may increase.

A sheet thinner than the outer case 603 may be used on the area E. In some cases, a conductive resistance sheet thinner than each of the first and second plates 10 and 20 may be used. The reason is that the area E overlaps a region occupied by the gasket 690, and each of the outside and inside of the door has a high temperature with respect to the gasket. To reduce the heat transfer of the inner space as much as possible, it is seen that an energy nose 608 is provided inside the gasket 690.

The area E is an area to which the plate is connected and may be defined as an area in which an amount of heat conduction increases in a longitudinal direction of the plate.

A foam adiabatic material 606 is provided outside the area D as described above to reinforce the strength of the door.

To provide each of the extension modules 6101 and 6102 of the vacuum adiabatic module 610, the second plate 20 may have a surface defining all three-dimensional surfaces. For example, based on the drawings, a surface extending in a direction parallel to the outer surface of the door may be a vertical surface with respect to the Y axis, and four surfaces that are bent inward with respect to the surface may be vertical surfaces with respect to the X axis and Z axis. As a result, the second plate may have a first surface parallel to the outer surface of the door and a second surface perpendicular to the first surface.

The disclosed contents of the second vacuum adiabatic module 620 having the window may be applied to the door according to this embodiment.

A door to which the three-dimensional vacuum adiabatic module is applied according to another embodiment will be described. If there is no special mention and it is applicable, the above description may be also applied to the following description.

FIG. 40 is a cross-sectional view of a door to which a three-dimensional multi-bent vacuum adiabatic module is applied according to another embodiment.

Referring to FIG. 40, in this embodiment, a three-dimensional multi-bent vacuum adiabatic module includes a plurality of extension modules having different extension directions. Thus, the three-dimensional multi-bent vacuum adiabatic module according to this embodiment may be referred to as a first multi-bent vacuum adiabatic module 630.

The first multi-bent vacuum adiabatic module 630 includes a first extension module 6301 extending along an extension direction of a front surface of the door, a second extension module 6302 extending along a side surface of the door from an outer end of the first extension module 6301 toward the inside of the refrigerator, and a third extension module 6303 extending from the second extension module 6302 toward the inside of the door.

The first extension module 6301 may extend up to at least one end of the front door.

An adiabatic effect may be continuously realized from the front surface of the door to an inlet end of the side surface.

The first and second extension modules 6301 and 6302 may wrap and thermally insulate the front portion of the door. Thus, the front portion of the door may be maintained with more rigid strength. Also, the adiabatic efficiency of the door may be improved.

The third extension module 6303 is bent to the inside (the X-axis direction) of the door to extend. In detail, the second extension module 6302 disposed at a right end of the first multi-bent vacuum adiabatic module 630 is bent to a left side to extend to the inside of the door. Likewise, the second extension module 6302 disposed at a left end of the first multi-bent vacuum adiabatic module 630 is bent to a right side to extend to the inside of the door.

The third extension module 6303 may increase in adiabatic effect in the X-axis direction to reduce a wall thickness of the door, thereby increasing in inner space of the door.

The first multi-bent vacuum adiabatic module 630 may be provided in a structure that is bent at three places to increase in its own structural strength. If the door has the same standard, when the first multi-bent vacuum adiabatic module 630 is used, the size of the door may be further reduced.

A conductive resistance sheet may be provided at an end of the third extension module 6303 and be thermally insulated by the foam adiabatic material 606 to reduce an adiabatic loss of the vacuum adiabatic module 630.

FIG. 41 is a cross-sectional view of a door to which a three-dimensional multi-bent vacuum adiabatic module is applied according to further another embodiment. In this embodiment, the specific aspects of the extension of the second and third extension modules 6302 and 6303 are different from those of the first multi-bent vacuum adiabatic module 630, and other portions are the same. Therefore, a description of another embodiment that has not been specifically disclosed may be applied as it is.

Referring to FIG. 41, in this embodiment, a three-dimensional multi-bent vacuum adiabatic module includes a plurality of extension modules having different extension directions. The three-dimensional multi-bent vacuum adiabatic module in this embodiment may be referred to as a second multi-bent vacuum adiabatic module 640 that is distinguished from the first multi-bent vacuum adiabatic module 630.

The second multi-bent vacuum adiabatic module 640 includes a first extension module 6401 extending along an extension direction of a front surface of the door, a second extension module 6402 extending from the first extension module 6401 toward the inside of the refrigerator, i.e., in the Y-axis direction, and a third extension module 6403 extending from the second extension module 6402 toward the outside of the door, i.e., in the X-axis direction.

In this embodiment, an outer end of the first extension module 6401 may be aligned with a side surface of the accommodation space of the door. Accordingly, the second extension module 6402 may provide a boundary surface of the accommodation space of the door.

The third extension module 6403 may extend by being bent outward from an inner end of the second extension module 6402. The third extension module 6403 may have high strength by increasing in moment of inertia of the second multi-bent vacuum adiabatic module 640.

Of course, various advantages described through other embodiments may also be included as it is in this embodiment.

FIG. 42 is a cross-sectional view of a door using a three-dimensional vacuum adiabatic module according to further another embodiment. This embodiment is similar to the foregoing embodiment in the three-dimensional vacuum adiabatic module 610 illustrated in FIG. 38, but is different from the foregoing embodiment in that the second extension module 6102 extends. Therefore, descriptions related without specific description will be applied as it is.

Referring to FIG. 42, a three-dimensional vacuum adiabatic module 610 according to this embodiment includes a first extension module 6101 and a second extension module 6102. The second extension module 6102 may extend along an inner accommodation space of a door to provide a boundary wall of the accommodation space, similar to the second extension module 6402 of the second multi-bent vacuum adiabatic module 640.

The second extension module 6402 may extend substantially to an inner end of the door. For example, the second extension module 6402 may extend to an inner end of an inner cover 603. Accordingly, an advantage of maximizing an adiabatic effect using a vacuum adiabatic body may be maximized.

This embodiment will be described in more detail with reference to FIG. 42.

Referring to FIG. 42, in more detail with respect to this embodiment, the refrigerator may include a main body having an accommodation space and an opening that allows access to accommodation space and a door that opens and closes the accommodation space. The door may include an outer case 603 corresponding to the outside of the door. The outer case may be made of a metal. The door may include an inner cover 602 corresponding to the inside of the door. A gasket may be seated on the inner cover 602. The inner cover may be made of a nonmetal material to reduce heat transfer from the outer case 603.

The refrigerator may include a first adiabatic module 650 and a second adiabatic module 660 disposed in a gap between the outer case and the inner cover. The first adiabatic module may be provided as a three-dimensional vacuum adiabatic module, for example, the first vacuum adiabatic module 610 may be applied.

The first vacuum adiabatic module includes a first plate 10 defining at least a portion of a wall for the first space and a second plate 20 defining at least a portion of a wall for the second space and having a temperature different from the first space.

The first plate 10 may include a plurality of layers. The second plate 20 may include a plurality of layers. For example, the inner cover 602 may be understood as a 2nd second first plate. The outer case 603 can be understood as a 2nd second plate.

The refrigerator may further include a seal configured to seal the first plate and the second plate so as to provide a third space that is in a vacuum state and has a temperature between a temperature of the first space and a temperature of the second space.

The refrigerator may further include a support that maintains the third space.

The first vacuum adiabatic module 650 may further include a conductive resistance sheet connecting the first plate to the second plate to reduce an amount of heat transferred between the first plate and the second plate.

At least a portion of the conductive resistance sheet may be disposed to face the third space. The conductive resistance sheet may be disposed between an edge of the first plate and an edge of the second plate. The conductive resistance sheet may be disposed between a surface on which the first plate faces the first space and a surface on which the second plate faces the second space. The conductive resistance sheet may be disposed between a side surface of the first plate and a side surface of the second plate. At least a portion of the conductive resistance sheet may extend in a direction that is substantially the same as the direction in which the first plate extends.

A thickness of the conductive resistance sheet may be thinner than at least one of the first plate or the second plate. The more the conductive resistance sheet decreases in thickness, the more heat transfer may decrease between the first plate and the second plate. One end of the conductive resistance sheet may be disposed to overlap at least a portion of the first plate. This is done for providing a space for coupling one end of the conductive resistance sheet to the first plate. The coupling method may include welding. The other end of the conductive resistance sheet may be arranged to overlap at least a portion of the second plate. This is done for providing a space for coupling the other end of the conductive resistance sheet to the second plate. The coupling method may include welding.

The more the conductive resistance sheet decreases in thickness, the more it may be difficult to couple the conductive resistance sheet between the first plate and the second plate. As another embodiment of replacing the conductive resistance sheet, the conductive resistance sheet may be deleted, and one of the first plate and the second plate may be thinner than the other. In this case, any thickness may be greater than that of the conductive resistance sheet. In this case, any length may be greater than that of the conductive resistance sheet. Thus, the heat transfer may be reduced while removing the conductive resistance sheet. Also, difficulty in coupling the first plate to the second plate may be reduced.

At least a portion of the first plate and at least a portion of the second plate may be disposed to overlap each other. This is done for providing a space for coupling the first plate to the second plate. An additional cover may be disposed on any one of the first plate and the second plate, which has a thin thickness. This is done for protecting the thinned cover.

In this embodiment, the second adiabatic module 660 may have an adiabatic degree less than that of the first adiabatic module. The second adiabatic module 660 may be provided as a foam adiabatic material 606.

The second adiabatic module 660 may have a vacuum level less than that of the first adiabatic module. The second adiabatic module 660 may be a non-vacuum adiabatic module or be made of a nonmetal. The second adiabatic module may be made of a resin or foamable PU. The second adiabatic module 660 may be convenient for mounting or coupling components when compared to the first adiabatic module 610. Since the first adiabatic module has a vacuum space defined therein, there may be difficult to mount or couple the components.

The second adiabatic module may be disposed between the plurality of first adiabatic modules or may be disposed on the first adiabatic module. The second adiabatic module 660 may be provided to define at least a portion of a wall connecting a plurality of first adiabatic modules to each other. The second adiabatic module may be arranged to contact side surfaces of the plurality of first adiabatic modules.

To reduce an amount of heat transfer between the first plate and the second plate, the first plate may be provided to have a thickness less than that of the second plate. Such the configuration may reduce the thickness of the first adiabatic module 610 in a Y-axis direction described above.

The second adiabatic module 660 may be arranged to contact the inner cover 602 to define at least a portion of the wall on which the component is seated.

The first adiabatic module 650 may include a first extension module 6101 of which at least a portion extends in the X-axis direction and a second extension module 6102 of which at least a portion extends in the Y-axis direction. Such the configuration may reduce the thickness of the first adiabatic module 610 in an X-axis direction described above.

At least one of the first plate 10 or the second plate 20 may be provided to have a thickness less than that of the outer case 603.

At least a portion of the first extension module 6101 may extend along a front surface of the door. At least a portion of the second extension module 6102 may extend along a side surface of the door. The first extension module and the second extension module may extend by bending a single body.

Door-side cool air passages 105 and 205 may be disposed in an inner space defined by the first and second extension modules.

The ice maker 81 may be disposed in the inner space defined by the first and second extension modules.

INDUSTRIAL APPLICABILITY

According to the embodiment, the vacuum adiabatic module applied to the door of the refrigerator may be optimized to thermally insulate the door using the thinner and smaller adiabatic space. As a result, the accommodation space provided in the door may increase in volume.

According to the embodiment, the performance of the ice maker mounted on the door may be improved. Also, the adiabatic space of the door may be more effectively provided by the three-dimensional vacuum adiabatic module.

According to the embodiment, it may be possible to further access to the actual production of the refrigerator utilizing the high vacuum and obtain the advantage that may be used industrially.

The invention claimed is:

1. A refrigerator door comprising:

a vacuum adiabatic body including:

a first plate;

a second plate;

a sheet configured to seal the first plate and the second plate to provide a vacuum space between the first plate and the second plate; and a support configured to maintain an interval of the vacuum space; and an outer case configured to contact the second plate and including a metal material, the outer case being thicker than at least a portion of at least one of the first plate or the second plate, wherein the vacuum adiabatic body includes at least two sections extending in different directions and including a first section and a second section, and wherein each of the first section and the second section includes the first plate, the second plate and the vacuum space.

2. The refrigerator door according to claim 1, wherein the outer case is thicker than each of the first plate and the second plate.

3. The refrigerator door according to claim 1, further comprising an inner cover coupled to the outer case, the inner case including a non-metal material and being provided at a side of the first plate.

4. The refrigerator door according to claim 3, wherein a foam adiabatic material is provided in a space between the inner cover and the outer case.

5. The refrigerator door according to claim 1, wherein the first section extends in a first direction, and the second section extends from the first section in a second direction.

6. The refrigerator door according to claim 5, wherein the vacuum adiabatic body includes a plurality of the supports, and at least one of the supports is provided separately for each of the first and second sections.

7. The refrigerator according to claim 1, wherein the second plate of the first section defines an exterior surface of the door.

8. A refrigerator comprising:

a main body having an accommodation space and an opening configured to allow access to the accommodation space; and a door configured to open and close the opening to the accommodation space, wherein the door includes:

an outer case including a metal material, the outer case corresponding to an outside of the door;

an inner cover on which a gasket is seated and which includes a nonmetal material to reduce heat transfer from the outer case, the inner cover corresponding to an inside of the door; and a vacuum adiabatic module provided between the outer case and the inner cover, the vacuum adiabatic module including a first plate and a second plate, which are provided to define a vacuum space therein, and wherein at least one of the first plate or the second plate has a thickness less than that of the outer case, the vacuum adiabatic module includes a first section extending in a first direction and a second section extending in a second direction perpendicular to the first direction, and at least a portion of the first section defines an exterior surface of the door.

9. The refrigerator according to claim 8, further comprising a cool air passage extending through an inner space defined by the vacuum adiabatic module.

10. The refrigerator according to claim 8, wherein the at least a portion of the first section defines a front surface of the door, and at least a portion of the second section extends along a side surface of the door.

11. The refrigerator according to claim 10, wherein a foam adiabatic material surrounds the second section to allow the second section to be covered by the foam adiabatic material.

12. The refrigerator according to claim 8, wherein the vacuum adiabatic module is a single body in which the second section extends from the first section.

13. The refrigerator according to claim 10, wherein the vacuum adiabatic module further includes a third section extending from an end of the second section.

14. The refrigerator according to claim 8, wherein the second plate contacts the outer case, and a foam adiabatic material provided outside the second plate.

15. The refrigerator according to claim 8, wherein the inner cover extends to form a portion of a wall defining the accommodation space.

16. The refrigerator according to claim 8, wherein at least a portion of the second section defines the exterior surface of the door.

17. A refrigerator comprising:

a main body having an accommodation space and an opening configured to allow access to the accommodation space; and a door configured to open and close the opening to the accommodation space, wherein the door includes:

an outer case including a metal material, the outer case corresponding to an outside of the door;

an inner cover on which a gasket is seated and which includes a nonmetal material to reduce heat transfer from the outer case, the inner cover corresponding to an inside of the door; and a first adiabatic module and a second adiabatic module, which are positioned between the outer case and the inner cover, wherein the first adiabatic module includes:

a first plate;

a second plate;

a sheet configured to seal the first plate and the second plate to provide a vacuum space between the first plate and the second plate; and a support configured to maintain an interval of the vacuum space, wherein the second adiabatic module is provided to have an adiabatic degree less than that of the first adiabatic module and contacts the inner cover, wherein the first adiabatic module includes a first section and a second section that extend in different directions, wherein the first section defines an exterior surface of the door, and wherein the second adiabatic module surrounds the second section and is covered by at least one of the outer case or the inner cover.

18. The refrigerator according to claim 17, wherein at least one of the first plate or the second plate has a thickness less than that of the outer case.

19. The refrigerator according to claim 17, wherein at least a portion of the first section of the first adiabatic module defines a front surface of the door, at least a portion of the second section of the first adiabatic module extends along a side surface of the door, and the first adiabatic module includes a single body in which the second section extends from the first section.

20. The refrigerator according to claim 17, wherein an ice maker is positioned in an inner space defined by the first section and the second section of the first adiabatic module.

21. The refrigerator according to claim 17, wherein a cool air passage is positioned in an inner space defined by the first section and the second section of the first adiabatic module.

* * * * *